US006408549B1

(12) United States Patent
Quenzi et al.

(10) Patent No.: US 6,408,549 B1
(45) Date of Patent: Jun. 25, 2002

(54) ADJUSTABLE WING PLOW

(75) Inventors: Philip J. Quenzi, Atlantic Mine; Cal G. Niemela; Curt E. Niemela, both of Chassell, all of MI (US)

(73) Assignee: Blizzard Corporation, Calumet, MI (US)

( * ) Notice: Subject to any disclaimer, the term of this patent is extended or adjusted under 35 U.S.C. 154(b) by 0 days.

(21) Appl. No.: 09/689,494

(22) Filed: Oct. 12, 2000

(51) Int. Cl.[7] ..... E01H 5/06
(52) U.S. Cl. ..... 37/281
(58) Field of Search ..... 37/241, 281, 282, 37/283, 234, 232, 266, 272, 274, 279, 269, 903; 172/782, 684.5, 786, 815, 816

(56) References Cited

U.S. PATENT DOCUMENTS

| | | | | |
|---|---|---|---|---|
| 595,202 | A | 12/1897 | Pearson et al. | |
| 1,927,078 | A | 9/1933 | Weeks | 37/44 |
| 2,219,512 | A | 10/1940 | Ball | 37/42 |

(List continued on next page.)

FOREIGN PATENT DOCUMENTS

| | | |
|---|---|---|
| DE | 919474 | 7/1949 |
| EP | 140139 | 5/1985 |
| GB | 1037674 | 8/1966 |
| SE | 323974 | 5/1970 |

OTHER PUBLICATIONS

Commonly Assigned Co–Pending U.S. application No. 09/243,908, filed Feb. 3, 1999 by Philip J. Quenzi et al. for Plow Hitch Assembly for Vehicles.

*Farm Industry News*, vol. 23, No. 7, Jul./Aug. 1990, p. 25.

Publication "Still Out Front in Productivity," Excel Industries, Inc., ®1988.

"Snow Track 440," Publication, Excel Industries, 1989.

Snow Craft Industries, Inc. Publication, Sedall, Colorado, published more than one year prior to the filing date of this application—No Date.

(List continued on next page.)

*Primary Examiner*—Robert E. Pezzuto
(74) *Attorney, Agent, or Firm*—Van Dyke, Gardner, Linn & Burkhart, LLP

(57) ABSTRACT

A plow assembly for vehicles such as pickup trucks and tractors for moving snow or other materials, as well as for bulldozers, graders and the like for excavating and grading dirt, sand, gravel or other plowable materials, has at least one extendable, forwardly pivotable plow wing which is extendable on one end of a main plow by sliding movement along the front of the plow between a retracted and an extended position. The plow wing is also pivotally mounted on a hinge for movement between an aligned position and a forwardly angled position in which the plow wing front surface extends at an angle to the plow front surface. At least one fluid power cylinder is connected to the plow wing to move the wing between the retracted, extended, aligned, and forwardly angled positions. In the preferred embodiment, an extendable plow wing is included on each end of the main plow with a pair of fluid cylinders connected to each of the respective plow wings. The fluid cylinders are operable independently of one another to move the plow wings independently between their respective retracted, extended, aligned and forwardly angled positions. When both plow wings are pivoted to their forwardly angled positions, the plow assembly has a general U-shape which facilitates pushing snow, dirt, sand or other plowable material without the material slipping off the plow blade ends. The plow wings may be pivoted to their forwardly angled positions irrespective of the degree of extension of the wings from the main plow blade. Similarly, the plow wings may be extended or retracted irrespective of the degree of forward angling of the plow wing with respect to the main plow blade.

64 Claims, 29 Drawing Sheets

U.S. PATENT DOCUMENTS

| | | | | |
|---|---|---|---|---|
| 2,299,451 | A | 10/1942 | Austin | 37/44 |
| 2,410,543 | A | 11/1946 | Kester | 37/44 |
| 2,524,329 | A | 10/1950 | Richardson | 37/44 |
| 2,643,470 | A | 6/1953 | Kaeser | |
| 3,157,099 | A | 11/1964 | Ulrich | |
| 3,250,026 | A | 5/1966 | Jocher et al. | 37/42 |
| 3,302,317 | A | 2/1967 | Domres | 37/179 |
| 3,378,084 | A | 4/1968 | Ulrich | 172/247 |
| 3,425,497 | A | 2/1969 | Strabala et al. | 172/792 |
| 3,430,706 | A | 3/1969 | Marron | 172/802 |
| 3,477,151 | A | 11/1969 | Zanella | 37/42 |
| 3,657,828 | A | 4/1972 | Anderson | 37/46 |
| 3,775,877 | A | 12/1973 | Gove, Sr. | 37/42 |
| 3,803,733 | A | 4/1974 | Ramsey | 37/44 |
| 3,807,664 | A | 4/1974 | Schmidt, Jr. | 37/41 |
| 4,019,268 | A | 4/1977 | Waterman | 37/10 |
| 4,073,077 | A | 2/1978 | Essel | 37/50 |
| 4,074,448 | A | 2/1978 | Niemela | 37/41 |
| 4,099,478 | A | 7/1978 | Stevens | 172/802 |
| 4,145,825 | A | 3/1979 | Bertolino | 37/42 |
| 4,196,532 | A | 4/1980 | Muller | 37/105 |
| 4,249,323 | A | 2/1981 | Mathis et al. | 37/42 |
| 4,275,514 | A | 6/1981 | Maura | 37/42 |
| RE31,045 | E | 10/1982 | Essell | 37/281 |
| 4,356,645 | A | 11/1982 | Hine et al. | 37/281 |
| 4,369,847 | A | 1/1983 | Mizunuma | 172/815 |
| 4,372,617 | A | 2/1983 | Zamboni | 229/24 |
| 4,479,312 | A | 10/1984 | Turgeon | 31/219 |
| B14,356,645 | A | 11/1984 | Hine et al. | 37/281 |
| 4,614,048 | A | 9/1986 | Melby | 37/280 |
| 4,658,519 | A | 4/1987 | Quenzi | 37/23 |
| 4,667,426 | A | 5/1987 | Howard et al. | 37/232 |
| 4,723,609 | A | 2/1988 | Curtis | 172/815 |
| 4,779,363 | A | 10/1988 | Boutrais et al. | 37/117 |
| 4,834,191 | A | 5/1989 | Vecchio | 172/784 |
| 4,962,600 | A | 10/1990 | Zellaha et al. | 37/280 |
| 5,165,191 | A | 11/1992 | Davis | 37/117.5 |
| 5,285,588 | A | 2/1994 | Niemela et al. | 37/234 |
| 5,375,349 | A | 12/1994 | Jochim | 37/429 |
| 5,392,538 | A | 2/1995 | Geerligs et al. | 37/268 |
| 5,411,102 | A | 5/1995 | Nickels et al. | 172/781 |
| 5,638,618 | A | 6/1997 | Niemela et al. | 37/281 |
| 5,829,174 | A | 11/1998 | Hadler et al. | 37/234 |
| 5,899,007 | A | 5/1999 | Niemela et al. | 37/281 |

OTHER PUBLICATIONS

Commonly Assigned, Co–Pending U.S. application No. 09/689,004, filed Oct. 12, 2000 by Philip J. Quenzi et al. for Plow With Rear Mounted, Adjustable Wing.

Commonly Assigned, Co–Pending U.S. application No. 09/689,524, filed Oct. 12, 2000 by Philip J. Quenzi et al. for Adjustable Wing Plow With Fixed Pivot.

ADJUSTABLE WING PLOW

FIELD OF THE INVENTION

This invention relates to plows fitted on vehicles for moving snow, dirt, sand, gravel and other plowable and/or excavatable materials and, more particularly, to a plow for snow and other materials for use with pickup trucks and other vehicles having plow wings which are individually adjustable for extension of the main plow and/or forward angling for positioning the plow to prevent snow or other plowed material from slipping off the ends of the plow.

BACKGROUND OF THE INVENTION

A wide variety of snow plows for pickup trucks and other utility vehicles are available and in use. These include straight bladed plows of the type shown in U.S. Pat. No. 3,250,026, and center-hinged, V-plows of the type shown in U.S. Pat. Nos. 4,074,448 and 4,658,519. Other straight bladed plows have been devised with one or both ends being slidably extendable as shown in U.S. Pat. No. 2,218,512; U.S. Pat. No. 3,807,064; and Swedish 323,974. Yet other plows have included straight blades with pivotable, non-extendable ends as shown in U.S. Pat. Nos. 4,145,825 and 3,477,151. At least one plow is shown in EPO 140,139 having permanently forwardly angled plow ends, which forwardly angled plow ends include slidable extensions wherein the entire plow swings from side to side so as to angle the entire plow left or right.

While each of the above types of prior known plows is useful in one or more situations, the overall flexibility for use of these plows has been limited. For example, for truck mounted plows which must be transported from one site to another for clearing snow or other materials, it is necessary that the plow be short enough to allow transport on public highways which have limited lane width. However, when actually engaged in plowing, it is very helpful to have a greater length for the plow so that larger areas of the parking lot or other site can be cleared of snow more quickly. Yet another problem encountered is when large amounts of snow or other plowable material must be pushed or carried with the plow from one area of a clearing site to another such as the side of a parking lot. Many of the above mentioned plows allow snow or other material being cleared to slip off the ends of the plow thereby requiring additional time and work to completely clear the site.

Some plows have been proposed which provide adjustable plow wings which are extendable and retractable and may be pivoted forwardly from their extended positions to form a generally U-shaped plow to assist in retaining snow or other material on the plow blade as it is pushed along. Such plows are disclosed in U.S. Pat. Nos. 5,899,007 and 5,638,618. Such plows are operable to first extend the plow wings and then pivot the wings forwardly.

Many existing, prior known plows have, therefore, failed to provide a plow with sufficient flexibility to handle the varying needs encountered in plowing using pickup trucks or other vehicles, especially when such vehicles must be driven on public highways, or when excavating or grading using a bulldozer, grader or the like. Such needs include a short enough plow length to allow transportation on public highways, a long enough length for fast, efficient clearing of a job site, and the carrying or pushing of snow, dirt, sand, gravel or the like from one area to another without allowing the material to slip off the plow ends. In addition, plows should be as light in weight as possible while sufficiently strong to withstand the various forces imposed thereon during plowing of various materials, should allow for proper visibility during use as well as when moved to a non-use position on the vehicle, and should allow ease in repair or replacement of those parts subject to high wear during plowing use. All of these results should be accomplished while minimizing the size and space required for the plow in each of its arrangements.

SUMMARY OF THE INVENTION

Accordingly, the present invention provides a plow having adjustable wings on its ends which can be adjusted to varying positions to allow transport on public highways, to provide increased plow length for fast, efficient clearing of snow or other material being plowed, and to allow carrying or pushing of plowable material from one area to another without the plowed material slipping off the plow ends. The present plow may be configured in various arrangements to handle each of these situations while minimizing the size and space required by the plow when in position on the vehicle. The present plow also allows adjustment to meet these various situations from a remote position in the cab of the vehicle without external, hands on adjustment.

According to an aspect of the present invention, a plow assembly for vehicles comprises a plow, a support for attaching the plow to the vehicle, a plow wing on one end of the plow, and an actuating device connected to the plow wing and operable to move the plow wing between an aligned position and a forwardly angled position and to move the plow wing between a retracted position and an extended position. The plow includes opposite ends, a front material engaging surface, and a rear surface opposite the front surface. The plow wing has an inner end and an outer end, a front material engaging surface, and a rear surface opposite the front surface. The plow wing is mounted for sliding movement along the plow between a retracted position in which the outer end of the wing is adjacent the end of the plow, and an extended position in which the outer wing is spaced outwardly from the retracted position and the end of the plow. The plow wing includes a hinge and is pivotally mounted on the hinge for movement between an aligned position in which the front material engaging surface of the plow wing is aligned with the front material engaging surface of the plow, and a forwardly angled position in which the wing front surface extends at an angle to the plow front surface. The actuating device is operable to move the plow wing between the aligned position and the forwardly angled position at least when the plow wing is in the retracted position.

In one form, the actuating device is operable to move the plow wing to the forwardly angled position prior to moving the plow wing from the retracted position to the extended position. The actuating device may comprise a single extendable and retractable actuator, such as a hydraulic cylinder, which is operable to first pivot the plow wing to the forwardly angled position and then to extend the plow wing laterally outwardly from the plow. The plow assembly may include a latch or restraining mechanism which prevents laterally outward movement of the plow wing until after the plow wing has been fully angled forwardly with respect to the plow, in which position the restraining mechanism disengages and allows extension of the plow wing in response to further extension of the actuator.

Preferably, a second plow wing is similarly positioned and operable at the opposite end of the plow. Optionally, the plow wings are operable by a separate pair of actuating devices, whereby one of the actuating devices of each pair is operable to extend and retract a respective one of the plow wings, while the other of the actuating devices of each pair is operable to pivot the respective plow wing between the aligned and forwardly angled positions.

According to another aspect of the present invention, a plow assembly for vehicles comprises a plow, a support for attaching the plow to the vehicle, first and second plow wings, and at least one first actuator operable to move the first plow wing and at least one second actuator operable to move the second plow wing. Each of the plow wings preferably has a cross sectional contour corresponding to the plow. The first wing is mounted for sliding movement along the front surface of the plow at one end, while the second wing is mounted for sliding movement along the front surface of the plow at the other end. Each of the wings are movable between the retracted position in which the outer end of the wing is adjacent to its respective end of the plow, and an extended position in which the outer wing and is spaced outwardly from the retracted position and its respective end of the plow. Each of the plow wings also includes a hinge and is pivotally mounted on the respective hinge for movement between an aligned position in which the front surface of the plow wing is aligned with the front surface of the plow, and a forwardly angled position in which the front surface of the plow wing extends at an angle to the plow front surface. Each of the plow wings is operable independently of the other plow wing, such that the plow wings are independently movable between the respective retracted, extended, aligned and forwardly angled positions. The plow wings form a generally U-shape with the plow when both plow wings are in their forwardly angled positions to facilitate pushing material being plowed without such materials slipping off the plow ends. The actuators are operable to move the respective plow wings between the aligned position and the forwardly angled position irrespective of a degree of extension of the respective plow wing from the plow.

Preferably, the plow assembly includes first and second slides mounted to the plow. The first plow wing and first hinge are mounted on and movable with the first slide, while the second plow wing and second hinge are mounted on and movable with the second slide. Preferably, each slide is telescopically mounted within a housing on the rear surface of the plow. The plow includes first and second openings therethrough, such that the hinges of the plow wings extend through the respective openings to support the respective plow wing for sliding movement along the front surface of the plow.

In one form, the material engaging surface of the plow includes a first section formed of metal and a second section formed of polymeric material, such that the second section has a weight less than the first section. Preferably, the first metal section extends from the ground engaging edge to an intermediate position spaced above the ground engaging edge. The plow wing is mounted for sliding movement along the first section. The second polymeric section extends from the intermediate position to the top of the plow.

Preferably, the plow assembly includes a support frame for attaching the plow to the vehicle. The plow is pivotally mounted on the support frame for movement about a first generally vertical pivot axis from a centered position extending generally transverse to the longitudinal axis of the vehicle, to a series of angled positions in which the plow is angled to the left or right of the center position.

Optionally, each of the first and second actuators includes a pair of actuators, whereby one of the actuators of each pair is operable to move the respective plow wing between the extended and retracted positions, while the other one of the actuators of each pair is operable to pivot the plow wing between the aligned position and the forwardly angled position. Preferably, each actuator of the two pairs of actuators is operable independently of one another, such that each wing may be independently extended, retracted, aligned, and/or forwardly angled with respect to the plow.

Accordingly, the present plow assembly provides numerous advantages over prior known plows. The present plow has sufficient flexibility to handle varying needs including being short enough in length when not extended to allow transport on public highways without projecting into adjacent lanes. Either one or both the ends of the plow may be angled forwardly for highly efficient carrying and/or pushing of plowed material from one location in the area being plowed to another without the plowed material slipping off the plow ends. The angled ends may be extended to a sufficient length to allow fast, efficient clearing of snow or other material being plowed from a large area. The plow wings may be angled forwardly from a retracted position of the wings, such that the plow may form a generally U-shaped plow, without first having to extend the plow wings laterally outwardly from the main plow. All of these functions are accomplished in the present plow with a minimal size and space due to its compact and efficient construction. The plow may be centered for pushing or carrying of snow or other plowed material, or angled to one side or the other for moving snow or other material to the side of the vehicle supporting the plow. One or both plow wings at the ends of the plow may be pivoted forwardly and/or may be extended independently or together, while the entire plow may be centered or angled to one side or the other with one or both of the plow wings extended or pivoted forwardly. In either case, the plow wings at either end of the main plow are independently movable to a forwardly angled position and/or extendable via remote control from the cab of the vehicle by means of hydraulic fluid cylinders mounted along the back of the plow. Either a single fluid cylinder or a pair of fluid cylinders may be mounted to move each plow wing. When a pair of fluid cylinders is used for each wing, any latch or spring mechanism for preventing or restraining laterally outward movement of the wing to its extended position is eliminated since one fluid cylinder pivots the plow between extended and forwardly angled positions and operates to lock the plow wing in whatever pivotal position it is found, while the other cylinder extends and retracts the plow wing relative to the plow blade, irrespective of the angle at which the wing is pivoted.

In addition, both the main plow and the extendable wings pivot forwardly on a horizontal axis in the event an obstacle is encountered during plowing. Further, when the plow wings are extended, if the vehicle is moved in reverse and a quantity of snow or other material being plowed engages the rear surface of either plow wing, either a latch or spring mechanism or a fluid cylinder maintains the plow wing in alignment with the plow blade and prevents movement to the forwardly angled position until desired. In addition, the extendable, adjustable plow of the present invention has been designed in a highly compact, lightweight manner allowing use on a wide variety of pickup trucks, tractors and other vehicles as well, including bulldozers, graders, or other excavation or construction vehicles. The plow may be supported at the front of a vehicle via the preferred support frame or by means such as vertical supports positioned behind the plow assembly such as in a road grader. In addition, the plow assembly of the present invention is rugged, strong and highly durable to allow use in harsh weather or environmental conditions over an extended period of time.

These and other objects, advantages, purposes and features of the invention will become more apparent from a study of the following description taken in conjunction with the drawings.

DESCRIPTION OF THE PREFERRED EMBODIMENTS

First Embodiment

Figure 14:
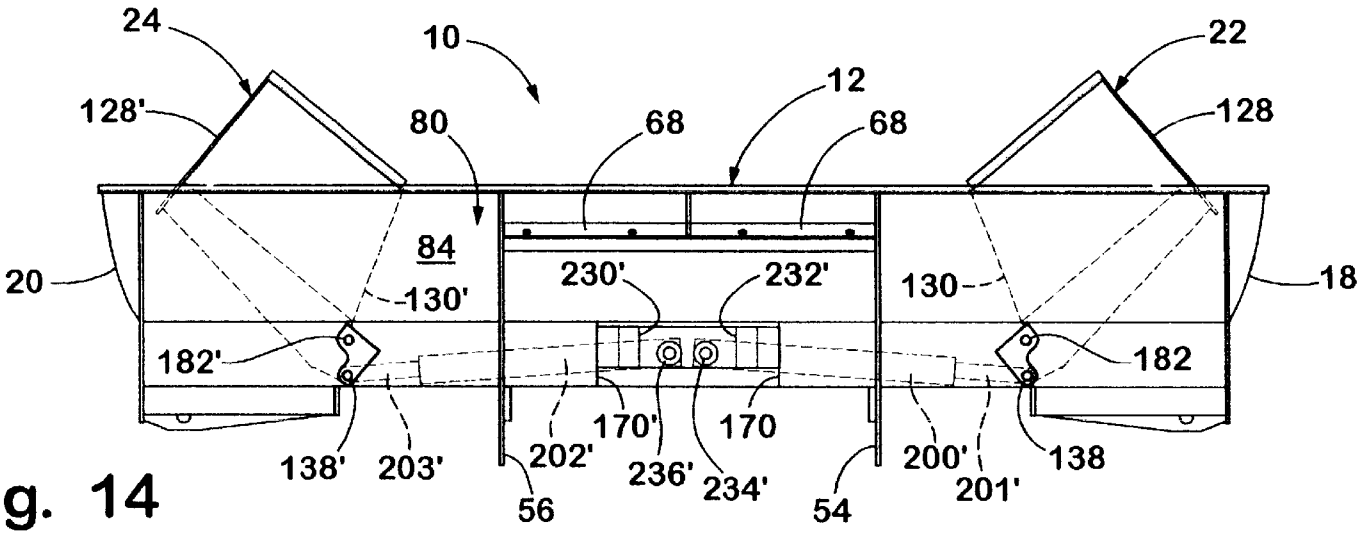
FIG. 14 is a top plan view of the plow assembly of the present invention with the plow wings angled forwardly.
Figure 15:
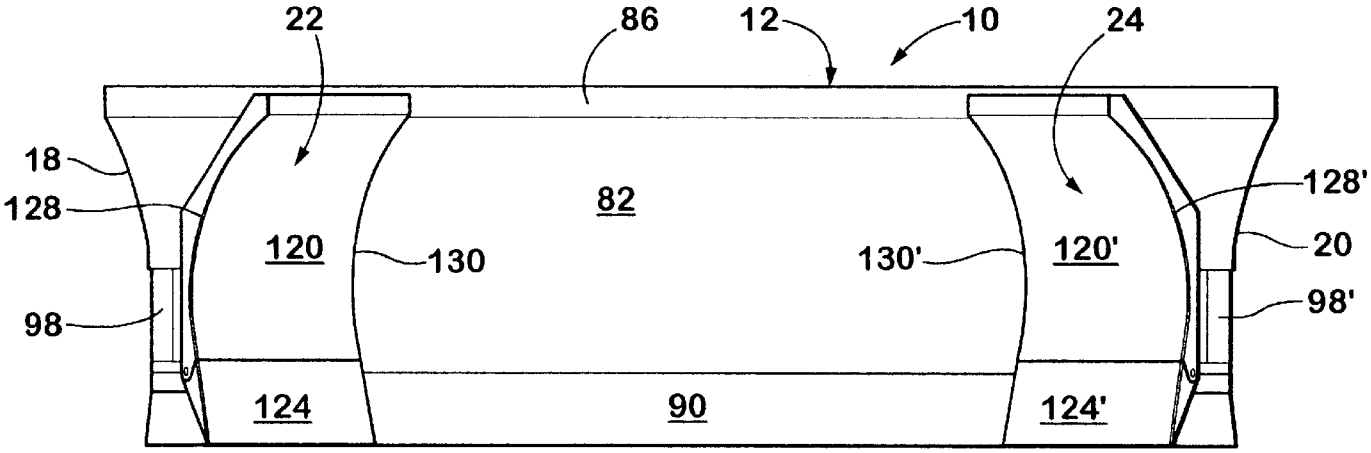
FIG. 15 is a front elevation of the plow assembly of FIG. 14 with the plow wings angled forwardly.
Figure 16:
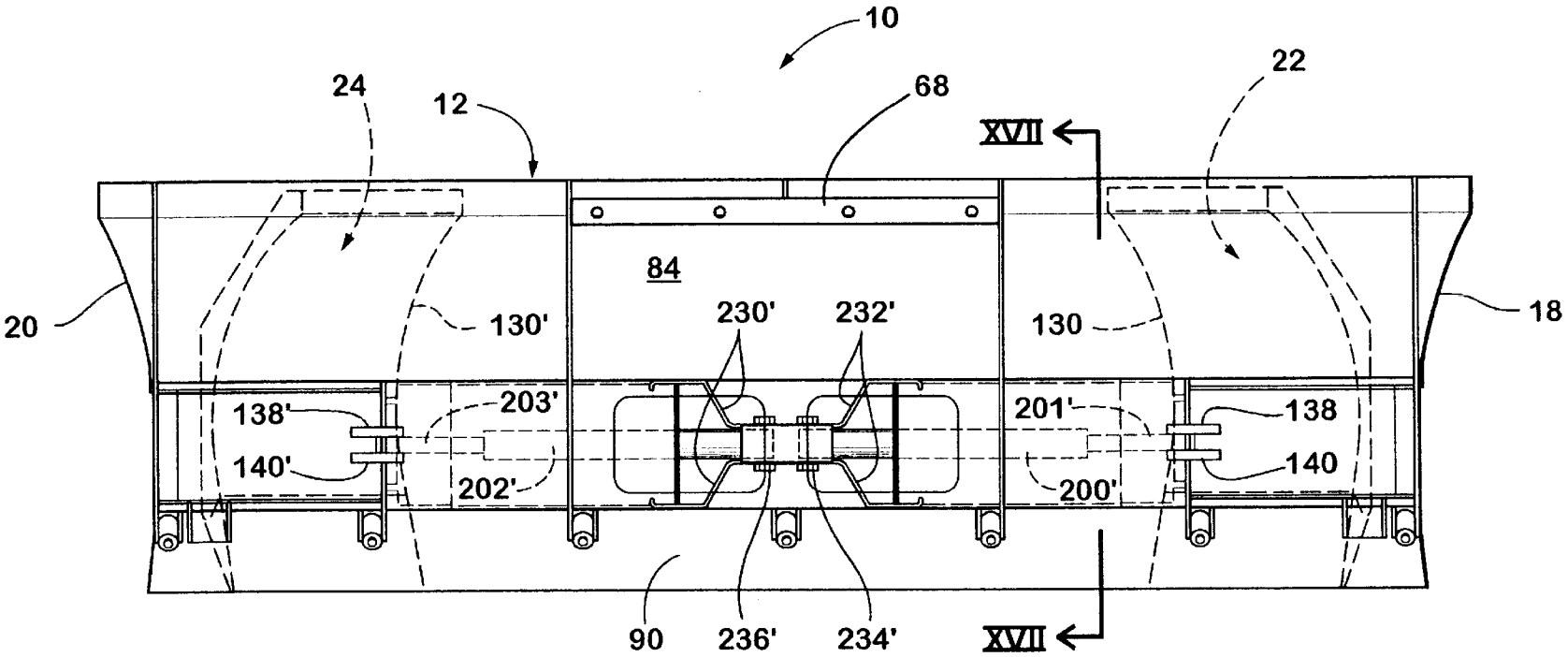
FIG. 16 is a rear elevation of the plow assembly of FIGS. 14 and 15.

Referring now to the drawings in greater detail, a first preferred embodiment 10 of the adjustable wing plow assembly of the present invention includes a reinforced main plow 12 pivotally mounted on a support frame 14 via an intermediate support 16. Slidably mounted at opposite ends 18, 20 of main plow 12 are extendable plow wings 22, 24 which are moved by actuators, such as fluid power cylinders 200, 202 remotely controlled from the cab of the pickup truck, dozer, grader, or other vehicle on which the plow assembly 10 is mounted. Wings 22, 24 are independently slidably movable between retracted positions as shown in FIGS. 1–5, forwardly angled positions in which the plow assembly has a generally U-shaped configuration as shown in FIGS. 14–16, and fully extended and angled positions as shown in FIGS. 19–22. Plow assembly 10 is primarily adapted for plowing snow when attached to the front of a transport vehicle such as a pickup truck, utility vehicle, tractor, or the like via support frame 14. However, other materials, such as dirt, sand, gravel, bark mulch, and the like, can also be moved with the plow. In addition, plow 12 can be mounted on other vehicles, such as bulldozers, graders or other construction or excavation vehicles, and in other ways besides via support frame 14, such as by vertical supports secured to the rear of the plow as explained more fully below.

Figure 1:
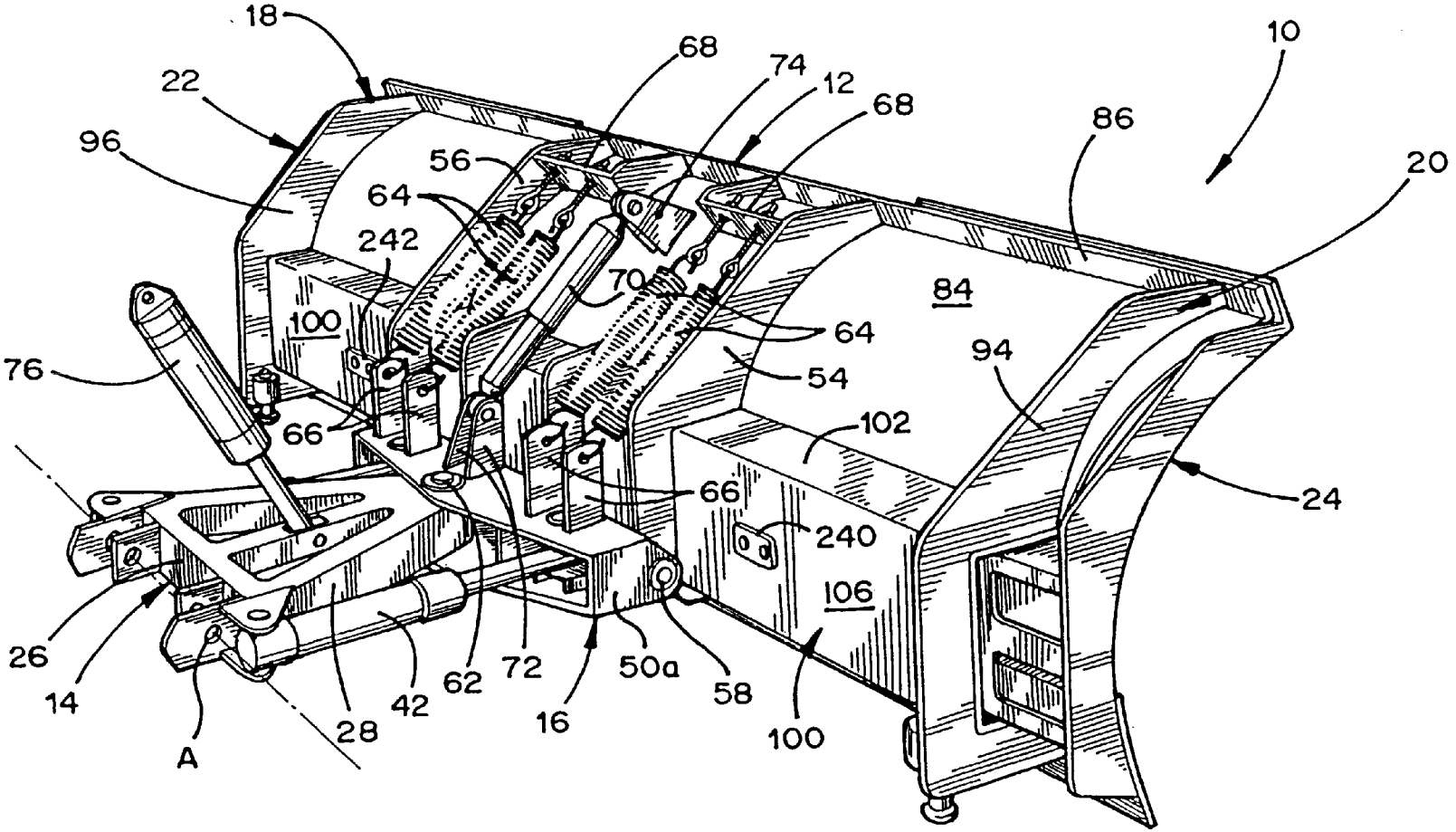
FIG. 1 is a rear perspective view of the adjustable wing plow assembly of the present invention wherein the plow wings are retracted and the plow is centered on a support frame.

Both support frame 14 and intermediate support 16 are shown in FIG. 1 and are preferably similar to the support frame and intermediate support disclosed in commonly assigned U.S. Pat. Nos. 5,638,618 and 5,899,007, which are hereby incorporated herein by reference, such that a detailed discussion of the support frame and intermediate support need not be included herein. However, plow assembly 10 may otherwise be mounted to a vehicle via any other mounting means, such as via conventional mounting arms, frames or supports, without affecting the scope of the present invention. As is best seen in FIGS. 1, 2, 4 and 19, support frame 14 is of the type suitable for attachment to the front of a pickup truck or the like and includes a triangularly shaped, reinforced framework having a base 26, inwardly tapering sides 28, 30 leading to a forward apex 32, and spaced pairs of rearwardly extending support flanges 34, 36 on base 26 adapted to allow frame 14 to be secured to a suitable hitch assembly on the front of a pickup truck or other vehicle for pivotal movement about a horizontal axis A extending through the support flanges. Laterally extending pairs of vertically spaced cylinder support flanges 38, 40 extend outwardly from the opposite sides 28, 30 of frame 14 and the outermost support flanges 34, 36. A pair of extendable, single acting, hydraulic fluid cylinders 42, 44 are pivotally mounted, one on either side of frame 14, between cylinder support flanges 38, 40 and pivot pins 46, 48 on intermediate support 16. Pins 46, 48 extend between spaced upper and lower plates 47, 49 of support 16.

Intermediate support 16 is an elongated steel beam having a generally U-shaped configuration in cross section (FIG. 4), upper and lower plates 47, 49, forward plate 51, and pairs of plow mounting flanges 50*a*, 50*b* and 52*a*, 52*b* welded to the ends of plates 47, 49, 51 and to plate 51 itself and projecting forwardly toward the rear surface of plow 12. Plow 12 includes rearwardly extending, vertically oriented supports or mounting flanges 54, 56 extending between flanges 50*a*, 50*b* and 52*a*, 52*b*, respectively, for mounting on horizontal rods 58, 60 aligned on a common horizontal axis B (FIG. 2) to allow the entire plow 12 to pivot about that horizontal axis. Intermediate support 16 is, in turn, pivotally mounted to apex 32 of support frame 14 by a generally vertically extending pivot pin 62. By controlling the extension and retraction of fluid cylinders 42, 44, intermediate support 16 and plow 12, which is mounted thereon, may be moved to a series of angled positions such that plow 12 is swung and angled to the left or right about pivot 62. Plow 12 is biased to an upright position about horizontal axis B on pins 58, 60 by a series of biasing members such as coil springs 64 which extend between mounting flanges 66 extending upwardly from the top surface of intermediate support 16 and support flanges 68 at the top of rear surface 84 of plow 12.

Figure 4:
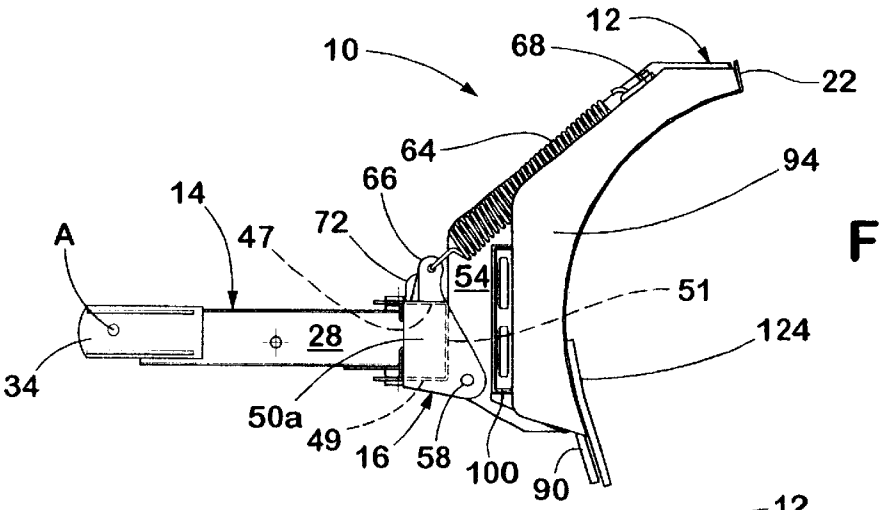
FIG. 4 is an end elevation of the plow assembly of FIGS. 1–3.

In addition, a shock absorber 70 is pivotally mounted between upstanding support flanges 72 on intermediate support 16 and rearwardly extending support flanges 74 on the rear surface 84 of plow 12. Shock absorber 70 dampens the pivotal movement of plow assembly 10 about horizontal axis B on pins 58, 60 after the plow encounters an obstacle along the surface being plowed thereby causing the plow 12 with wings 22, 24 to tip or pivot forwardly against the bias of springs 64. The shock absorber dampens the pivotal movement as of the plow blade as the plow returns or rebounds to its initial position after the plow passes the obstacle. Rearward pivoting of the plow about axis B on pins 58, 60 is limited by the rear, vertical edges of flanges 54, 56 which engage the forward plate 51 on intermediate support 16 (FIG. 4). Forward pivotal movement is limited by springs 64, while rearward or return pivoting is dampened by shock absorber 70. When support frame 14 is pivotally secured to a horizontal axis A on a vehicle via support flanges 34, 36, the entire support frame 14, intermediate support 16 and plow 12 including extendable wings 22, 24 may be lifted away from the ground or other support surface via a retractable hydraulic cylinder 76 as shown in FIG. 1. Cylinder 76 is preferably pivotally mounted between the support frame 14 and a suitable mounting point on the pickup truck or other vehicle.

As will be best seen in FIGS. 1–3, 5, 15–18, 21 and 22, main plow 12 may be an elongated, rectilinear steel moldboard 80 having a concave front surface 82, a convex rear surface 84 and an integral reinforcing flange 86 extending along its upper edge. Secured to a lower flange which extends along the lower edge of moldboard 80 is a reinforcing plate 88 with a replaceable elongated, rectilinear plow blade 90 secured thereto by fasteners 92 having countersunk heads which are flush with the front surface of blade 90 to prevent interference with the material being plowed. Alternately, carriage bolts having rounded heads could be used as fasteners 92. The upper portions of the right and left ends of moldboard 80 are curved to extend outwardly on a large radius curve (FIG. 5) so as to cover the gap between the inner edge of wing extensions 22, 24 and the outer edges of moldboard 80 when plow extensions 22, 24 are pivoted and extended outwardly as shown, for example, in FIGS. 19–22. Alternately, moldboard 80 may be unitarily formed of steel or polymeric materials, and may be formed with the plow blade, or moldboard 80 may comprise an upper, curved section which is formed from a polymeric sheet material, such as an opaque ultra high molecular weight (UHMW) polyethylene or clear polycarbonate, as discussed below with respect to moldboard 380, without affecting the scope of the present invention. The rear surface 84 of moldboard 80 is reinforced with vertically extending supports or mounting flanges 54, 56 on either side of its center, as well as end flanges 94, 96 welded to rear surface 84 adjacent either end.

Extending parallel to the top and bottom edges of moldboard 80 at either end are elongated, rectangular slots 98, 98' best seen in FIGS. 3, 15, 17 and 22. On the rear surface 84 of moldboard 80 is welded a rectangular, steel slide support or housing 100 having a top wall 102, bottom wall 104, and rear wall 106 forming a generally U-shaped enclosure which is larger than slots or openings 98, 98' on the front of the moldboard. As will be explained below, slide support or housing 100 is adapted to receive a generally rectangular inner slide member 170, 170' as best seen in FIGS. 5, 10–13, 16 and 17. Synthetic, elongated wear pad strips 108 may be secured to the inner surfaces of housing walls 102, 104 and 106 to slidably support the slide members inside housing 100 and to maintain the slide members in contact with the rear surface of 84 of moldboard 80 adjacent slots 98, 98'. Preferably, wear pads 108 are formed from ultra high molecular weight (UHMW) plastic, although other materials such as Teflon, steel and/or other materials could also be used. Mounting flanges 54, 56 and reinforcing flanges 94, 96 extend over top wall 102, along rear wall 106 and thereafter along bottom wall 104 of housing 100 and are welded thereto to reinforce the entire assembly. When slide members 170, 170' are received within housing 100 (FIG. 17), their front walls 178, 178', which have a radius of curvature parallel to that of moldboard 80, close slots 98, 98' on either end of main plow 12, such that snow or other material being plowed and moving upwardly along moldboard 80 from plow blade 90 continues along front surface 82 of the moldboard without interruption and without packing into the interior of housing 100. Alternately, slide members 170, 170' may be slidably or movably mounted to other slide support means positioned along the rear of the plow 12, such as an open support frame or upper and lower support rails or the like. Such a mounting scheme facilitates easier access to the actuators, since they are not substantially encased within a housing.

As is best seen in FIGS. 3, 5, 14–16 and 20–22, each plow wing extension 22, 24 is a substantial mirror image of the other, only one being described in detail herein, namely, plow wing 22. Substantially the same elements are included in plow wing extension 24 but are shown with prime numerals.

Figure 18:
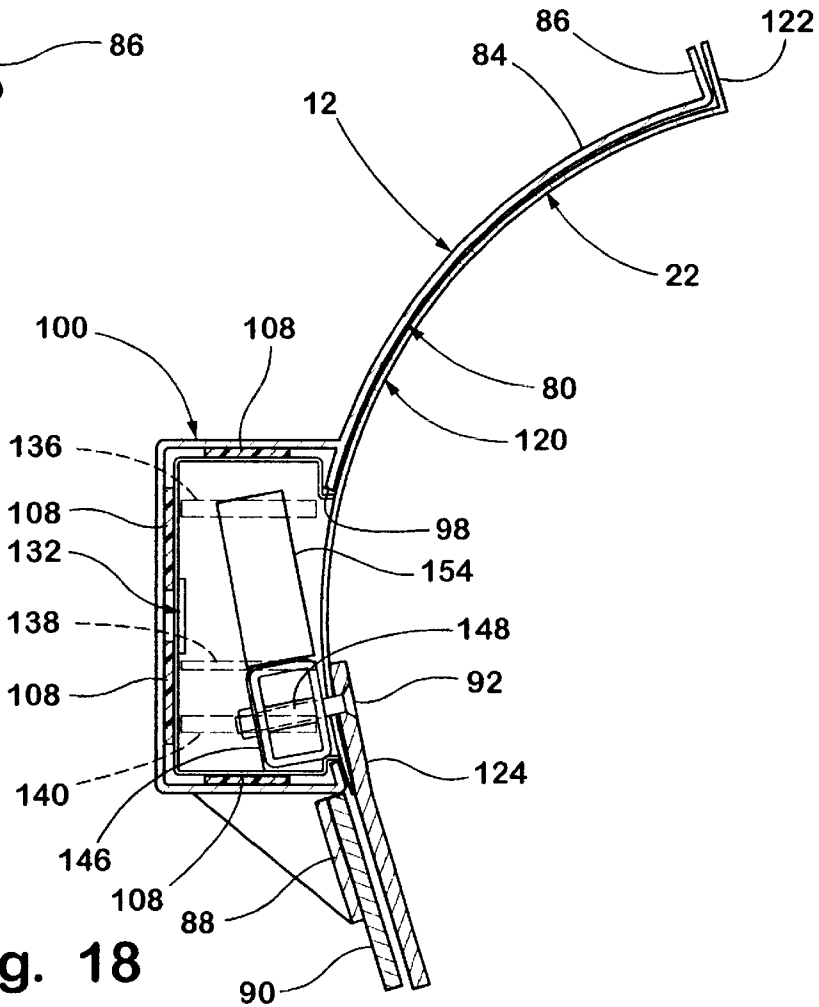
FIG. 18 is a sectional end elevation of one of the extendable plow wings on its slide assembly taken along plane XVIII—XVIII of FIG. 5.

Plow wing extension 22 includes a moldboard section 120 having a radius of curvature substantially the same as that for moldboard 80 and extending parallel to moldboard 80 when mounted on the plow assembly. Wing extension 22 includes an integral, upper flange 122 extending along the front surface of flange 86 at the top of moldboard 80 and extends over slot or opening 98 on the front surface 82 at the end of moldboard 80. A steel extension blade 124, also known as a cutting edge or wear edge, is secured to the front surface of the lower edge of moldboard 120 and extends generally parallel to plow blade 90, as shown in FIG. 18. Blade 124 engages the plowed surface during plowing and may be repaired or replaced when worn. A generally vertical reinforcing flange 126 extends along the outermost edge 128 of wing extension moldboard 120. The innermost edge 130 of moldboard 120 is inclined downwardly and outwardly from the position of upper flange 122.

Figure 7:
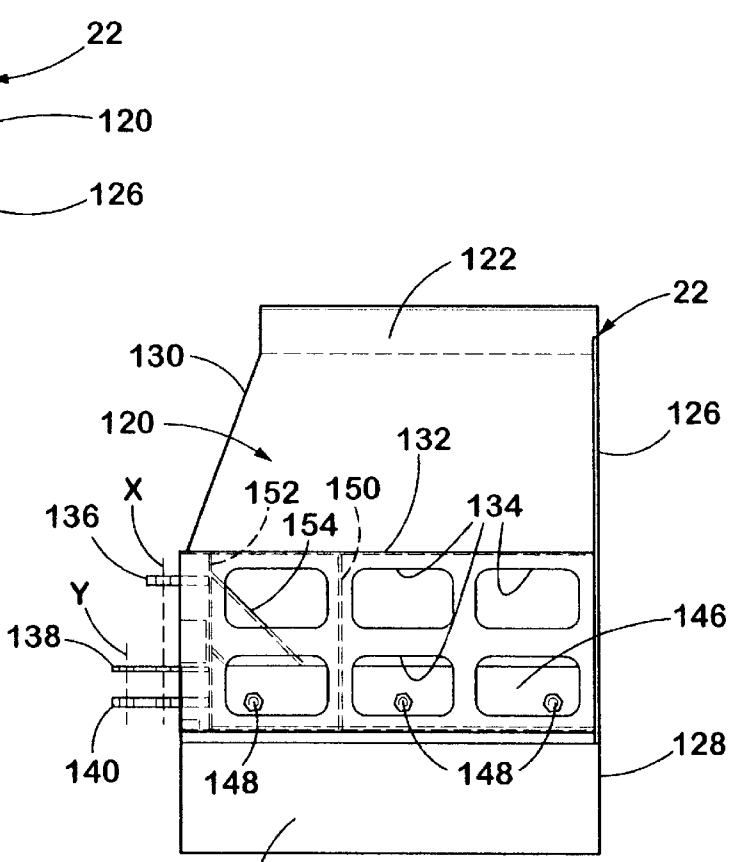
FIG. 7 is a rear elevation of the extendable plow wing of FIG. 6.
Figure 8:
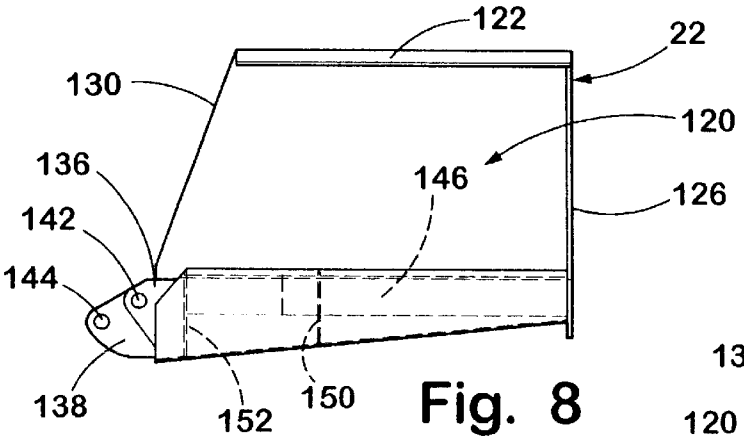
FIG. 8 is a top plan view of the extendable plow wing of FIGS. 6 and 7.
Figure 9:
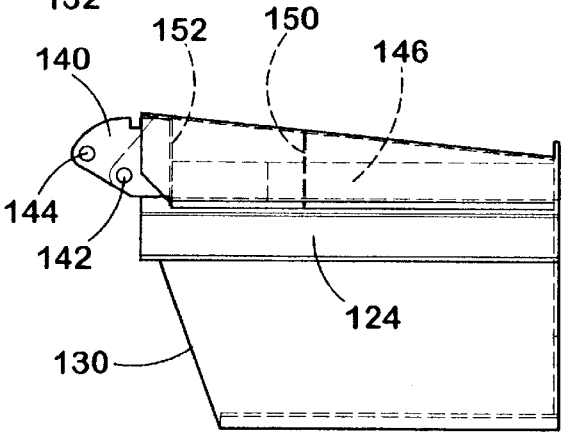
FIG. 9 is a bottom plan view of the extendable plow wing of FIGS. 6–8.
Figure 6:
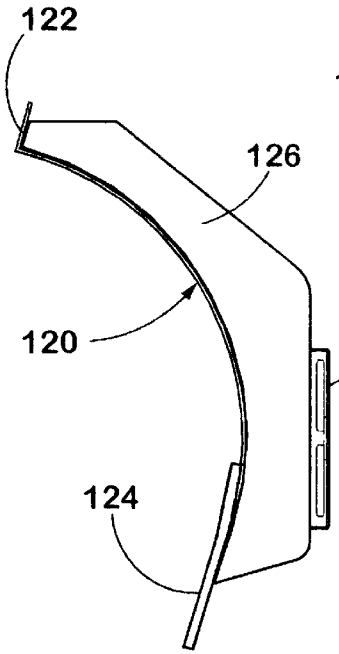
FIG. 6 is an end elevation of one of the extendable plow wings.
Figure 19:
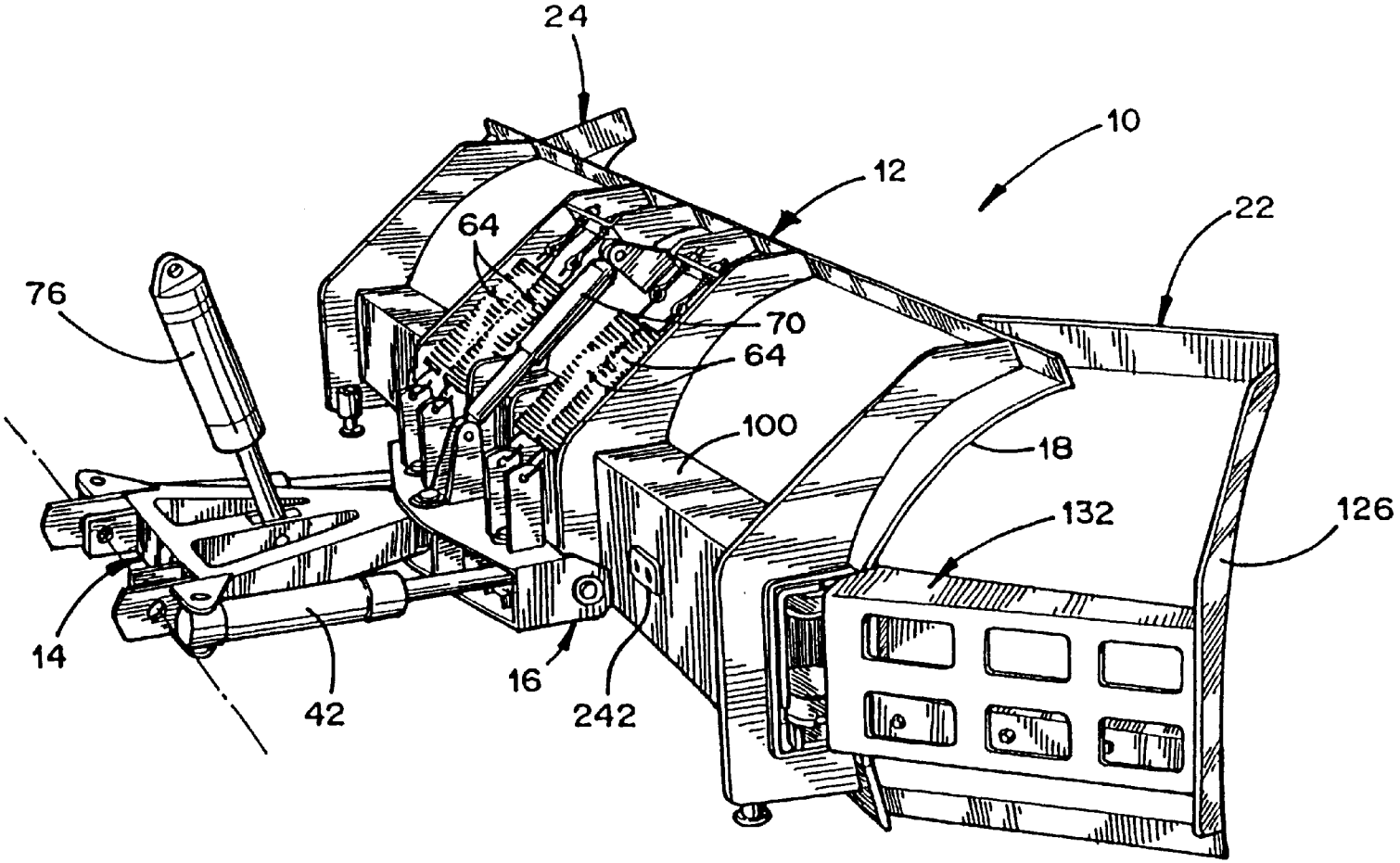
FIG. 19 is a rear perspective view of the plow assembly of the present invention with the plow wings extended and angled forwardly forming a generally U-shaped plow.
Figure 20:
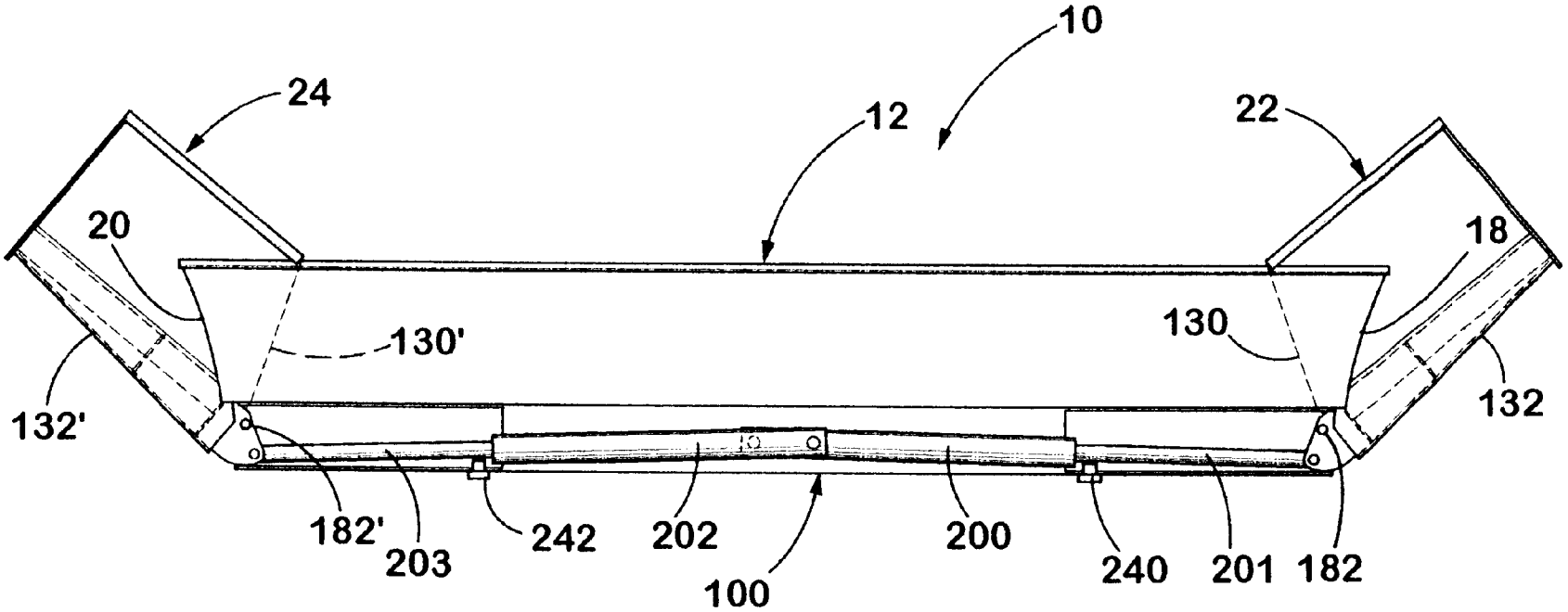
FIG. 20 is a top plan view of the plow assembly in the configuration of FIG. 19 with portions broken away.
Figure 21:
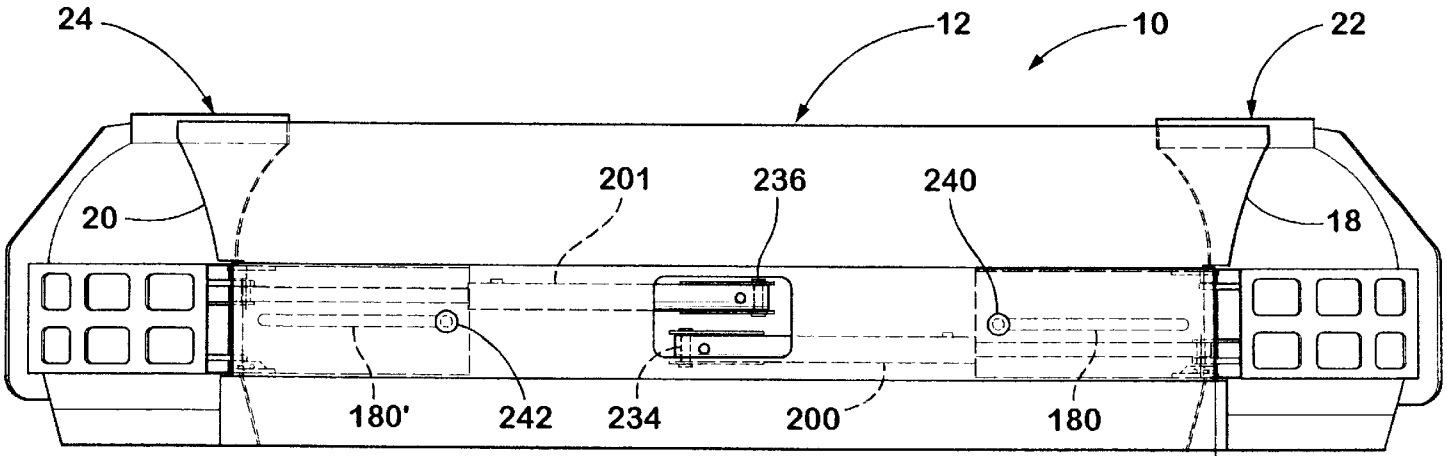
FIG. 21 is a rear elevation of the plow assembly in the configuration of FIGS. 19 and 20.
Figure 22:
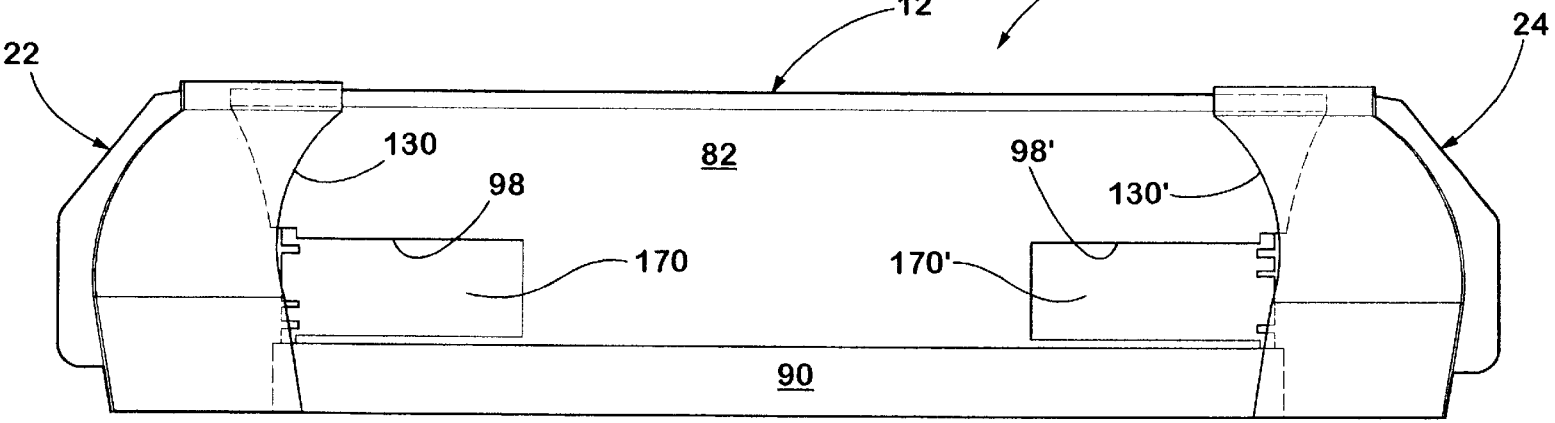
FIG. 22 is a front elevation of the plow assembly in the configuration of FIGS. 19–21.

Extending parallel to the upper and lower edges of wing extension 22 on the rear surface thereof is a tapered housing 132, which may be perforated and have a series of weight reducing, generally rectangular openings 134 formed therethrough, as best seen in FIGS. 7 and 19. Housing 132 is preferably formed from sheet steel bent into a generally U-shaped configuration and welded or otherwise secured to the rear surface of moldboard 120. Housing 132 is slightly smaller than both outer housing 100 and inner slide member 170, as will be understood from FIGS. 5 and 10. At the inner edge of wing extension 22, within housing 132 are a series of three spaced, generally horizontal hinge plates 136, 138, 140 which are best seen in FIGS. 7–9. These hinge plates are welded between the rear surface of moldboard 120 and the interior of housing 132 and project inwardly a predetermined distance. Hinge plate 136 is shorter than plates 138, 140. As shown in FIGS. 7–9, a vertical hinge pivot axis X is provided by aligned apertures 142 extending through the three hinge plates, while a fluid cylinder pivot axis Y is provided by apertures 144 extending through longer hinge plates 138, 140. Hinge pivot axis X is offset from fluid cylinder pivot Y by a predetermined distance, as shown in FIGS. 7–11, to provide a moment arm providing torque for pivoting the wing extension on its hinge axis, as will be explained more fully below. Also mounted within housing 132 is a hollow, rectangular cross section beam 146 which extends along the lower rear surface of moldboard 120 in opposition to the upper edge of extension blade 124. Countersunk, threaded fasteners 148 are passed through the front surface of extension blade 124 and beam 146 to both reinforce the lower edge of the extension moldboard and secure the wing extension blade 124 to the front surface of the moldboard. A pair of generally vertical reinforcing plates 150, 152 are welded within housing 132 at spaced positions, reinforcing plate 152 being adjacent the inner edges of horizontal hinge plates 136, 138, 140, as is best seen in FIG. 7. A diagonal reinforcement or gusset 154 extends between plate 152 and the top surface of beam 146 in each wing extension for additional strength. As will be understood from FIG. 5, plow wing extension 24 is a substantial mirror image of wing extension 22 except that uppermost hinge plate 136' is longer than hinge plate 136. Intermediate hinge plate 138' is spaced more closely to upper plate 136' to allow fastening of the extension rod 203 from a fluid power cylinder 202 which is offset from the position of the fluid power cylinder 200 engaging hinge plates 138, 140 on wing extension 22. In addition, diagonal reinforcing gusset 154' transfers stress from the upper fluid power cylinder 202 to the reinforcing beam 146' in wing extension 24.

With reference to FIGS. 10–13 and 21, each plow wing extension 22, 24 is pivotally mounted to the end of a generally rectangular slide member 170, 170', only one of which is described in detail herein. The subassemblies 160, 160' of slide member 170 and wing extension 22, or slide member 170' and wing extension 24 (FIGS. 10–13), are both adapted to be slidably mounted telescopingly within housing 100 on the rear surface of main plow moldboard 80 to allow extension, retraction and forward angling of the plow wing extensions 22, 24 by fluid power cylinders 200, 202 as referenced above and as explained more fully below.

Figure 17:
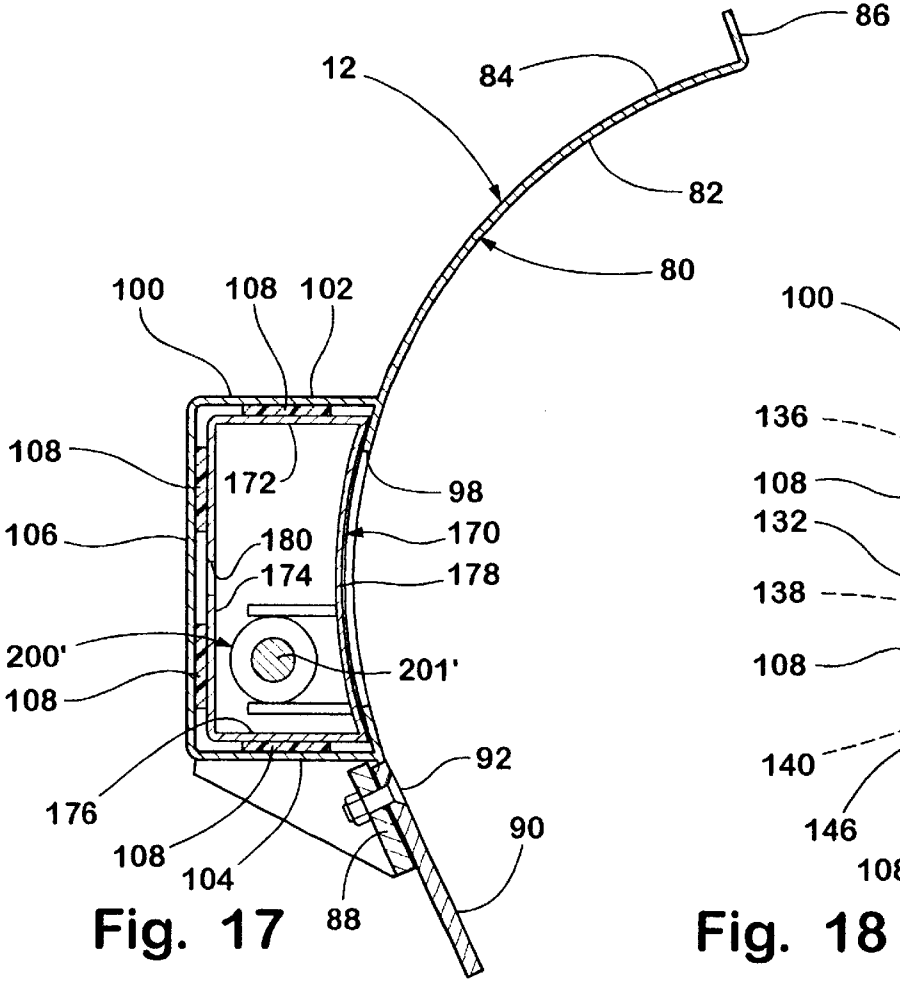
FIG. 17 is a sectional end elevation of the slide assembly for mounting one of the extendable plow wings taken along plane XVII—XVII of FIG. 16.

Each slide member 170, 170' is an elongated beam having a generally rectangular cross section, formed from welded steel, and including a top wall 172, rear wall 174, bottom wall 176, and concave front wall 178. As shown in FIG. 17, the cross-sectional shape generally corresponds to the cross-sectional shape of housing 100. The radius of curvature of front wall 178 is substantially the same as for moldboard 80 such that front wall 178 closes slot 98 or 98' when the plow wing extensions are at least partially extended and/or angled forwardly. Rear walls 174, 174' include elongated, closed slots 180, 180', each adapted to receive a projecting, cylindrical stop 240, 242 which limit the extension and retraction of the slide members, and thus, wing extensions 22, 24, as explained below. Alternately, actuators 200, 202 may provide a stop member, whereby outward movement of slide members 170, 170' is limited by full extension of the actuators or by "bottoming out" of the piston within the hydraulic cylinder actuator, without affecting the scope of the present invention. The right-hand most fluid power cylinder 200 extends through the interior space within slide member 170, while fluid cylinder 202 extends through the interior space in slide member 170' (FIGS. 5, 10, 11, 13, 14, 16 and 17).

Figure 10:
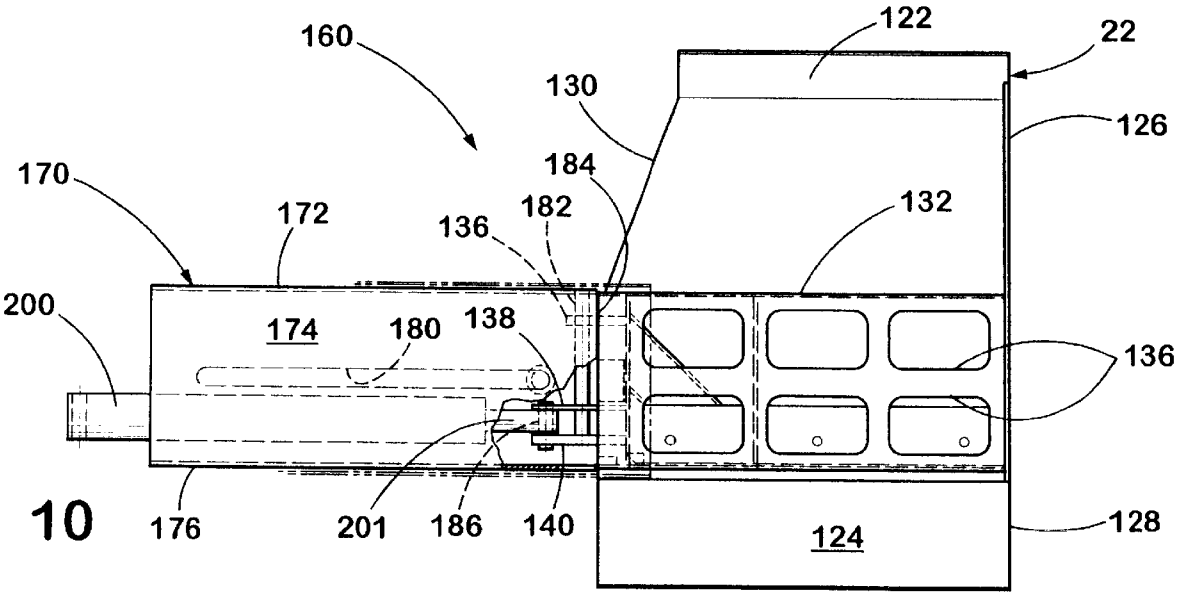
FIG. 10 is rear elevation of the subassembly of a slide, a plow wing pivotally mounted thereon, and fluid cylinder, with the plow wing in its retracted and aligned position.
Figure 11:
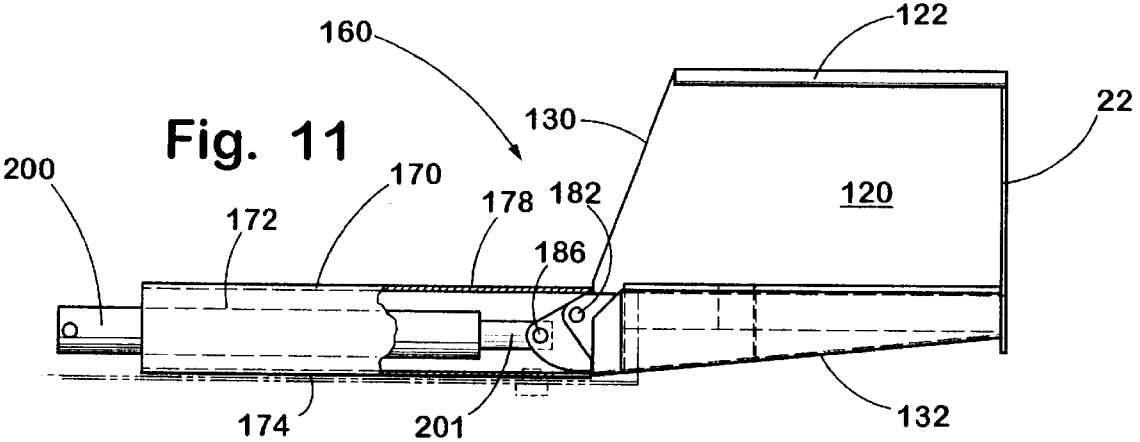
FIG. 11 is a top plan view of the subassembly of FIG. 10.
Figure 13:
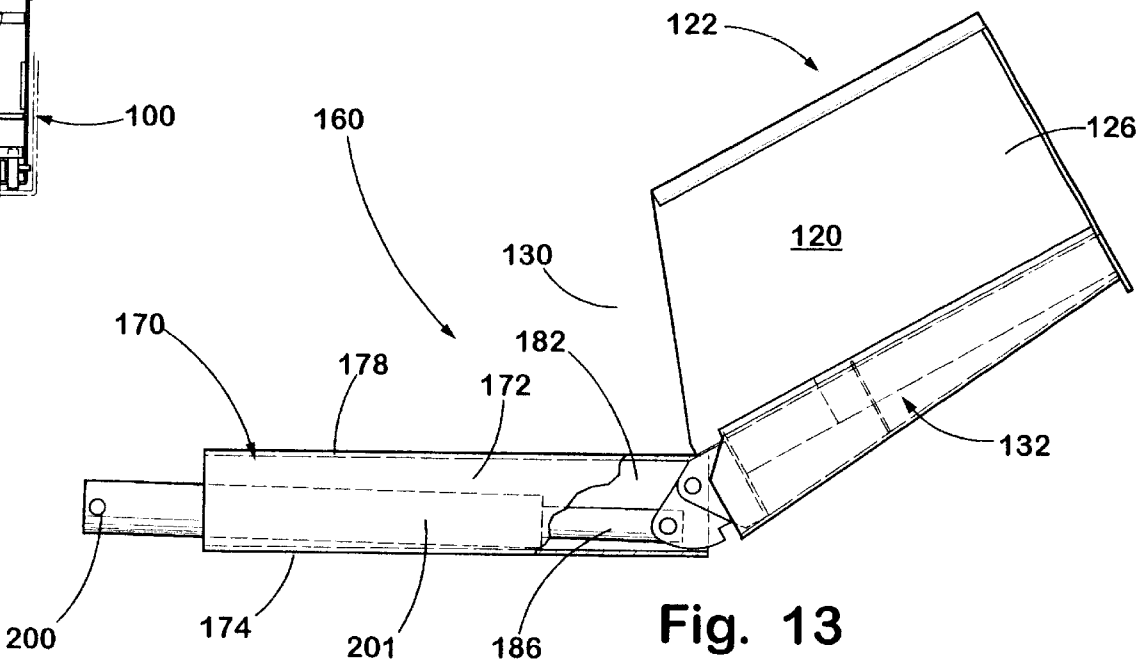
FIG. 13 is a top plan view of the subassembly of FIGS. 10–12 illustrating the plow wing angled forwardly.
Figure 12:
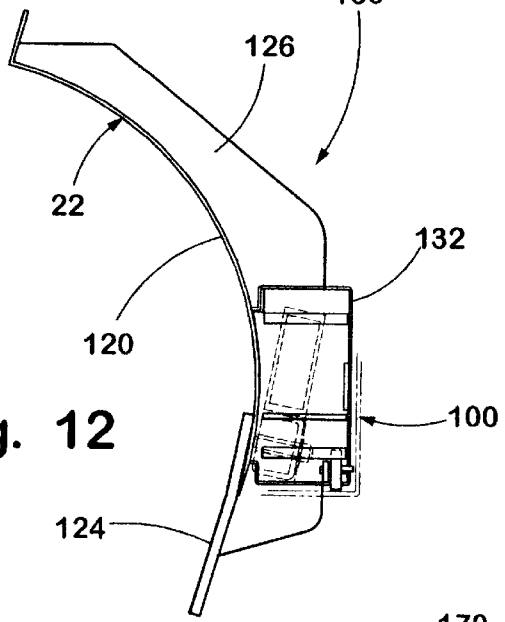
FIG. 12 is an end elevation of the subassembly of FIGS. 10 and 11.

Plow wing extensions 22, 24 are pivotally mounted to the outer ends of elongated slide members 170, 170', respectively, by hinge plates 136, 138, 140. As shown in FIGS. 10 and 11, a hinge pin 182 is welded between top and bottom walls 172, 176 of slide member 170 to extend generally vertically and parallel to the outer end 184 of slide member 170. Hinge pin 182 extends vertically through aligned apertures 142 in the hinge plates such that wing extension 22 pivots on axis X (FIG. 7) from an aligned position, in which moldboard 120 is generally rectilinearly aligned with concave front wall 178 of slide member 170 (FIGS. 10 and 11), to a forwardly angled position, in which moldboard 120 extends at an obtuse angle to the front wall 178 of slide member 170 (FIG. 13). Similarly, a shorter hinge pin 186 extends vertically through hinge plates 138, 140 and apertures 144 on axis Y (FIG. 7) to pivotally secure the outer end of extendable rod 201 from fluid cylinder 200. Because of the offset between the pivot axes X and Y provided by hinge pins 182, 186, when fluid cylinder rod 201 is extended from cylinder 200, the moment arm of the offset created by longer hinge plates 138, 140 rotates wing extension 22 forwardly about hinge pin 182. Likewise, wing extension 24 is rotatable by rod 203 from cylinder 202.

Figure 41B:
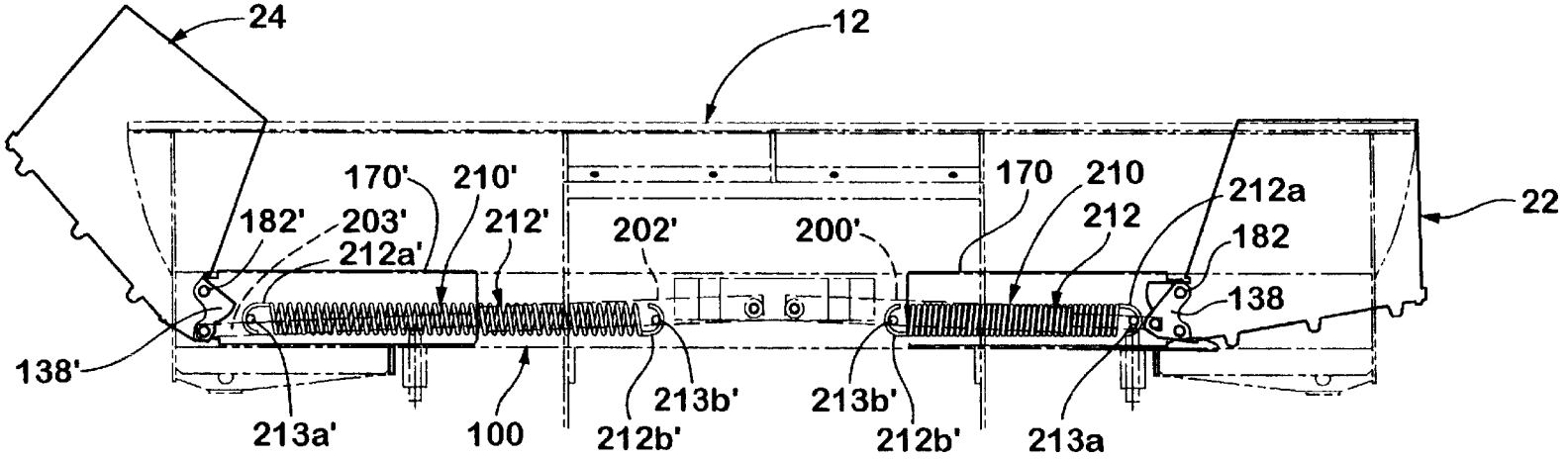
FIGS. 41A and 41B are top plan views similar to FIG. 14, and show a latch or spring mechanism useful with the present invention which limits outward extension of the wings until after the wings are pivoted forwardly.
Figure 41A:
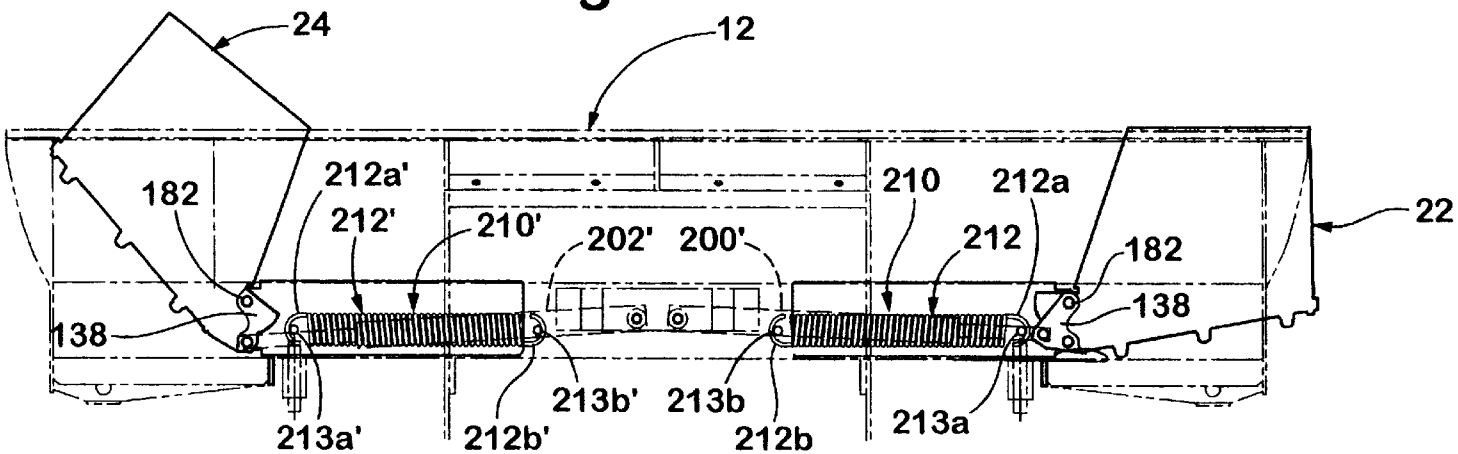
Figure 42B:
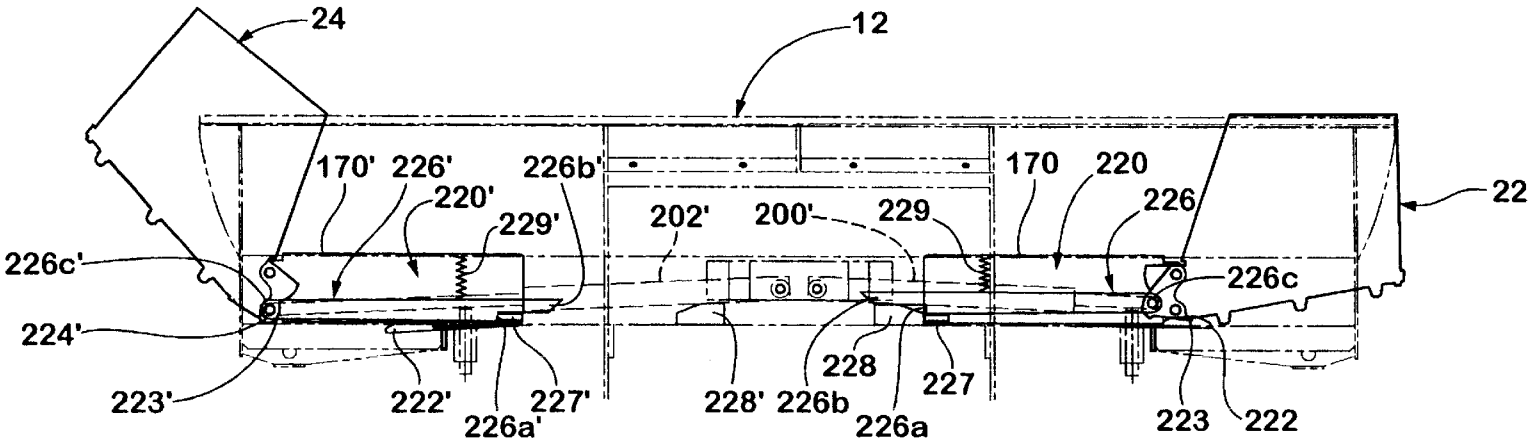
FIGS. 42A and 42B are top plan views similar to FIGS. 41A and 42B of an alternate embodiment of a latch mechanism useful with the present invention.
Figure 42A:
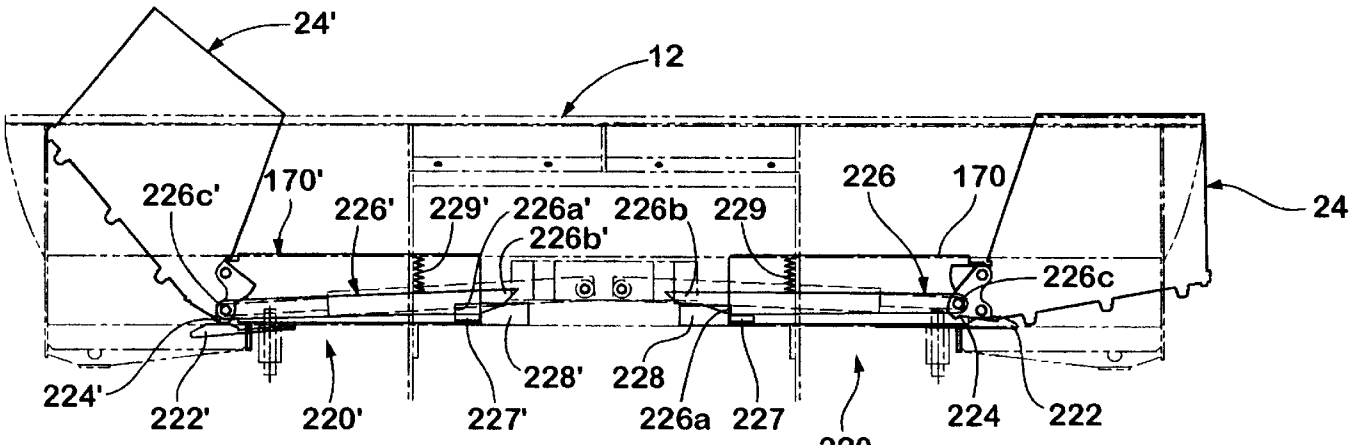
Figure 42C:
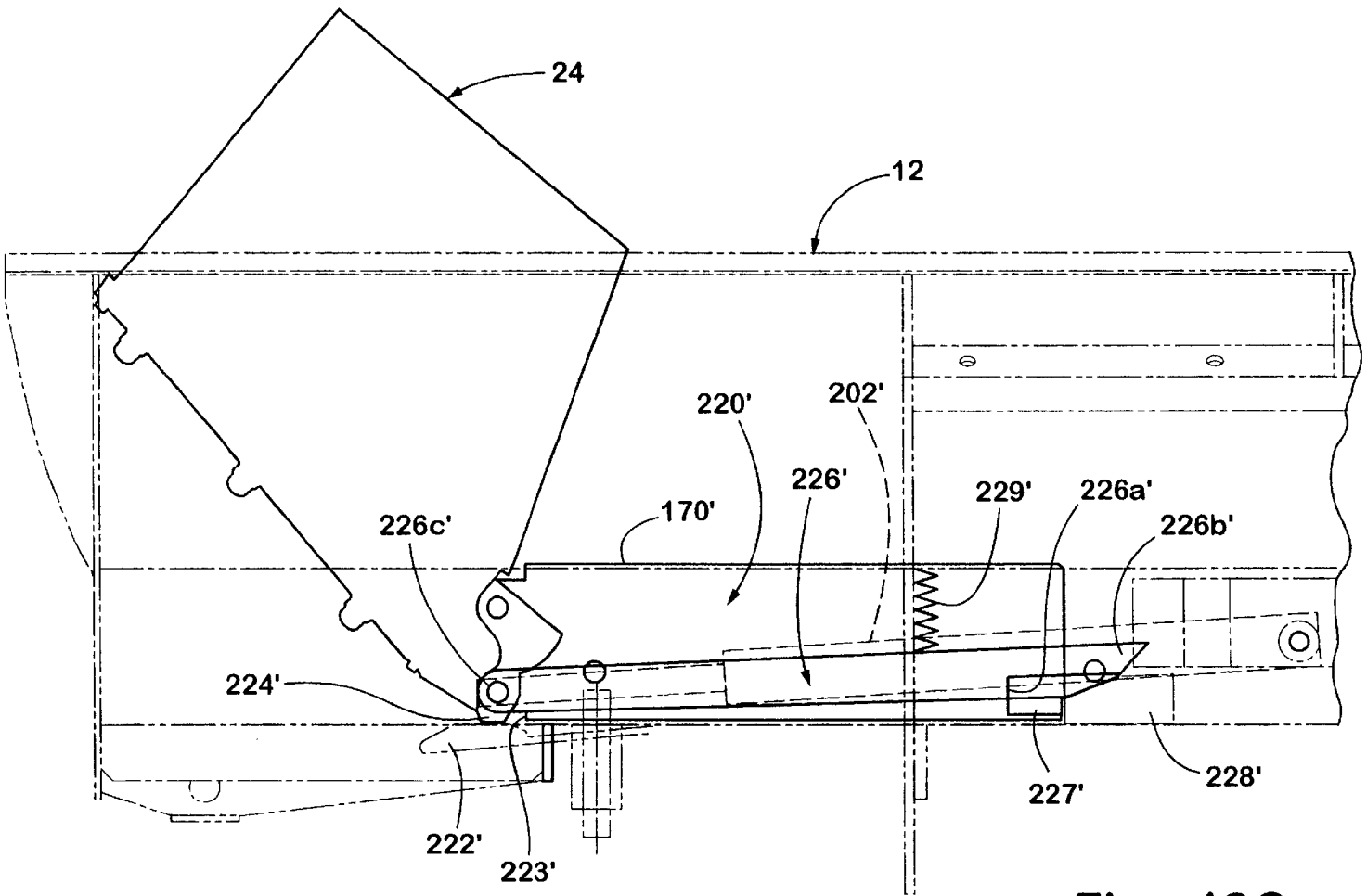
FIG. 42C is an enlarged view of the left side of the plow in FIG. 42A.

As shown in FIGS. 41A, B and 42A, B, C, the pivoting of wing extensions 22, 24 from their rectilinear positions to their forwardly angled positions may be accomplished before slide members 170, 170' are extended by cylinders 200', 202' by means of one or more latch or restraining or spring assemblies, such as latch or spring assemblies 210, 210' (FIGS. 41 A and 41B) or latch assemblies 220, 220' (FIGS. 42A, 42B and 42C). The latch or spring assemblies are preferably mounted within housing 100 and/or slide members 170, 170'. With reference to FIGS. 41A and 41B, a latch or spring biasing member or mechanism 212 may be mounted between wing 22, 24 and housing 100 or plow 12. One end 212*a* of spring 212 is mounted at a mount 213*a* projecting within slide member 170, while the opposite end 212*b* of spring 212 is mounted at a second mount 213*b* projecting within housing 100. Spring 212 restrains outward movement of wing 22 and slide member 170 until the spring or biasing force is overcome by the actuator 200'. Accordingly, as the actuator is first extended, spring 212 holds the slide box or member 170 in its retracted position, while extension of the actuator first causes the wing 22 to pivot to its forwardly angled position, as shown on the left side of FIG. 41A. Once the wing 22 is fully pivoted forwardly, further extension of actuator 200' overcomes the spring biasing force and stretches spring 212 as slide member 170 and wing 22 extend outwardly toward their extended position, as shown on the left side of FIG. 41B. The latch or spring assembly 210, 210' is thus operable to provide smooth, continuous and uninterrupted movement of plow wing 22, 24 from the retracted and aligned position to the retracted and forwardly angled position and then to the extended and forwardly angled position in response to continuous extension of actuator 200', 202'. When the actuator is retracted, spring 212 functions to pull slide member 170, and thus wing 22, inwardly first, such that the wing is not pivoted toward its aligned position until after slide member 170 is fully retracted.

Alternately, as shown in FIGS. 42A, 42B and 42C, latch assembly 220 includes a slide latch member 222, which restricts outward movement or extension of wing 22, and a pivot latch member 226, which restricts rearward pivotal movement of wing 22 when the wing is in its forwardly angled position. Slide latch member 222 is a flexible or movable hook or arm member which is biased toward engagement with slide member 170. When wings 22, 24 are in their aligned positions, latch member 222 engages a stop member 223 at the outer end of slide member 170 and limits or prevents outward movement or extension of slide member 170 with respect to housing 100 (as shown at the right end of FIGS. 42A and 42B), while allowing pivotal movement of wing 22 at the outer end of slide member 170 in response to extension of actuator 200' (as shown in FIG. 42C and at the left side of FIG. 42A). As the wing pivots toward its forward most angled position via extension of actuator 200', latch member 222 remains engaged with stop member 223 to hold the wing in its retracted position. As the wing is pivoted further toward the forwardly angled position, a release member or lug 224 at wing 22 engages latch member 222 and pushes latch member 222 away from slide member 170 as wing 22 is further pivoted, whereby latch member 222 flexes or moves and disengages from stop member 223, as best seen in FIG. 42C, such that further extension of cylinder 200' results in wing 22 and slide member 170, slidably extending along plow blade 12.

Latch member or rod 226 is pivotally mounted at wing 22 at an outer end 226*c* and extends within and along slide member 170. As wing 22 is pivoted forwardly, the pivot latch member 226 slides outwardly along and within slide member 170. Once the wing 22 is fully angled forwardly and the slide member 170 and wing 22 are extended outwardly from their retracted position, the pivot latch member 226 slides outwardly until a latch surface 226*a* engages a stop lug or member 227 at an inner end of slide member 170. Latch member 226 preferably includes a spring 229 which biases latch member 226 toward its engaged position with stop lug 227. Latch member 226 thus locks wing 22 in its forwardly angled position and prevents reverse pivoting of wing 22. Latch assembly 220 is thus also operable to lock wing 22 in its forwardly angled position, in order to prevent or restrain pivotal movement of wing 22 until the wing is again retracted to its retracted position along plow 12. When cylinder 200' is retracted, slide member 170 is first withdrawn or retracted toward the plow blade while wing 22 remains in it forwardly angled position due to pivot latch member 226 and stop lug 227. As wing 22 and slide member 170 are retracted toward the retracted position, an inner end 226*b* of latch member 226 engages a tapered or angled release lug or camming block 228 positioned within housing 100 and/or along the rear surface of the plow. As inner end 226*b* of latch member 226 engages and slides along release lug 228, latch member 226 pivots such that latch surface 226*a* is pushed or moved away from stop lug 227 against the biasing pressure from spring 229, thereby releasing latch member 226, such that further retraction of the cylinders results in wings pivoting or returning to their non-angled position with respect to moldboard 80. When wing 22 is fully retracted, latch member 222 is biased to again engage slide member 170 and prevent outward movement thereof until after wing 22 is first pivoted forwardly.

Although shown and described as a spring member or latch rods, clearly, other means for limiting or restraining outward movement of slide member 170, 170' until after wing 22, 24 is pivoted to its forwardly angled position, and/or for restraining rearward pivoting of wing 22, 24 until after slide member 170, 170' is fully retracted, or for otherwise sequencing the movement of the plow wings with respect to the plow, may be implemented without affecting the scope of the present invention. The latch or spring or restraining assemblies are operable to provide generally continuous and uninterrupted pivotal and outward or inward movement of the plow wings 22, 24 in response to continuous extension or retraction of the actuators. Also, although shown as being implemented with actuators 200' and 202', clearly, the latch or spring assemblies are equally applicable to a plow having actuators 200, 202 or other actuators, without affecting the scope of the present invention.

Figure 2:
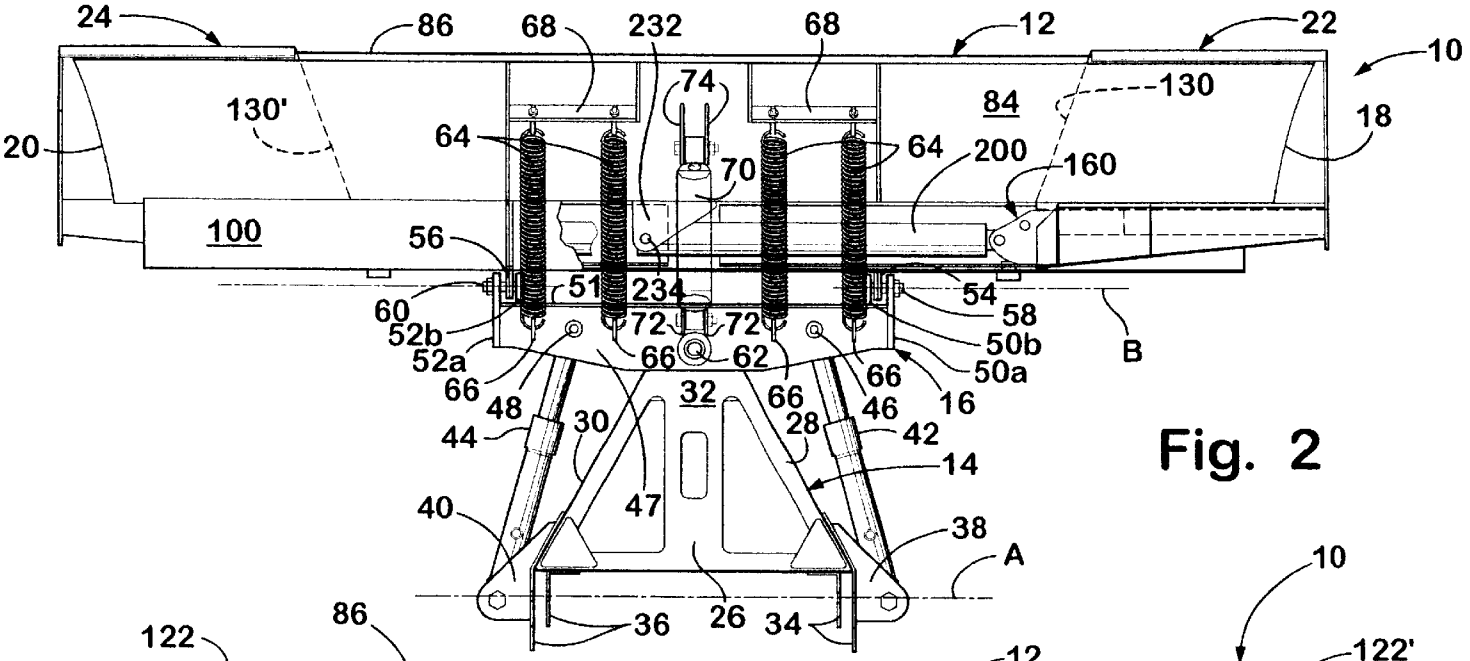
FIG. 2 is a top plan view, with portions broken away, of the plow assembly with wings retracted as shown in FIG. 1.
Figure 3:
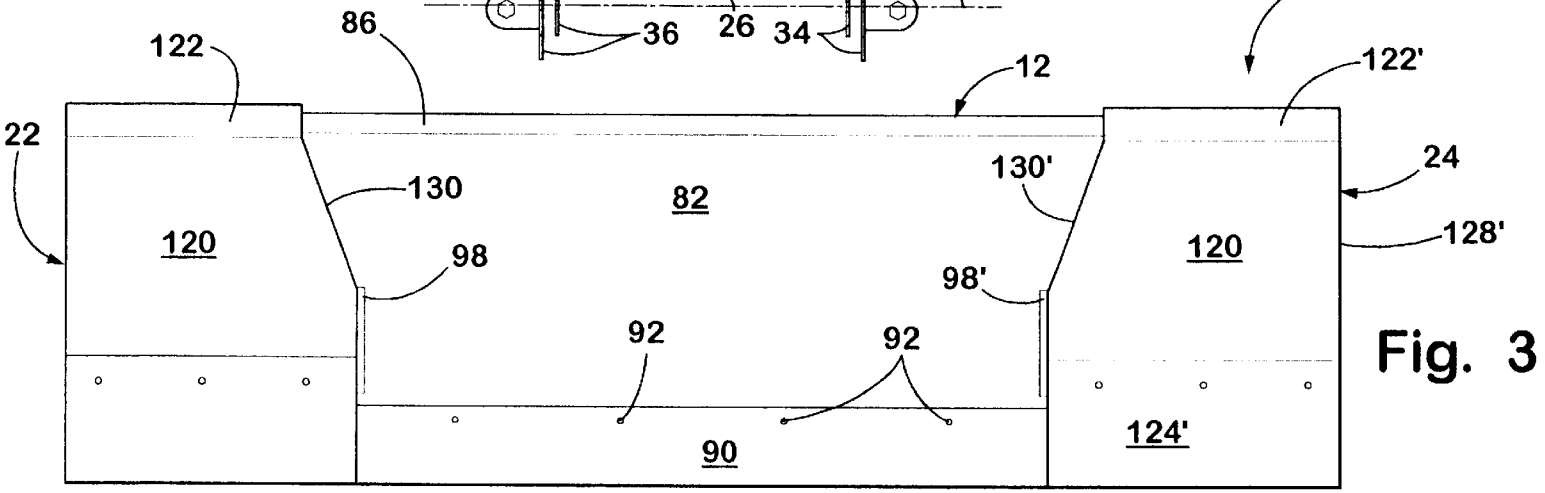
FIG. 3 is a front elevation of the plow assembly of FIGS. 1 and 2.
Figure 5:
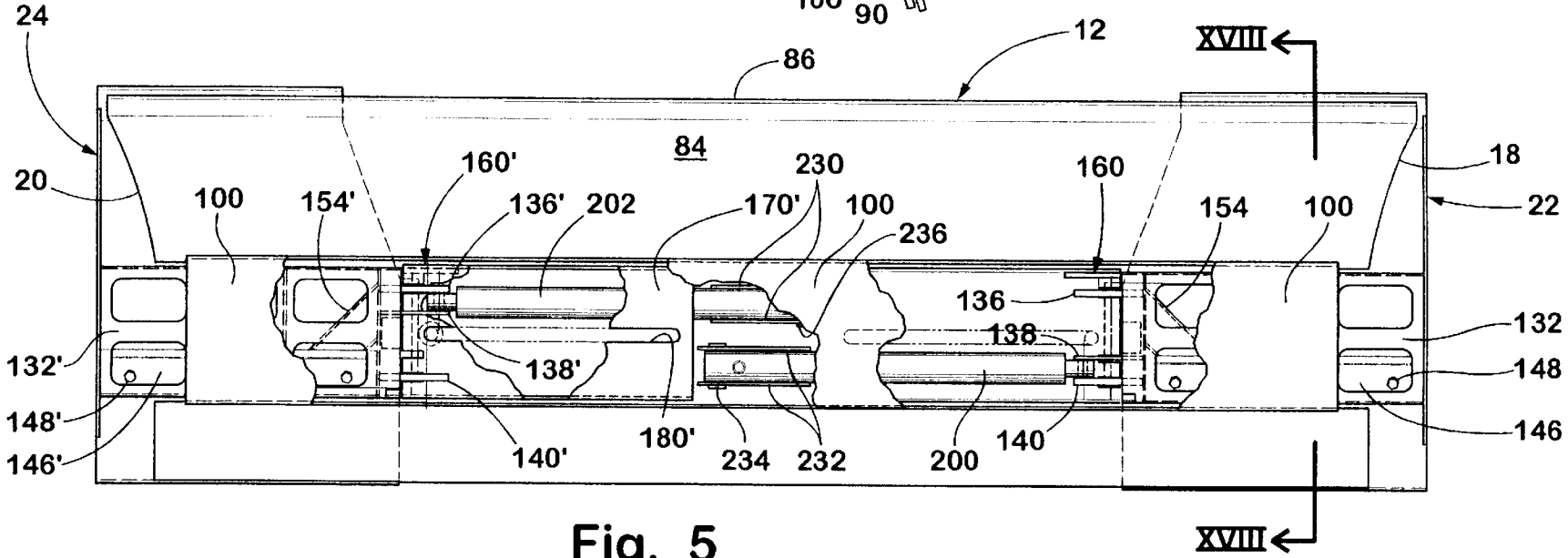
FIG. 5 is a rear elevation of the plow assembly of FIGS. 1–4 with portions broken away to illustrate the fluid cylinders, hinge and slide assembly for each of the extendable plow wings.

With reference to FIGS. 2 and 5, it will now be understood that the subassemblies 160, 160' of slide members 170, 170' and their pivotally attached plow wing extensions 22, 24, respectively, are telescopingly mounted within the interior of outer housing 100 on wear pads 108 for sliding rectilinear movement within the outer housing along a common axis. Pivotal movement of the wings and movement of each slide member 170, 170' is accomplished by a power source, preferably a pair of independent, double acting, hydraulic fluid cylinders 200, 202 as noted above. Two pairs of vertically aligned and spaced fluid cylinder support plates 230, 232 are welded to extend rearwardly from the rear surface 84 of main plow moldboard 80 (FIGS. 2 and 5). The non-extendable end of fluid cylinder 200 is pivotally mounted between the lower pair of support plates 232 on pivot pin 234. The non-extendable inner end of fluid cylinder 202 is pivotally supported between plates 230 on pivot pin 236 (FIG. 5). Extendable rods 201, 203 from each fluid cylinder 200, 202 are pivotally mounted between hinge plates 138, 140 and 136', 138', respectively. Although two, double acting, hydraulic fluid cylinders are preferably shown for use in the preferred embodiment of the invention, it is within the scope of the invention to utilize other power sources such as a single, double acting, hydraulic fluid cylinder having extendable rods projecting from either end. Alternately, threaded rods rotated by at least one electric motor or a pulley and cable system could be used to move slides 170, 170' outwardly or inwardly for extension and retraction.

As shown in FIGS. 14 and 16, the actuators may alternately include fluid cylinders 200', 202', which are generally longitudinally aligned cylinders, with their non-extendable ends being mounted between a pair of mounting plates 232', 230' via pivot pins 234', 236', respectively. Plates 232', 230' may be welded to the upper and lower walls of housing 100 and angled or bent inwardly toward cylinders 200', 202', as shown in FIG. 16. Because cylinders 200', 202' are longitudinally aligned, the ends of the extendable rods 201', 203' are mounted between a pair of generally aligned hinge plates or flanges 138, 140 and 138', 140', as is also shown in FIG. 16. The operation of fluid cylinders 200'. 202' is substantially the same as fluid cylinders 200, 202, such that further discussion of cylinders 200', 202' will not be included herein.

Extension of pivotally mounted fluid cylinders 200, 202 or 200', 202' causes rotation of wing extensions 22, 24 forwardly about hinge pins 182, 182' due to the distance between pivot axes X and Y creating a moment arm (as shown in FIG. 7) and because outward extension of slide member 170, 170' is preferably at least initially prevented by the latch or spring assembly, such as restraining assembly 210 or 220. Such cylinder extension causes rotation of the plow wings to the positions shown in FIGS. 14–16 such that one or both wing extensions are pivoted forwardly at an obtuse angle to the main plow moldboard and thereby forming a generally U-shaped configuration for the plow assembly. In such position, and when wings 22, 24 are also extended as shown in FIGS. 19–22, ends 18, 20 of main plow moldboard 80 substantially overlap the inner edges 130, 130' of the wings. The outward taper of edges 130, 130' allows the wings to be pivoted to the forward position without interference between those edges and the main plow moldboard. Hydraulic pressure within cylinders 200, 202 keeps the wings in the forwardly pivoted positions for pushing or carrying snow or other plowable material such that the plowable material does not slip off the ends of the plow assembly. At the same time, front walls 178, 178' of slide member 170, 170' cover the openings 98, 98' in the main plow moldboard and prevent material from being packed into the inside of the outer housing and allow the plow assembly to function normally. At the point of full forward pivoting, the latch or spring assembly releases the slide member or is overcome by the actuator. Thus, at the fully pivoted position, slide members 170, 170' and plow wings 22, 24 are unlocked, released and free to extend laterally outwardly along moldboard 80.

Sliding movement of slide member 170, 170' may be limited by projecting, cylindrical stop members 240, 242 which are mounted in the rear wall 106 of outer housing 100 (FIGS. 1, 5 and 19–21) in alignment with slots 180, 180' in the slide members. As fluid cylinders 200, 202 are operated to extend rods 201, 203, slide member 170, 170' are moved rectilinearly outwardly on wear pads 108 until stops 240, 242 engage the inner ends of slots 180, 180' stopping further outward extension of the plow wings. In the extended positions, as shown in FIGS. 19–22, the outer wing ends 128, 128' are spaced outwardly of the outer ends 18, 20 of main plow moldboard 80. Since the upper ends of the main plow moldboard 80 taper outwardly, the gap between the edges 130, 130' of the wing extensions and the outer edges of the main plow moldboard are substantially closed when the wings are fully extended and pivoted as shown in FIGS. 19–22.

Likewise, when fluid cylinders 200, 202 are retracted, the opposite motions occur. First, wing extensions 22, 24 are retracted along the front surface of the main plow moldboard to the retracted and forwardly angled position shown in FIGS. 14–16. When the slide members 170, 170' are fully retracted along the plow, further retraction of the fluid cylinders causes latch or spring assemblies 210, 210' or 220, 220' to unlock wings 22, 24 or to otherwise allow pivotal movement of wings 22, 24 toward their aligned positions. Inward movement of the slide members 170, 170' is optionally limited by the stop members 240, 242 engaging the outer ends of slots 180, 180' preventing further inward sliding movement of the slide members.

In each position, openings 98, 98' allow the hinged wing extension to be mounted on slides 170, 170' adjacent the rear surface 84 of main plow moldboard 80 with the hinges extending through the openings for movement of wing extensions 22, 24 along the front surface of the main plow. Thus, the plow assembly may be used in its retracted position to plow snow, dirt, sand, gravel or other plowable material when either centered or angled to the left or right, the preferred length of such plow in the retracted position being approximately 8 feet. Secondly, cylinders 200, 202 can be extended simultaneously or independently of one another such that wing extensions 22, 24 are pivoted to their fully angled positions as shown in FIGS. 14–16 and the plow may also be used either centered or angled left or right by extending one or the other of fluid cylinders 42, 44. Further, as shown in FIGS. 19–22, yet further extension of cylinders 200, 202 causes outward movement of plow extensions 22, 24 along moldboard 80 to the positions shown therein providing a longer, substantially U-shaped plow assembly allowing snow or other material to be pushed or carried from one position along a horizontal surface to another without the snow slipping off the ends of the plow assembly. It is also possible to pivot and extend only one or the other of wing extensions 22, 24 such that the plow may be used with only one end extended or pivoted forwardly, or one end pivoted forwardly with the opposite end extended and pivoted forwardly.

Figure 23:
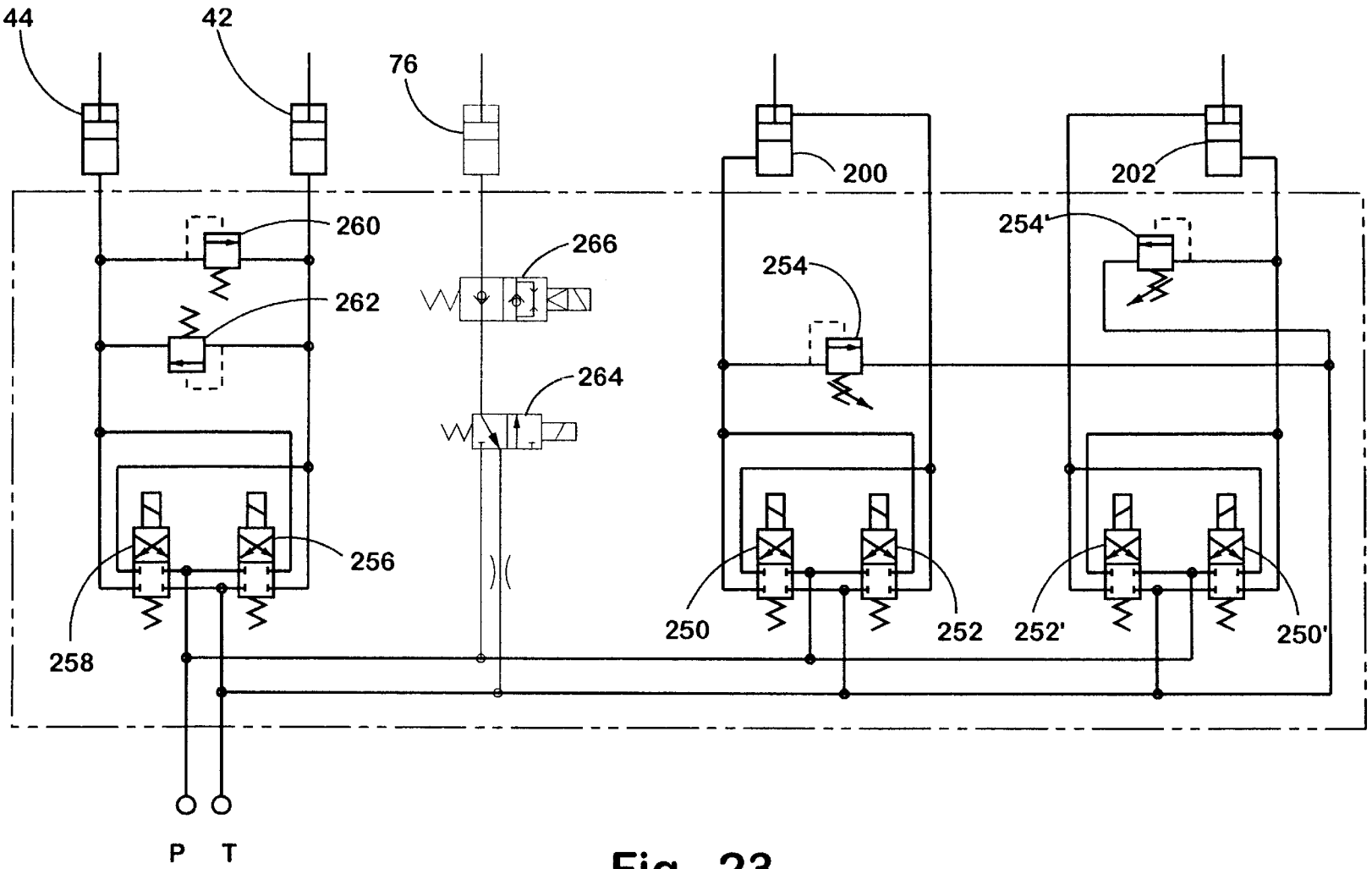
FIG. 23 is a schematic illustration of the hydraulic system for operation of the adjustable plow assembly of the present invention.

As shown in FIG. 23, each hydraulic fluid cylinder 200, 202 (or 200', 202') is controlled by a pair of solenoid operated valves 250, 252 and 250', 252' which direct hydraulic fluid from the hydraulic system into the fluid cylinder to either extend or retract rods 201, 203. Pressure release valves 254, 254' are included within the system to prevent over pressurization of each of cylinders 200, 202. Likewise, angling of the plow assembly to the left or right is accomplished by fluid cylinders 42, 44 which are controlled by solenoid operated fluid valves 256, 258, respectively. Again, pressure release valves 260, 262 are included between the hydraulic lines leading to cylinders 42, 44 to prevent over pressurization. Pressure release valves 254, 254' release pressure exerted on the system should wings 22, 24 encounter an obstacle or other sudden rearward load when extended and pivoted forwardly and allow hydraulic fluid to be directed back to storage to provide system relief when forces generated exceed specified system pressures. Likewise, valves 260, 262 release overload pressures exerted on angling cylinders 42, 44 in the event an obstacle engages the plow.

In the event a lift cylinder 76 is included on support frame 14, it too may be operated by a solenoid operated fluid valve 264 with a hydraulic lock valve 266 included in the system to hold the lift cylinder 76 in position when raised. All of these fluid cylinders can be easily controlled with the solenoid operated fluid valves 250, 252, 250', 252', 256, 258, 264, and 266 having electrical controls which are positioned on a control panel in the cab of the vehicle for easy access by the driver to allow operation without leaving the vehicle cab. Such remote control greatly increases the speed and efficiency of adjustment of the plow assembly without the need for exiting the cab.

Second Embodiment

Referring now to FIGS. 24–40, a second preferred embodiment 300 of the adjustable wing plow assembly of the present invention is illustrated including a reinforced main plow 312 pivotally mounted on a support frame 314 via intermediate support 316. Slidably mounted at opposite ends 318, 320 of main plow 312 are pivotable and/or extendable plow wings 322, 324 each of which are moved by pair of fluid power cylinders 500*a*, 502*a* or 500*b*, 502*b* remotely controlled from the cab of the pickup truck or other vehicle, such as a bulldozer, grader or other excavation or construction vehicle, on which the plow assembly 300 is mounted. Wings 322, 324 are independently slidably movable between retracted positions, as shown in FIGS. 24–27, fully extended positions as shown in FIG. 28, forwardly angled positions in which the plow assembly has a generally U-shaped configuration as shown in FIG. 38 and extended and forwardly angled positions as shown in FIGS. 24–27. FIGS. 24–27 show the plow with one wing extended and angled forwardly, and one wing fully retracted and angled forwardly, which is another optional position in which the plow may be used. Additionally, FIG. 38 shows the plow with both wings angled forwardly, but with one wing extended and the other wing retracted. FIG. 39 further shows the plow with one wing retracted and angled forwardly, and the other wing extended and not angled forwardly.

In addition to the use of a pair of fluid power cylinders for movement of each of the plow wings, embodiment 300 of the adjustable wing plow also incorporates a modified main plow construction in which an upper section of the main plow moldboard 380 is preferably formed from a sheet polymeric material such as opaque ultra high molecular weight (UHMW) polyethylene or clear polycarbonate. Such material lessens the overall weight of the plow assembly and also provides additional visibility through the clear material at the top of the plow moldboard especially when the plow assembly is raised to its inoperative position when mounted on the front of a vehicle or truck. In addition, the construction of the plow wings and main plow is modified for ease and strength of attachment of the extension blade 424 of the main plow moldboard and rectilinear plow blade 390 secured to the lower edge of each plow wing 322, 324. In addition, support skids 410 are mounted at either end of the rear of the main plow assembly.

Figure 25:
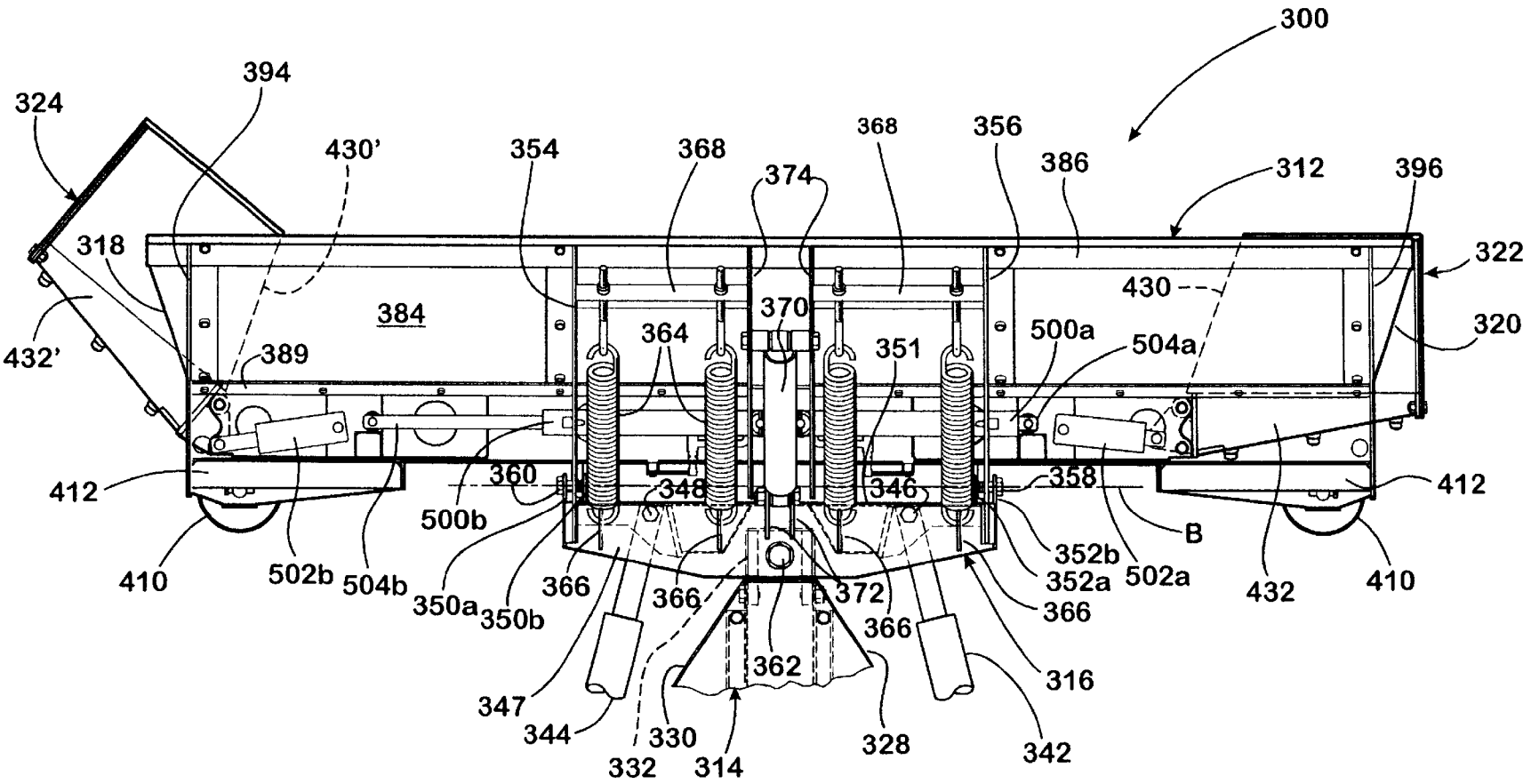
FIG. 25 is a top plan view of the plow assembly of FIG. 24 with portions of the support frame broken away and the top wall of the slide housing removed.

As is best seen in FIG. 25, support frame 314 is preferably a triangularly shaped, reinforced framework substantially similar to support frame 14 including inwardly tapering sides 328, 330 leading to a forward apex 332. Not shown in FIG. 25 are a series of support flanges at the rear of support frame 314 to allow frame 314 to be secured to a suitable hitch assembly on the front of a pickup truck or other vehicle for pivotal movement about a horizontal axis extending through such support flanges. A pair of extendable, single-acting, hydraulic fluid cylinders 342, 344 are pivotally mounted one at either side of frame 314 in a manner similar to that shown for support frame 14 between the support frame and pivot pins 346, 348 on intermediate support 316. Pins 346, 348 extend between spaced upper and lower plates 347, 349 of support 316.

Intermediate support 316 is an elongated steel beam having a generally U-shaped configuration in cross section and substantially similar to support 16 described above in connection with embodiment 10. Included are upper and lower support plates 347, 349, a forward plate 351, and two pair of plow mounting flanges 350*a*, 350*b* and 352*a*, 352*b* welded to the ends of plates 347, 349, 351 and to plate 351 itself and projecting forwardly toward the rear surface of plow 312. Plow 312 includes rearwardly extending, vertically oriented supports or mounting flanges 354, 356 extending between flanges 350*a*, 350*b* and 352*a*, 352*b*, respectively, for mounting on horizontal rods 358, 360 aligned on a common horizontal axis B (FIG. 25) to allow the entire plow 312 to pivot about that horizontal axis. Intermediate support 316 is, in turn, pivotally mounted to apex 332 of support frame 314 by a generally vertically extending pivot pin 362. By controlling the extension and retraction of fluid cylinders 342, 344, intermediate support 316 and plow 312, which is mounted thereon, may be moved to a series of angled positions such that plow 312 is swung and angled to the left or right about pivot pin 362 just as in the case of embodiment 10 described above.

Plow 312 is biased to an upright position about horizontal axis B on pins 358, 360 by a series of biasing members, such as coil springs 364, which extend between mounting flanges 366 extending upwardly from the top surface of intermediate support 316 and support flanges 368 at the top of rear surface 384 of plow 312. In addition, a shock absorber 370 is pivotally mounted between upstanding support flanges 372 on intermediate support 316 and rearwardly extending support flanges 374 on the rear surface 384 of plow 312. Like shock absorber 70, shock absorber 370 dampens the return or rebound pivotal movement of plow assembly 300 about horizontal axis B on pins 358, 360 during plowing after the plow encounters an obstacle along the surface being plowed being thereby causing plow 312 with wings 322, 324 to tip or pivot forwardly against the bias of springs 64. Rearward pivoting of the plow about axis B on pins 358, 360 is limited by contact of flanges 354, 356 with intermediate support 316. Forward pivotal movement is limited by springs 364 and shock absorber 370. When support frame 314 is pivotally secured to a horizontal axis on a vehicle, the entire support frame 314, intermediate support 316 and plow 312 including extendable wings 322, 324 may be lifted away from the ground or other support surface via a retractable hydraulic cylinder 376 or other power source (FIG. 40) in the manner described above in connection with embodiment 10.

Figure 24:
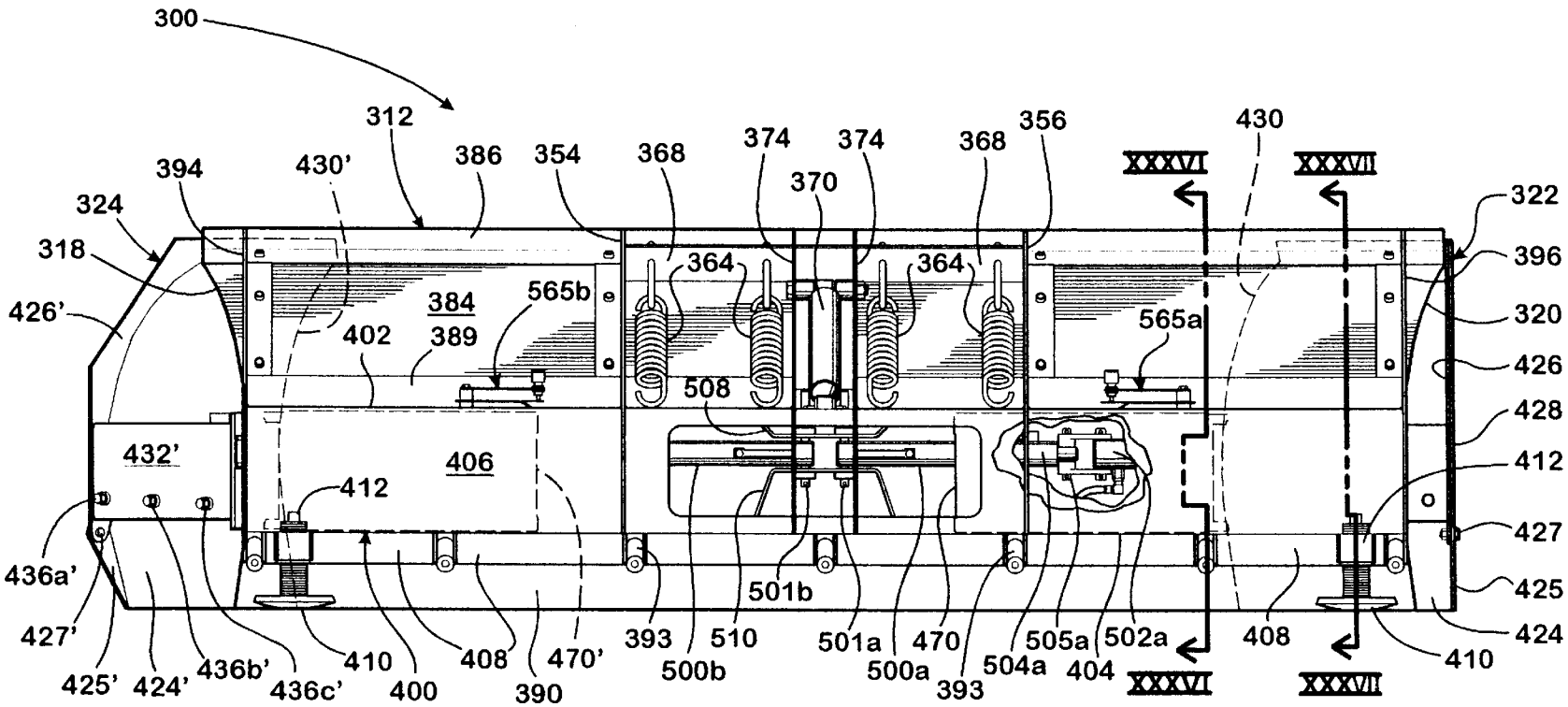
FIG. 24 is a rear elevation of a second embodiment of the adjustable wing plow assembly of the present invention with portions broken away and showing one of the plow wings in retracted position, and the other plow wing extended and angled forwardly.
Figure 36:
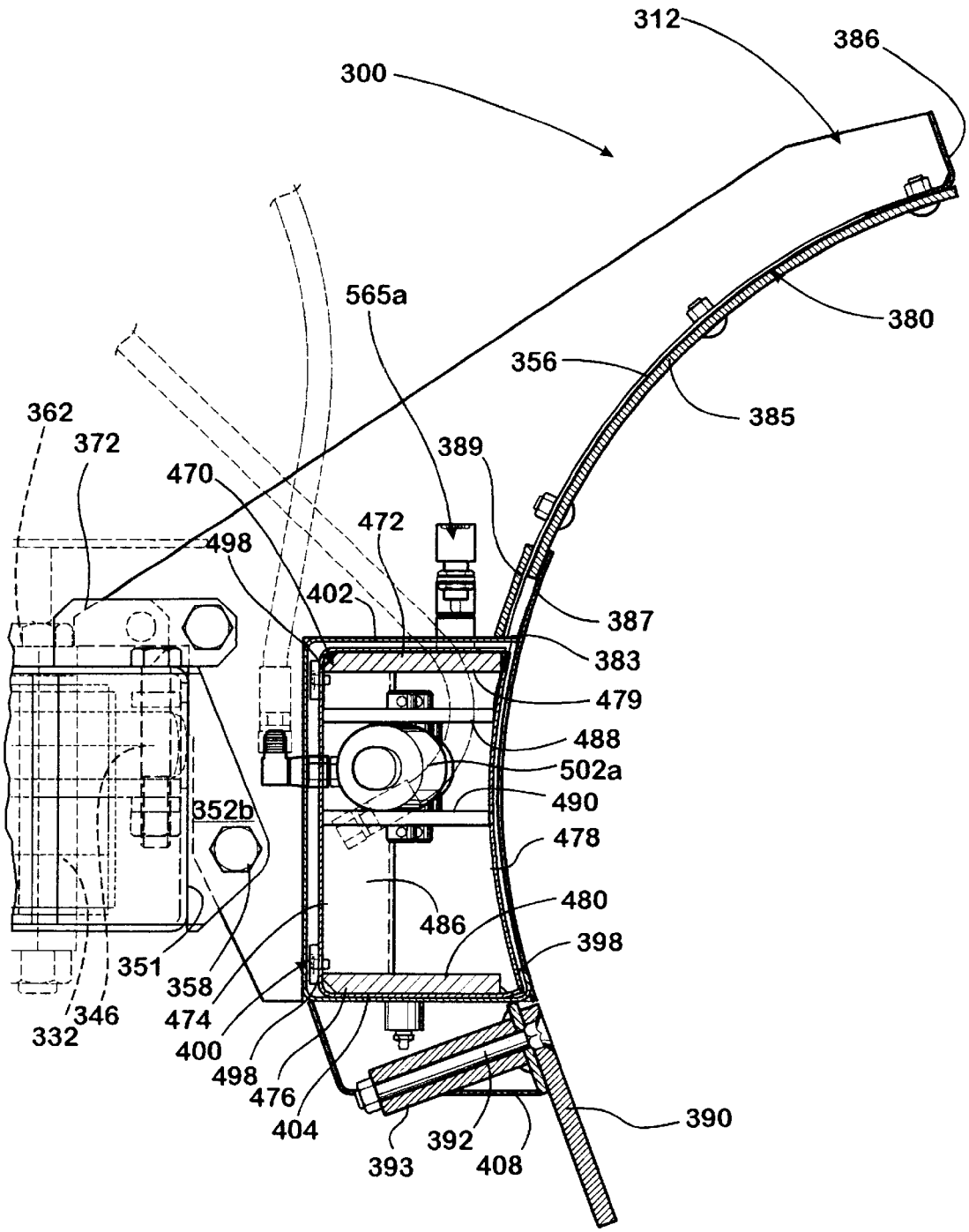
FIG. 36 is a sectional end elevation of the slide assembly for mounting one of the extendable plow wings as mounted in the main plow taken along plane XXXVI—XXXVI of FIG. 24.
Figure 37:
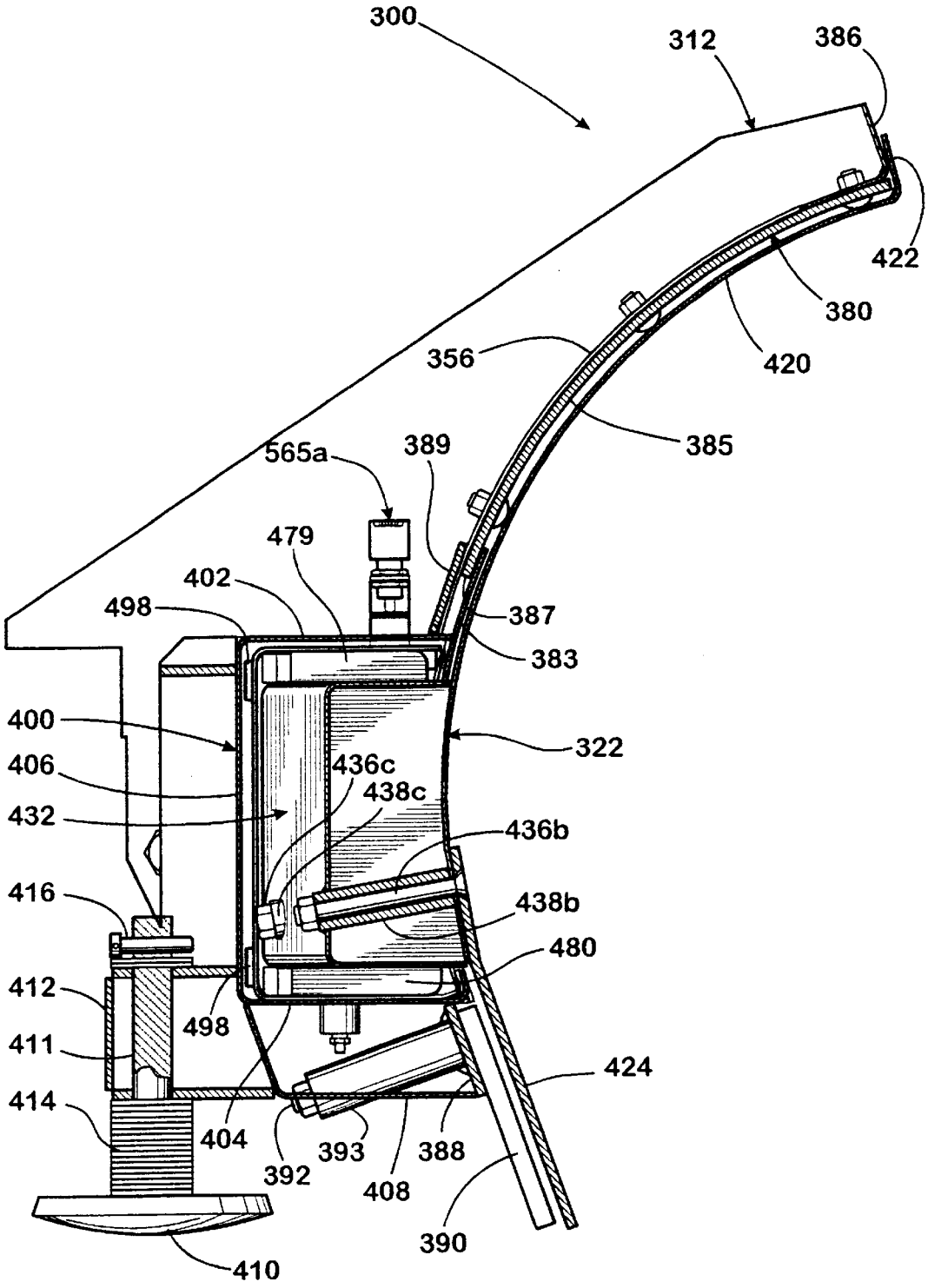
FIG. 37 is a sectional end elevation of one of the extendable plow wings on its slide assembly taken along plane XXXVII—XXXVII of FIG. 24.
Figure 38:
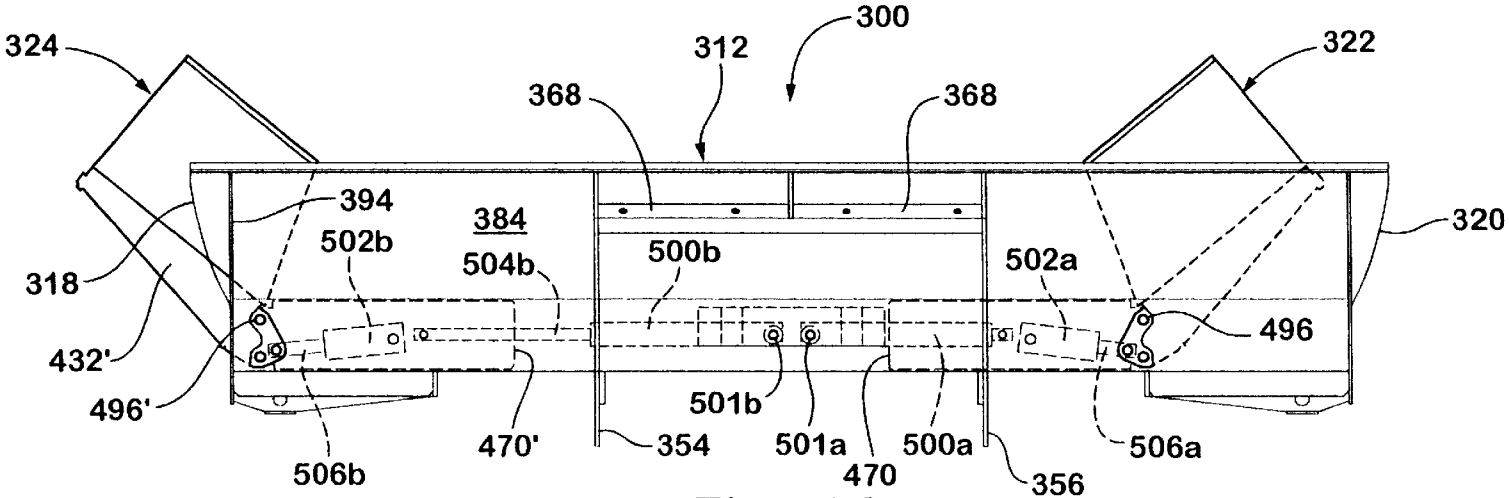
FIG. 38 is a top plan view of the plow assembly of FIG. 24, with both plow wings angled forwardly to form a generally U-shaped plow, with one wing extended and the other wing retracted.
Figure 39:
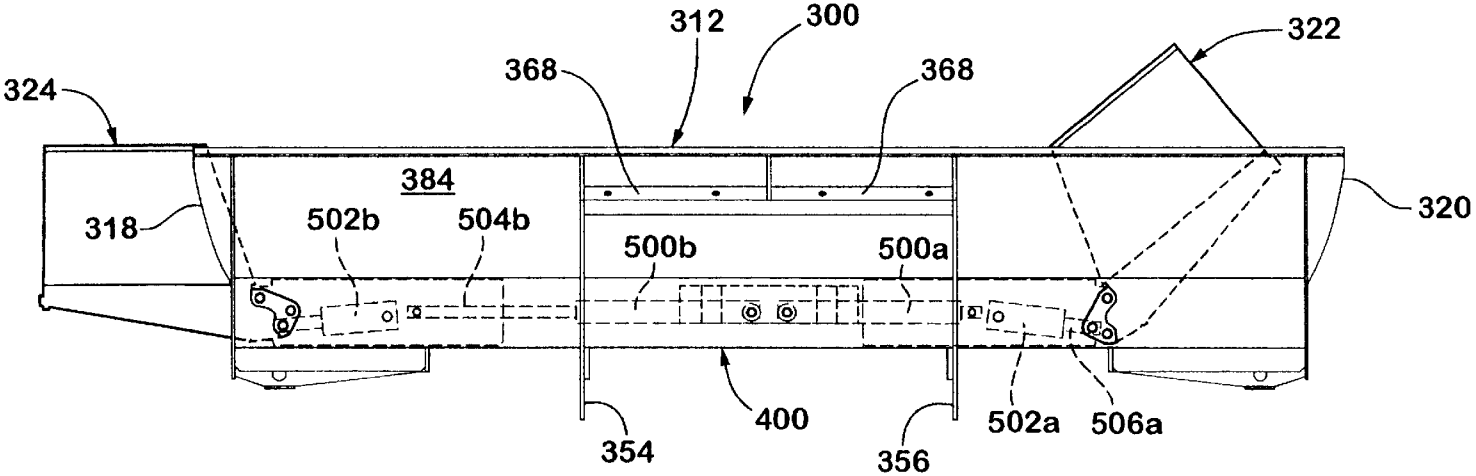
FIG. 39 is a top plan view of the plow assembly of FIG. 24, with one plow wing angled forwardly and retracted, and the other plow wing extended and aligned with the plow.

As best seen in FIGS. 24–28, and 36–39, main plow 312 is preferably an elongated, rectilinear moldboard 380 having a concave front surface 382, a convex rear surface 384, and an integral steel reinforcing flange 386 extending along its upper edge. Secured to a lower flange which extends along a lower edge of moldboard 380 is a reinforcing plate 388 with a replaceable, elongated, rectilinear plow blade 390 secured thereto by fasteners 392 having countersunk heads which are flush with the front surface of blade 390 to prevent interference with the material being plowed. As in embodiment 10, carriage bolts having rounded heads could also be used in place of countersunk fasteners 392. Carriage bolts 392 are elongated for additional strength and extend through spaced, cylindrical mounts 393 welded to the rear surface of plate 388 (FIGS. 24, 36 and 37). The upper portions of the right and left ends of moldboard 380 are curved to extend outwardly on a large radius curve (FIG. 24) so as to cover the gap between the inner edge of wing extensions 322, 324 and the outer edges of moldboard 380 when plow extensions 322, 324 are extended outwardly and forwardly as shown, for example, in FIGS. 24, 25, 27 and 38–40. The rear surface 384 of moldboard 380 is reinforced with vertically extending supports or mounting flanges 354, 356 on either side of its center, as well as end flanges 394, 396 welded to flange 386 and plate 388 adjacent either end.

Figure 27:
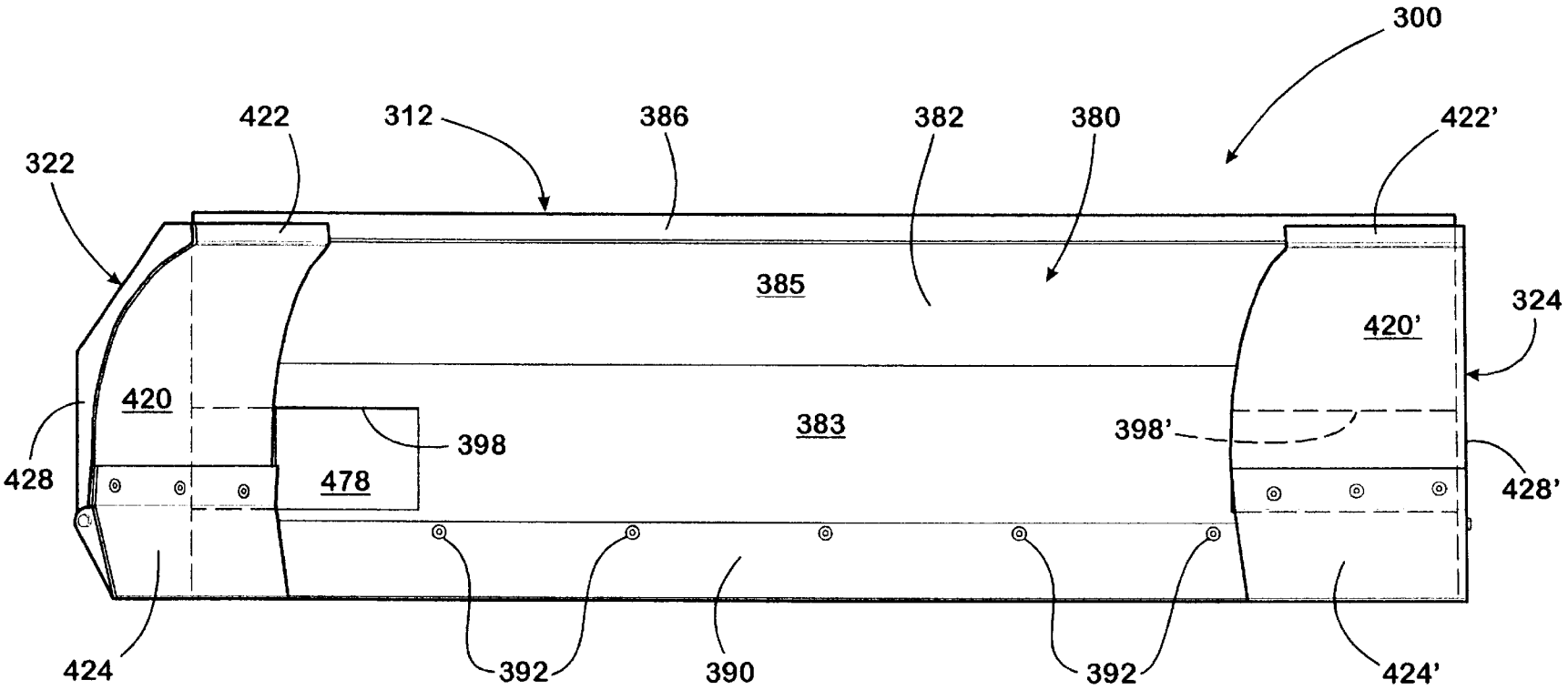
FIG. 27 is a front elevation of the plow assembly of FIGS. 24–26 with one plow wing retracted and the other plow wing extended and angled forwardly.
Figure 28:
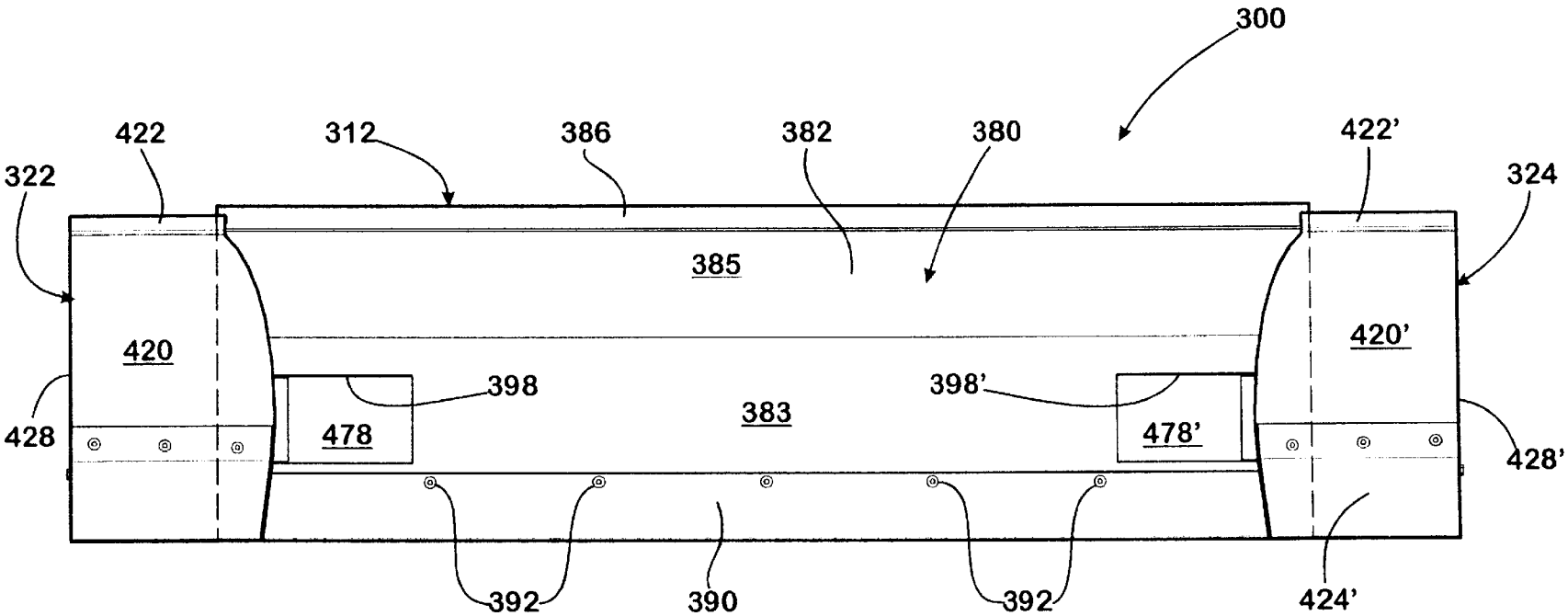
FIG. 28 is a front elevation of the plow assembly of FIGS. 24–26 with the plow wings shown in an extended but not forwardly angled position.
Figure 29:
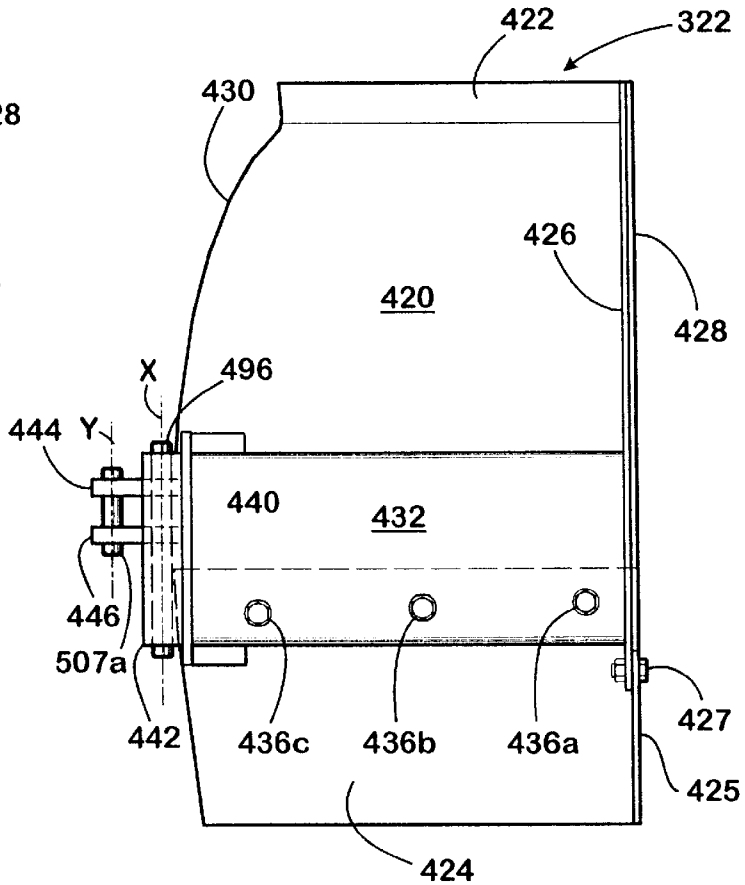
FIG. 29 is a rear elevation of one of the extendable plow wings.
Figure 30:
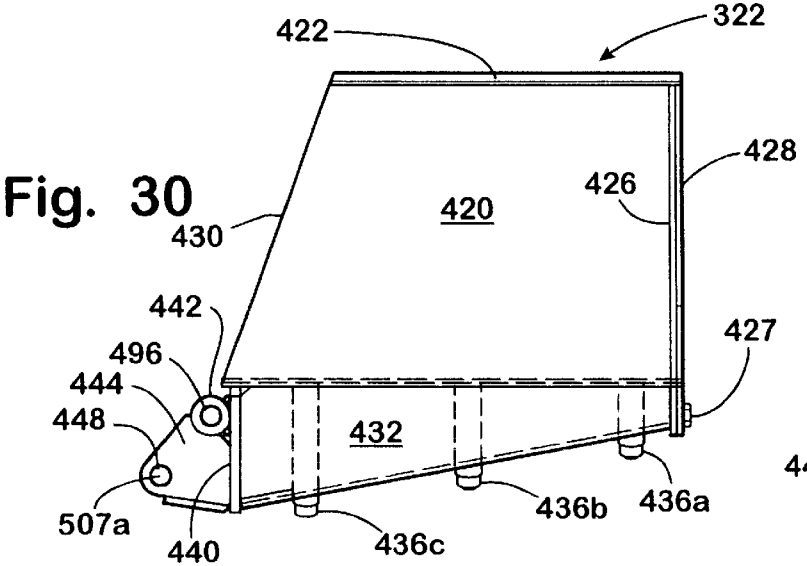
FIG. 30 is a top plan view of the extendable plow wing of FIG. 29.
Figure 31:
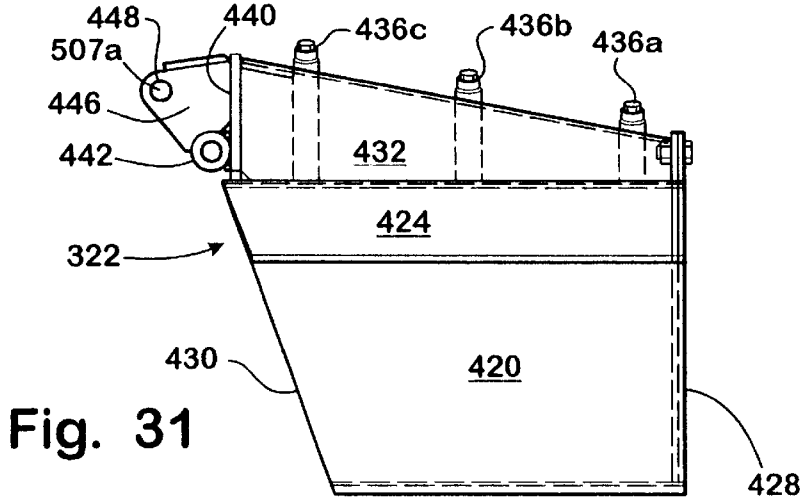
FIG. 31 is a bottom plan view of the extendable plow wing of FIG. 29.
Figure 32:
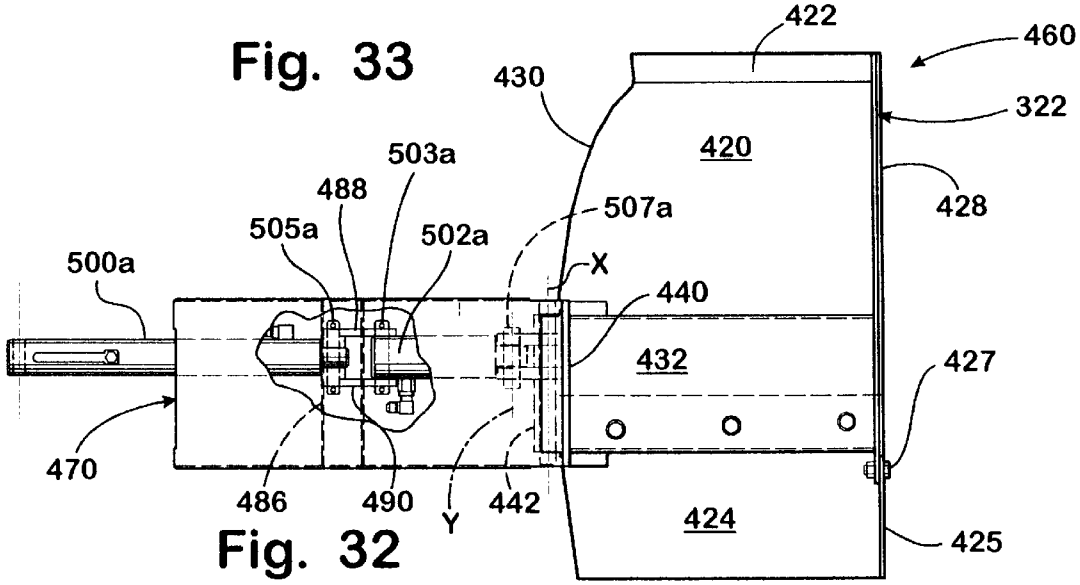
FIG. 32 is a rear elevation, with portions broken away, of the subassembly of a slide, a plow wing pivotally mounted thereon, and the pair of fluid power cylinders for operating the slide and plow wing subassembly.

As is best shown in FIGS. 27, 36 and 37, rectilinear moldboard 380 may be formed in two sections, a first, steel section 383 which extends from the top of plow blade 390 to a position approximately two-thirds up the overall height of the moldboard. A second, upper, curved section of the moldboard 385 is preferably formed from a polymeric sheet material such as opaque UHMW polyethylene or clear polycarbonate which is preferably bolted to mounting flanges 354, 356 and end flanges 394, 396 with its free lower edge 387 fitted in a pocket formed by the upper edge of moldboard section 383 and a horizontally extending reinforcing flange 389 secured on the rear surface of the main plow. Accordingly, when material to be plowed, such as snow, dirt, sand, gravel or other plowable material, engages the plow blade 390, it is forced upwardly along first moldboard section 383, which bears the principal amount of force, causing the material to change directions, while the remainder of first section 383 and second section 385 impart a rolling action or a continuation of the change in direction to force the material forwardly as the plow is moved in the same direction. Such polymeric sheet material 385 may save a significant amount of weight in the overall plow assembly, namely, approximately 30 pounds in an eight foot plow assembly, and may also provide the ability to view through the upper section of the plow, especially when the plow assembly is raised to its inoperative position when mounted on a truck. Alternately, however, the moldboard 380 may be unitarily formed of steel or polymeric materials, and may be formed with the plow blade, without affecting the scope of the present invention.

Extending parallel to the top and bottom edges of moldboard 380 at either end are elongated, rectangular slots 398, 398' best seen in FIGS. 27, 28, 36 and 37. On the rear surface 384 of moldboard 380 is welded a rectangular, steel slide support or housing 400 having a top wall 402, bottom wall 404, and rear wall 406 forming a generally U-shaped enclosure which is larger than slots or openings 398, 398' on the front of the moldboard section 383. The slide support or housing 400 and its corresponding slots or openings 398 or 398' are thus aligned along the first, steel section 383 of the moldboard in this embodiment of the plow. Mounting flanges 354, 356 and reinforcing flanges 394, 396 extend over top wall 402, along rear wall 406 and thereafter along bottom wall 404 of housing 400 and are welded thereto to reinforce the entire assembly. Additional reinforcement for main plow 312 is provided by L-shaped plates 408 welded to the corner of housing 400 between rear wall 406 and bottom wall 404 and to the lower edge of plate 388 (FIGS. 36 and 37). Plates 408 extend laterally within the spaces between bolt mounts 393 (FIG. 24). In addition, as shown in FIGS. 24–26 and 37, a pair of support skids 410 are each telescopingly mounted in a mounting box 412 welded to rear wall 406 and to outermost plate 408 at each end of plow 312. Skids 410, which include concave shoes, extend downwardly to engage the ground or pavement surface and support blade 390 at the proper height above that surface by a series of metal washers 414 stacked on the shaft 411 of skid 410 (FIG. 37). The extension of skids 410 is limited by stop pins 416 passed through an aperture in shaft 411 of the skid. As ground engaging plow blade 390 wears during use, the plow operator manually removes individual washers 414 from between the shoe of skid 410 and box 412 and places them between pin 416 and box 412 keeping the bottom of the skid shoe even with the bottom of the plow blade.

As will be explained below, slide support or housing 400 is adapted to receive generally rectangular, inner slide members 470, 470' best seen in FIGS. 32, 33, 33A, 33B and 34–37. When slide members 470, 470' are received within housing 400 (FIGS. 26, 36 and 37), hinges 442, 442' extend through slots 398, 398' to support wing extensions 322, 324 on the front of the main plow. Also, front walls 478, 478' of housing 400 have a radius of curvature parallel to that of moldboard 380, and close slots 398, 398' on either end of main plow 312 when the plow wings are at least partially extended, such that the snow or other material being plowed moves upwardly along moldboard 380 from plow blade 390 continues along front surface 382 of the moldboard onto the polymeric moldboard section 385 without interruption and without packing into the interior of housing 400. Alternately, slide members 470, 470' may be movably mounted to the rear of moldboard 380 via other slide support means, such as an open frame structure or upper and lower support rails or the like, without affecting the scope of the present invention. Such a mounting scheme facilitates easier access to the actuators, since they are not substantially encased in a housing.

As best seen in FIGS. 25, 27, 28, 38 and 39, each plow wing extension 322, 324 is a substantial mirror image of the other, only one being described in detail herein, namely, plow wing 322. Substantially the same elements are included in plow wing extension 324 but are shown with prime numerals.

Figure 26:
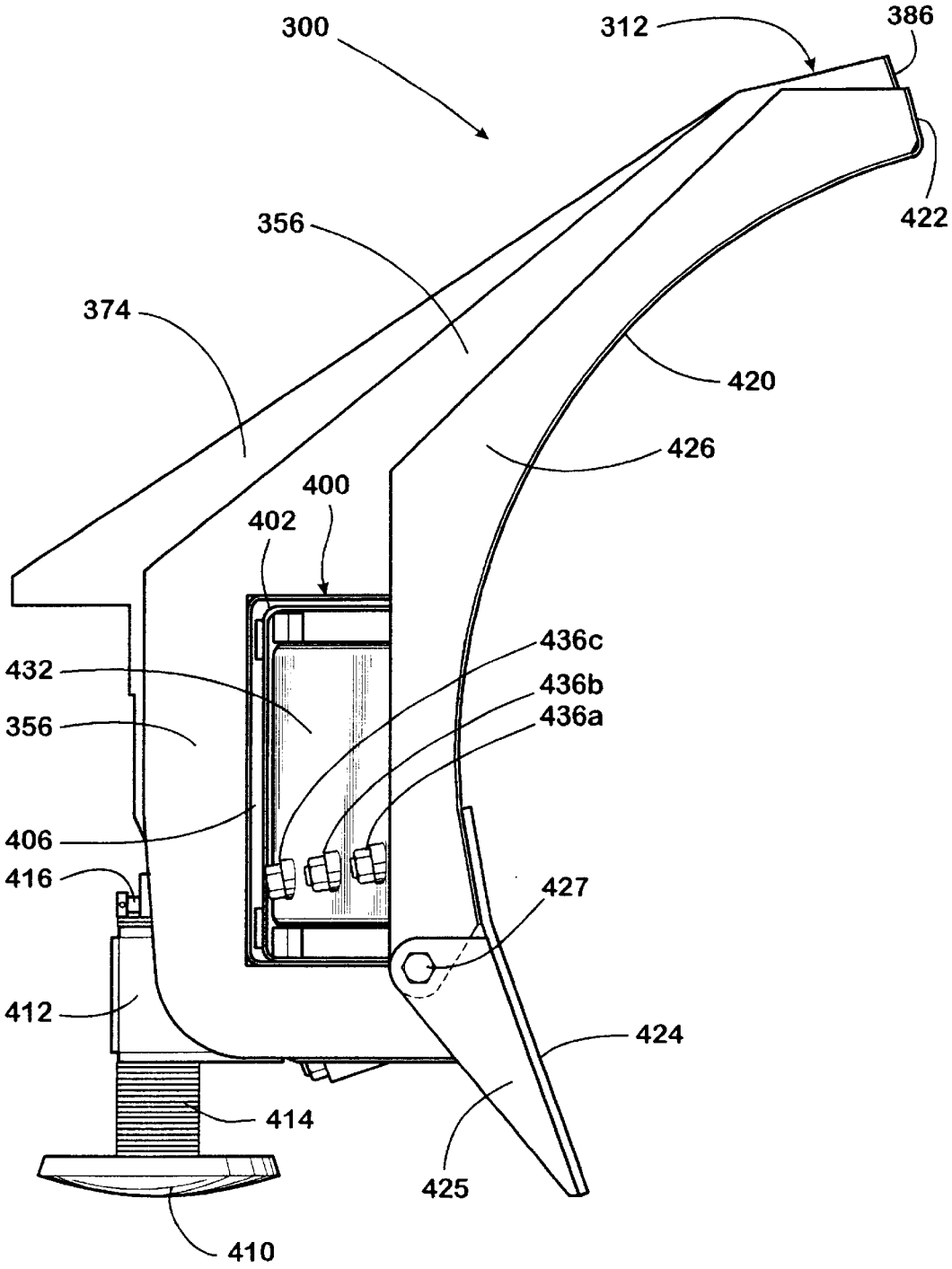
FIG. 26 is an end elevation of the plow assembly shown in FIGS. 24 and 25.

Plow wing extension 322 includes a moldboard section 420 formed entirely from sheet steel having a radius of curvature substantially the same as that for moldboard 380 and extending parallel to moldboard 380 when mounted on and aligned with plow assembly 312 as shown in FIG. 37. Wing extension 322 includes an integral, upper flange 422 extending along the front surface of flange 386 at the top of moldboard 380 and over slot or opening 398 on the front surface 382 at the left end of moldboard 380. A replaceable, steel extension blade 424, also known as a cutting edge or wear edge is secured to the front surface of the lower edge of moldboard 420 and extends generally parallel to plow blade 390, as shown in FIG. 37. Blade 424 engages the plowed surface during plowing and may be repaired or replaced when worn. A generally vertical reinforcing flange 426 extends along the outermost edge 428 of wing extension moldboard 420. The innermost edge 430 of moldboard 420 is inclined inwardly and outwardly from the position of upper flange 422. Extension blade 424 includes a rearwardly extending, triangular reinforcing flange 425 at its outer edge which is bolted to the lower extremity of vertical reinforcing flange 426 as shown in FIGS. 24 and 26.

Extending parallel to the upper and lower edges of wing extension 322 on the rear surface thereof is a tapered, reinforcement housing 432 best seen in FIGS. 26 and 29–31. Housing 432 is preferably formed from sheet steel bent into a generally U-shaped configuration and welded to the rear surface of steel moldboard 420. Housing 432 is slightly smaller than both outer housing 400 and inner slide member 470, as will be understood from FIG. 26. Spaced along the lower portion of housing 432 are a series of three elongated securing bolts 436*a*, 436*b*, 436*c* of successively longer length which extend through cylindrical bolt mounts 438*a*, 438*b*, 438*c* which correspond in length to the successively longer bolts 436 and are welded at a downwardly extending angle to the inner, rear surface of moldboard 420 and project through the outer surface of the rear wall of housing 432 as shown in FIG. 37. Bolts 436 are countersunk in and received through apertures at the upper edge of blade extension 424 and pass completely through mounts 438 to receive fastening nuts thereon to secure the blade extension in position on the front surface of moldboard 420.

With reference to FIGS. 29–35, a vertical support plate 440 is welded to the edges of the housing 432 at the inner edge of wing extension 332. At the forward most edge of support plate 440 adjacent the inner edge 430 of moldboard 420, is a vertically oriented hinge support tube or hinge cylinder 442 welded to plate 440. Intermediate the ends of support tube 442 are a pair of spaced hinge plates 444, 446 which are welded to both support tube 442 and support plate 440 and extend parallel to one another outwardly away from the inner edge of the wing extension. As was the case in embodiment 10 of the plow assembly, and as shown in FIGS. 32–35, a vertical hinge pivot axis X is provided by support tube 442 while a fluid cylinder pivot axis Y is provided by aligned apertures 448 extending through hinge plates 444, 446. Hinge pivot axis X is offset from fluid cylinder pivot axis Y by a predetermined distance creating a moment arm providing torque for pivoting the wing extension on its hinge axis as will be explained more fully below.

As is best seen in FIGS. 32–35, each plow wing extension 322, 324 is pivotally mounted to the end of a generally rectangular slide member 470, 470', only one of which is described in detail herein. Subassemblies 460, 460', comprising slide member 470 and wing extension 322, or slide member 470' and wing extension 324, are both adapted to be slidably mounted telescopingly within housing 400 on rear surface of main plow moldboard 380 to allow extension, retraction and forward angling of plow wing extensions 322, 324 by fluid power cylinders 500, 502 as referenced above and explained more fully below.

Figure 33:
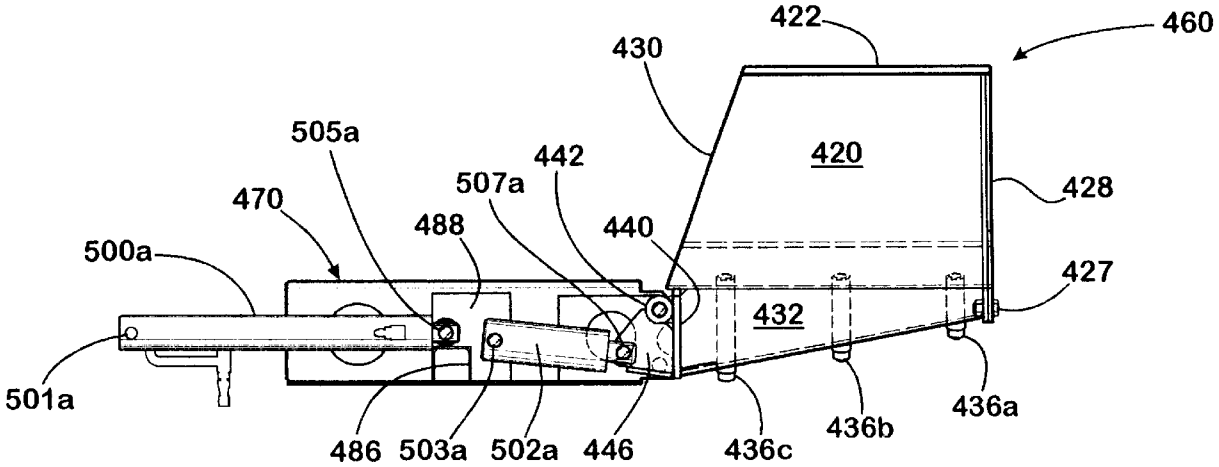
FIG. 33 is a top plan view of the subassembly of FIG. 32 with portions broken away.
Figure 33A:
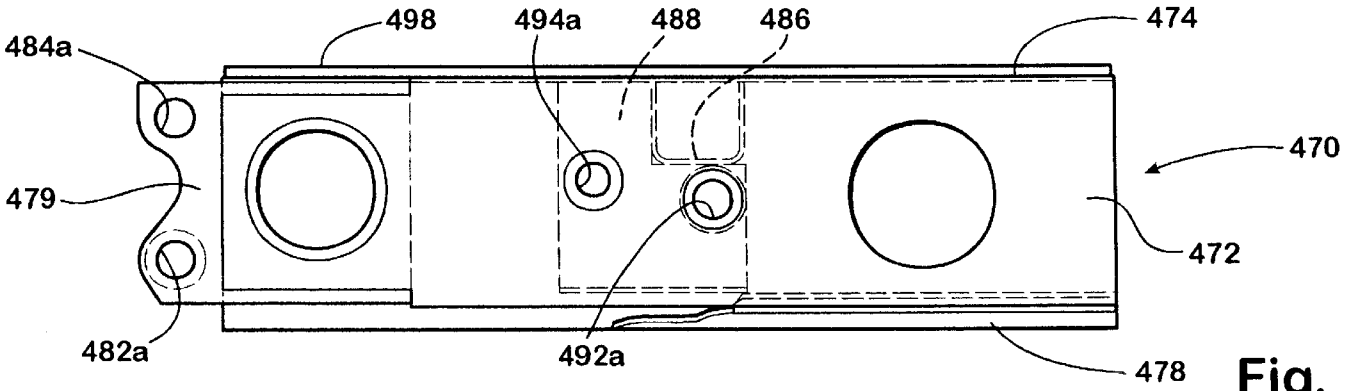
FIG. 33A is a top plan view of the slide member of the subassembly of FIGS. 32 and 33 with portions of the front wall broken away.
Figure 33B:
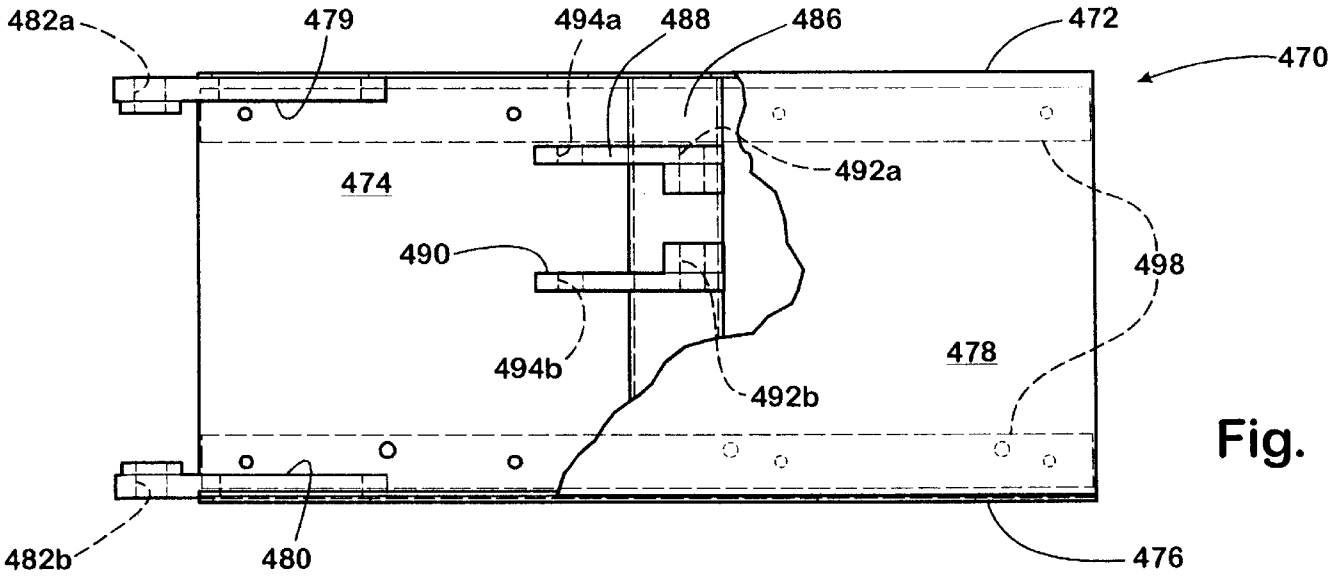
FIG. 33B is a side elevation of the slide member of FIG. 33A.

As shown in FIGS. 33A and 33B, each slide member 470, 470' is an elongated beam having a generally rectangular cross section, formed from welded steel and including a top wall 472, rear wall 474, bottom wall 476, and a concave front wall 478. The cross-sectional shape generally corresponds to the cross-section shape of housing 400. The radius of curvature of front wall 478 is substantially the same as for moldboard 380, such that front wall 478 closes slot 398, 398' when the plow wing extensions are in their extended positions or angled forwardly. A pair of parallel hinge plates 479, 480 are welded to the top and bottom walls 472, 476, respectively, on the interior of slide members 470, 470'. Hinge plates 479, 480 project outwardly from the outer end of slide member 470, 470' and provide vertically spaced, vertically aligned apertures 482*a*, 482*b* and 484*a*, 484*b* in the projecting portion of the hinge plates. On the inner surface of rear wall 474, a vertically oriented, U-shaped bent steel inner support 486 extends from top wall 472 to bottom wall 476. Spaced, parallel cylinder mount plates 488, 490 are welded to support 486 and the inner surface of rear wall 474 as shown in FIGS. 33A, 33B. Mount plates 488, 490 include two pair of vertically aligned apertures 492*a, b* and 494*a, b* which receive pivot pins for mounting the outer end and inner end of the pair of fluid cylinders for operating the wing extensions as will be more fully explained below. As shown in FIGS. 32–35, fluid power cylinder 500*a* extends into the interior space of slide member 470 from its inner end while fluid cylinder 502*a* is mounted within the interior space of slide member 470 and extends out of the outer end of the slide member for engagement with the wing extension 322.

Figures 34, 35:
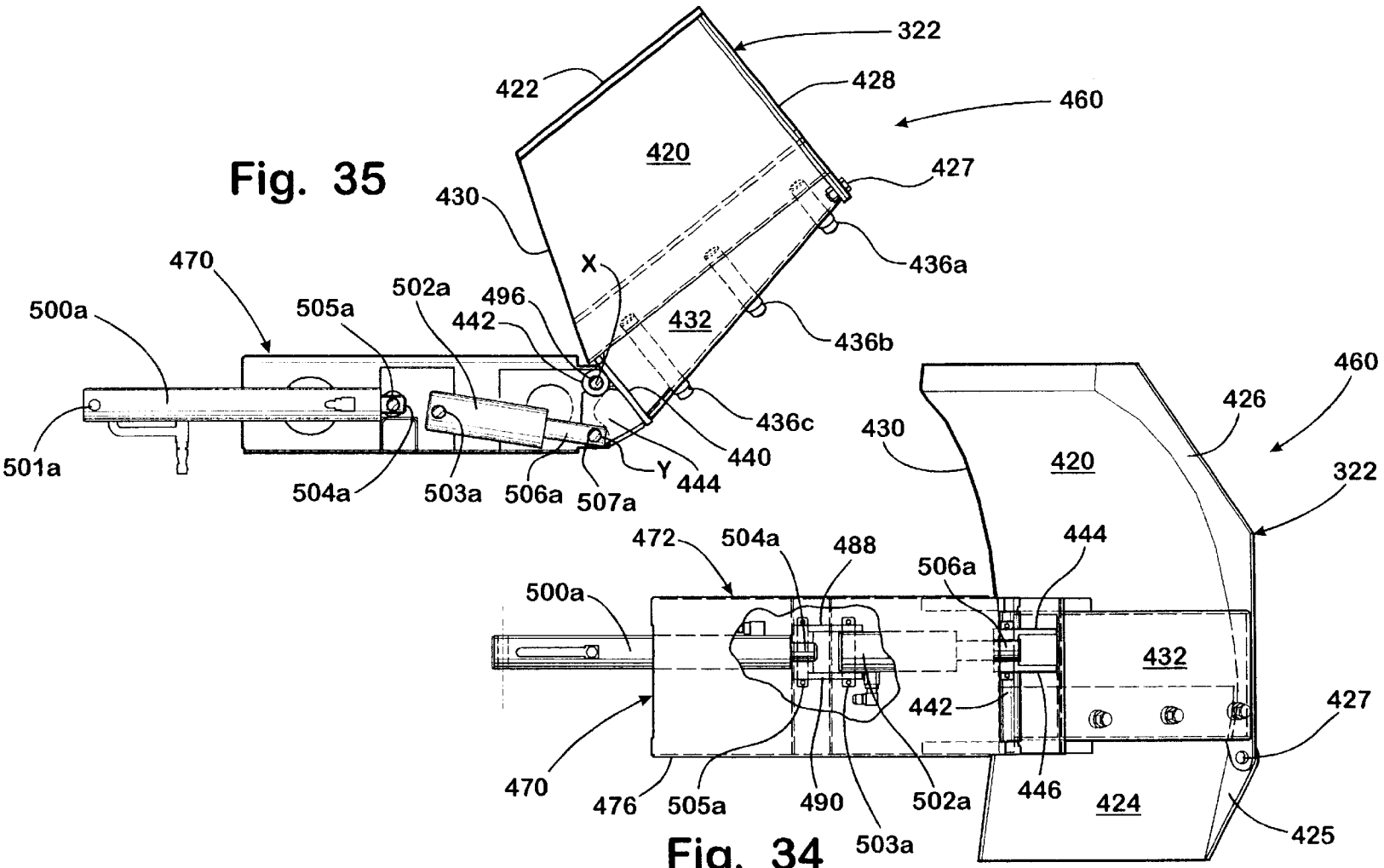
FIG. 34 is a rear elevation of the subassembly of FIGS. 32 and 33 illustrating the plow wing angled forwardly.
FIG. 35 is a top plan view of the subassembly of FIGS. 32 and 33 in the position shown in FIG. 34.

Plow wing extensions 322, 324 are pivotally mounted to the outer ends of elongated slide members 470, 470', by means of hinge plates 479, 480. As shown in FIGS. 32–35, a hinge pin 496 extends through vertically aligned apertures 482*a*, 482*b* and through cylindrical hinge tube 442 along axis X to provide the hinged movement. Wing extension 322 therefore pivots on axis X from a position in which moldboard 420 is generally rectilinearly aligned with concave front wall 478 of slide member 470 to a forwardly angled position in which moldboard 420 extends at an obtuse angle to the front wall 478 of slide member 470 (FIG. 35). In addition, slide members 470 may include elongated, synthetic wear pads or strips 498 secured to the outer surface of rear wall 474 adjacent and along the upper and lower edges of the rear wall to slidably support the slide members inside housing 400. Preferably, wear pads 498 are formed from ultra high molecular weight (UHMW) polyethylene, although other materials, such as Teflon, steel and the like could also be used. As shown in FIGS. 36 and 37, however, the bottom wall 476 of slide member 470 engages the inner surface of bottom wall 404 of housing 400 to slidingly support the slide member 470 within the housing using suitable lubricants. Optionally, slide member 470 may slidably engage slide support or housing 400 using suitable lubricants and without any wearpads.

As best seen in FIGS. 24, 25, 32–35, 38 and 39, each subassembly of a slide member 470, 470' and wing extension 322, 324 is operated between its retracted, extended and forwardly angled positions by a pair of extendable, hydraulic fluid power cylinders 500*a*, 502*a* and 500*b*, 502*b*. Fluid cylinders 500*a*, 500*b* include extendable piston rods 504*a*, 504*b* while fluid cylinders 502*a*, 502*b* include extendable piston rods 506*a*, 506*b*. Fluid cylinders 500*a*, 500*b* are longer and extend piston rods 504*a*, 504*b* a greater distance than fluid cylinders 502*a*, 502*b* and piston rods 506*a*, 506*b*. The inner end of fluid cylinders 500*a*, 500*b* are pivotally mounted by pivot pins 501*a*, 501*b* extending between cylinder mount plates 508, 510 welded to the interior surface of upper wall 402 and bottom wall 404 of slide housing 400, as shown in FIG. 24. A rectangular aperture is provided through rear wall 406 adjacent plates 508, 510 for access to the fluid cylinders. The outer end of extendable piston rods 504*a*, 504*b* is pivotally secured by pivot pins 505*a*, 505*b* mounted through vertically aligned apertures 492*a*, 492*b* or 492*a*', 492*b*', respectively. Likewise, fluid cylinders 502*a*, 502*b* are respectively pivotally connected via pivot pins 503*a*, 503*b* passed through vertically aligned apertures 494*a*, 494*b* or 494*a*', 494*b*' and through the end of the fluid cylinders. The outer end of extendable piston rods 506*a*, 506*b* are pivotally connected via hinge pins 507*a*, 507*b* passed through the vertically aligned apertures 448 defining axis Y in hinge plates 444, 446 or 444', 446'. Because of the offset between pivot axes X and Y, when fluid cylinder rods 506*a*, 506*b* are extended from cylinders 502*a*, 502*b*, the moment arm of the offset created by the positioning of the cylinder rods rotates wing extensions 322, 324 forwardly about hinge pins 496, 496'. The pivotal or rotational movement of wings 322, 324 may be simultaneous with or independent of outward extension or retraction of the wings via extension or retraction of fluid cylinder rod 504*a*, 504*b*. Fluid cylinders 500, 502 act to hold and restrain the wing extensions 322, 324 in the position in which they are located without the need for a latch assembly of the type used in embodiment 10 described above.

With reference to FIGS. 36 and 37, it will now be understood that the subassemblies 460, 460' of slide members 470, 470' and their pivotally attached wing plow extensions 322, 324, respectively, are telescopingly mounted within the interior of slide support or housing 400 for sliding rectilinear movement within the outer housing along a common axis. When extension of either wing 322, or 324 is desired, the respective fluid cylinder 500 is activated by means of a hydraulic control system described more fully below to extend piston rod 504, thereby moving slide member 470 or 470' outwardly along with wing extensions 322 or 324. Fluid cylinder 500 moves slide member 470, 470' outwardly to its full extension while moldboard 420 may remain substantially parallel to the front surface of main plow 312 and its moldboard sections 383, 385. At the position of full extension, curved front walls 478, 478' of slide members 470, 470' substantially close slots 398, 398' along the front surface of the plow so that the snow or other material being plowed continues to move along the moldboard without interruption. In the event it is desired to pivot one or both of the wing extensions 322, 324 forwardly, the second fluid cylinder 502*a*, 502*b*, respectively, or both, are activated to pivot the wings about pivot 496, 496' until the wings are angled forwardly as shown in FIGS. 25, 34, 35, 38 and 39, such that the entire plow has a U-shaped configuration. The plow wings may be individually or simultaneously selectively pivoted or extended or both, in order to position each wing in a desired orientation with respect to the main plow blade, depending on the situation encountered with the plow assembly. Therefore, the plow wings may be angled forwardly irrespective of a degree of extension/retraction of the plow wing relative to the main plow blade. Likewise, the plow wings may be extended or retracted irrespective of a degree of forward angle of the plow wings relative to the main plow blade. This provides greater versatility of the plow, since the wings may be fully retracted and angled forwardly or fully extended and not angled forwardly, or any degree of extension and/or angling of the one or both plow wings with respect to the main plow blade. As explained below, the plow operator simply selectively operates one or more switches to extend fluid cylinders 500*a*, 500*b* and/or fluid cylinders 502*a*, 502*b*, such that the slide member is extended and/or the wing extensions are pivoted forwardly all in a continuous movement or motion. Unlike embodiment 10 of the plow assembly, no separate stop or latch mechanisms are necessary to control extension or retraction of slide members 470, 471 since such control is selected by the operator. Likewise, the hydraulic pressure in the fluid cylinders resists rearward pivoting of the forwardly angled wing extensions during plowing. In the event an obstacle is encountered, extreme pressure created within the fluid cylinders 502*a*, 502*b* would be relieved through the hydraulic system to prevent rupture of hydraulic lines or damage to any of the components.

Figure 40:
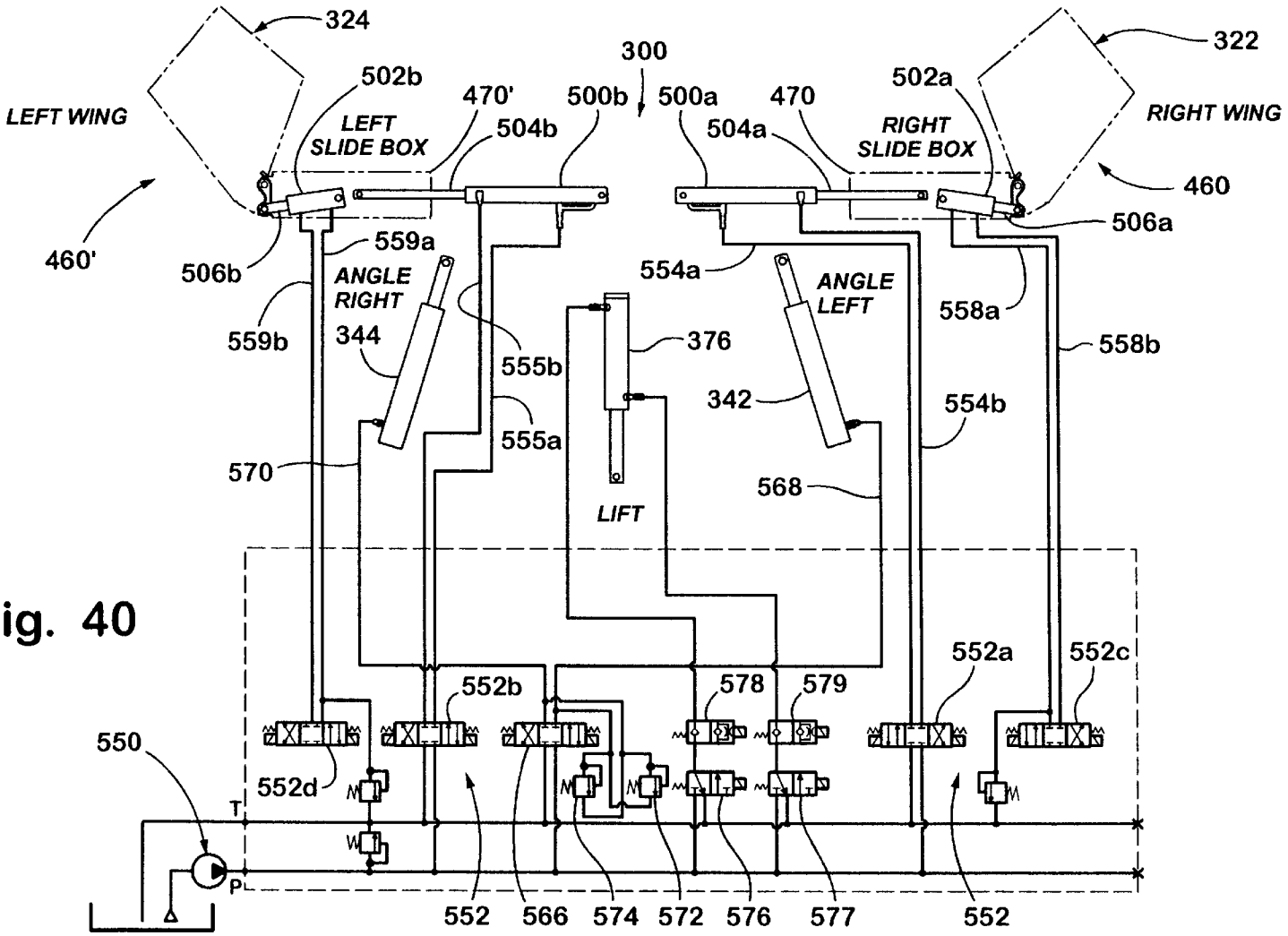
FIG. 40 is a schematic illustration of the hydraulic system for operation of the second embodiment of the adjustable wing plow assembly of FIGS. 24–39.

As shown in FIG. 40, each fluid cylinder 500*a*, 502*a*, 500*b*, and 502*b* is controlled by its own respective solenoid operated hydraulic valve and cooperating hydraulic relief valve via electrical switches (not shown) mounted in the cab of the plowing vehicle. A conventional hydraulic pump 550 creates hydraulic line pressure which is directed by electric solenoid operated spool valves 552*a*, 552*b* through lines 554*a*, 555*a* to the inner end of fluid cylinder 500*a*, 500*b*, thereby extending piston rod 504*a*, 504*b* upon closure of an appropriate electrical switch in the vehicle cab by the vehicle/plow operator. This shifts solenoid valve 552*a* or 552*b* to the left or right, respectively, in FIG. 40. Alternately, or additionally, the operator may actuate other electrical switches in the cab to direct pressurized fluid via electric solenoid operated spool valves 552*c*, 552*d* through lines 558*a*, 559*a* to the inner end of fluid cylinders 502*a*, 502*b*, respectively, causing extension of piston 506*a* or 506*b* and thereby pivoting wing extension 322 or 324 forwardly as shown in FIG. 40. Thus, the plow operator may selectively depress an appropriate switch or switches to cause fluid pressure to extend cylinder 500*a* or 500*b* and/or extend cylinder 502*a* or 502*b* through the operation of valves 552. Release of the switches causes solenoid valves 552*a*, 552*b*, 552*c*, 552*d* to return to their centered positions thereby holding fluid cylinders 500*a*, 500*b*, 502*a*, and/or 502*b* in their extended and/or forwardly pivoted positions.

When return of wing extensions 322, 324 to their non-angled positions and/or retraction of slide members 470, 470' is desired, however, solenoid valves 552*a*, 552*b*, 552*c* and/or 552*d* are activated in the reverse direction by moving or depressing the appropriate electrical switch, thereby shifting the spool valve to the opposite side. Hydraulic pressure is directed through lines 558*b* and/or 559*b* to the outer end of fluid cylinders 502*a* and/or 502*b* causing retraction of piston rod 506*a* or 506*b* and pivoting wing 322 or 324 to its non-angled position from its forwardly angled position, while hydraulic pressure may alternately or additionally be directed through lines 554*b*, 555*b* to the outer end of fluid cylinders 500*a*, 500*b*, thereby causing retraction of piston rods 504*a*, 504*b* and hence, slide members 470, 470' including wing extension 322, 324. Again, such retraction of the piston rods in the fluid cylinders occurs continuously via the operator selectively throwing the appropriate switches.

Optionally, the actuators for each wing may be controlled via a single solenoid operated spool valve (not shown) and a pressure relief or sequencing valve (not shown), such that actuation of the spool valve extends actuator 502*a*, 502*b* until the wing or wings are fully angled forwardly. As pressure builds up in the lines, the relief valve then functions to direct pressurized fluid to the other actuator 500*a*, 500*b* to then extend the wings outwardly along the plow. The wings are thus pivotable and then extendable automatically in a generally smooth, continuous and uninterrupted manner. A second spool valve and relief valve may be provided to provide continuous and uninterrupted movement of the plow wings in the opposite direction or from their extended and forwardly angled position to their retracted and aligned position. The relief valve may be operable to restrict pivoting of the wings toward the aligned position until after the wings have been fully retracted along the plow.

If desired, electronic devices or switches, such as cam operated micro switches 565*a*, 565*b*, may be mounted at housing 100, such as on housing top wall 402 (FIGS. 24, 36 and 37), to stop extension of the cylinders 500*a*, 500*b* and slide members 470, 470', at a desired or outermost extended position, followed by actuation of a separate switch to cause extension of actuators 502*a*, 502*b*, in response to actuation by an operator of a single appropriate switch at the vehicle. Micro switches 565*a*, 565*b* each include a flexible strap which extends through an aperture in top wall 402 of housing 400 and flexes away from the plunger on an electrical switch when slide member 470, 470' is extended, but is flexed into contact with the switch plunger when the slide member is retracted. The electronic switch is operable to deactivate the respective actuator 500*a*, 500*b* in response to a threshold amount of movement of the plow wing (corresponding to the fully extended position or fully retracted position of the plow wing) along the rear surface of the plow. When the plow wing and slide reach their fully extended position. the electronic device or system is further operable (if the operator continues to depress an appropriate switch at the vehicle) to actuate the other actuator 502*a*, 502*b* to automatically pivot the plow wing forwardly once it is extended. This provides a smooth, continuous and uninterrupted motion of the plow wings from their retracted and aligned position to their extended and forwardly angled position. Although shown as a switch that detects and responds to outward movement of the plow wing, it is further envisioned that the electronic device may detect rotational movement of the plow wing, such that the system is operable to first pivot the wings forwardly and then automatically extend the wings outwardly in response to a threshold amount of rotation of the plow wing (corresponding to the plow wing reaching its fully forwardly angled position. Clearly, other stop members or limit switches may be implemented to deactuate one actuator and subsequently or substantially simultaneously actuate the other actuator, such that the plow wings are movable in a smooth, continuous and uninterrupted manner between the retracted and aligned position and the extended and forwardly angled position, whether the wings are first extended, then pivoted or first pivoted, then extended, without affecting the scope of the present invention.

As shown in FIG. 40, valving for operating the fluid cylinders 342, 344 to pivot the plow assembly about support 314 and axis 362 to the left or right is provided through solenoid operated valve 566 which is shifted to the right by operation of an electrical switch to angle the plow assembly to the left with fluid cylinder 342 through hydraulic line 568, and shifted to the right through the reversal of the same switch to angle the plow assembly to the right with fluid cylinder 344 through hydraulic line 570. Appropriate relief valves 572, 574 are connected, respectively, to lines 568, 570 in the event pressure on the plow during plowing forces the plow in the opposite pivotal direction and creates extreme pressure within the hydraulic system.

Likewise, a solenoid operated valve 576 and an electrically operated check valve 578 may be shifted to the left to activate the lift cylinder 376 in the event such a cylinder is included on the support 314. Return of check valve 578 to its right-hand position retains cylinder 376 in its extended position. Similarly, to retract cylinder 376, solenoid operated valve 577 and check valve 579 are shifted to the left, after which release of check valve 579 holds cylinder 376 in its retracted position.

Although shown and described as hydraulic fluid cylinders with extendable and retractable rods, clearly, actuators 200, 202, 500*a*, 500*b*, 502*a*, and/or 502*b* may comprise other means for extending and retracting or pivoting the plow wings relative to the main plow. For example, the actuators may comprise linear actuators which include a rotating screw and ball mechanism, as are known in the art, a rotary driven gear or sprocket which engages a movable member, such as a timing belt or toothed track, to impart a generally linear or translational movement of the movable member, or any other device or means for extending, retracting and/or pivoting the plow wings, without affecting the scope of the present invention. It is further envisioned that an electrical or hydraulic rotary motor or other rotational means may rotate to cause pivoting movement of the plow wings with respect to the main plow, without affecting the scope of the present invention. It is also envisioned that the actuators may even be manually operable mechanical devices, such as a hand crank or lever, which may be operable to linearly or rotationally move one or both of the plow wings with respect to the main plow. Other means for imparting a linear or rotational movement to the plow wings may be implemented without affecting the scope of the present invention. In situations where a hydraulic cylinder is not implemented, an additional stop or locking mechanism may be desired to lock or retain the plow wings in the desired position, such that the wings are not pivoted when resistance is encountered by the plow as it is moved by the vehicle.

As will also be appreciated, it is also possible to support the plow assembly including main plow 12 or 312 and wing extensions 22, 24 or 322, 324 on a support other than support frame 14 or 314 and intermediate support 16 or 316 at the front of a vehicle. For example, should the plow be used on a grader, or other excavation or construction vehicle, an overhead beam may include downwardly extending rods or other supports which engage rear mounting flanges 54, 56 or 354, 356 from above to support the assembly in the normal horizontal position shown in the drawings. Other supports such as bulldozer type support arms extending from the rear of the plow to a support frame on a vehicle may also be used with this plow assembly.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted according to the principles of patent law, including the Doctrine of Equivalents.

The embodiments of the invention in which an exclusive property or privilege is claimed are defined as follows:

1. A plow assembly for vehicles, said assembly comprising:

a plow having first and second ends, a front material engaging surface, and a rear surface opposite said front surface;

a support for attaching said plow to the vehicle;

a plow wing on said first end of said plow, said wing having inner and outer ends, a front, material engaging surface, and rear surface opposite said front surface, said plow wing being mounted for sliding movement along said plow at said first end between a retracted position in which said outer end of said plow wing is adjacent said first end of said plow, and an extended position in which said outer wing end is spaced outwardly of said retracted position;

said plow wing including a hinge, said plow wing being pivotally mounted on said hinge for movement between an aligned position in which said material engaging surface of said plow wing is aligned with said front material engaging surface of said plow, and a forwardly angled position in which said wing front surface extends at an angle to said plow front surface; and at least one actuating device connected to said plow wing which is operable to move said plow wing between said aligned position and said forwardly angled position and to move said plow wing between said retracted and said extended positions, said at least one actuating device being operable to move said plow wing between said aligned position and said forwardly angled position at least when said plow wing is in said retracted position.

2. The plow assembly of claim 1, wherein said at least one actuating device is operable to move said plow wing to said forwardly angled position prior to moving said plow wing from said retracted position to said extended position.

3. The plow assembly of claim 2, wherein said at least one actuating device is operable to move said plow wing between a retracted and aligned position and an extended and forwardly angled position in a generally continuous and uninterrupted manner.

4. The plow assembly of claim 3 further including a restraining mechanism which is operable to limit extension of said plow wing from said retracted position until after said plow wing has been fully moved to said forwardly angled position.

5. The plow assembly of claim 4, wherein said restraining mechanism comprises a biasing member which biases said plow wing toward said retracted position.

6. The plow assembly of claim 4, wherein said restraining mechanism comprises a pair of latch members, one of said latch members being operable to limit outward movement of said plow wing until said plow wing is in said forwardly angled position, and the other of said latch members being operable to retain said plow wing in said forwardly angled position until said plow wing is retracted to said retracted position.

7. The plow assembly of claim 1, wherein said at least one actuating device comprises first and second actuating devices, said first actuating device being operable to move said plow wing between said retracted and said extended positions and said second actuating device being operable to move said plow wing between said aligned position and said forwardly angled position.

8. The plow assembly of claim 7, wherein said first and second actuating devices are operable independently of one another.

9. The plow assembly of claim 8, wherein said first and second actuating devices comprise hydraulic cylinders, each of said first and second actuating devices being actuatable by at least one respective first and second valve, said first and second valves being independently operable of one another.

10. The plow assembly of claim 8, wherein said first and second actuating devices comprise hydraulic cylinders, said first and second actuating devices being actuatable by at least one respective first and second valve, said first and second valves being sequentially operable to actuate said first and second actuating devices in a desired order.

11. The plow assembly of claim 10, wherein said first and second valves are sequentially operable in response to a limit switch which is operable to deactuate one of said first and second valves and actuate the other of said first and second valves in response to a threshold movement of said plow wing relative to said plow.

12. The plow assembly of claim 11, wherein said plow assembly is operable to move said plow wing to said forwardly angled position prior to moving said plow wing to said extended position, said limit switch being operable to deactuate said second valve and said second actuating device and actuate said first valve and said first actuating device in response to a threshold amount of pivoting of said plow wing relative to said plow.

13. The plow assembly of claim 7 including a slide mounted on said plow, said plow wing and hinge being mounted on and movable with said slide.

14. The plow assembly of claim 13, wherein each of said first and second actuating devices has two ends, one end of said first actuating device being pivotally connected to said rear surface of said plow, the other end of said first actuating device being pivotally connected to said slide, one end of said second actuating device being pivotally connected to said slide, the other end of said second actuating device being pivotally connected to said hinge.

15. The plow assembly of claim 14, wherein said hinge is pivotally connected to said slide along a generally vertical pivot axis, said other end of said second actuating device being pivotally connected to said hinge at a distance from said vertical pivot axis.

16. The plow assembly of claim 15, wherein said other end of said first actuating device is pivotally connected to said slide at a position spaced from the position at which said one end of said other fluid cylinder is pivotally connected to said slide.

17. The plow assembly of claim 1 including a slide mounted on said plow, said plow wing and hinge being mounted on and movable with said slide.

18. The plow assembly of claim 17 further including a restraining mechanism which is operable to limit extension of said plow wing from said retracted position until after said plow wing is in said forwardly angled position.

19. The plow assembly of claim 18, wherein said restraining mechanism comprises a biasing member connected between said slide and said plow, said biasing member biasing said slide toward said retracted position.

20. The plow assembly of claim 18, wherein said restraining mechanism comprises first and second latch members, said first latch member being engagable to limit outward movement of said slide and being disengagable to allow outward movement of said slide in response to said plow wing pivoting to said forwardly angled position, said second latch member being engagable to limit pivotal movement of said plow wing relative to said slide when said plow wing is in said forwardly angled position, said second latch member being disengagable to allow pivoting of said plow wing toward said aligned position in response to a release member when said slide is moved to said retracted position.

21. The plow assembly of claim 17, wherein said slide is telescopically mounted within a housing on said rear surface of said plow, said plow including an opening therethrough through which said hinge extends to support said plow wing for sliding movement along said plow.

22. The plow assembly of claim 1 including a second plow wing on said second end of said plow, said second plow wing being mounted for sliding movement along said plow at said second end between a retracted position in which said outer end of said wing is adjacent said second end of said plow, and an extended position in which said outer wing end is spaced outwardly of said retracted position of said second plow wing, said second plow wing also including a second hinge, said second plow wing being pivotally mounted on said second hinge for movement between said an aligned position in which said material engaging surface of said second plow wing is aligned with said front material engaging surface of said plow, and a forwardly angled position in which a front surface of said second plow wing extends at an angle to said plow front surface, said at least one actuating device comprising at least two actuating devices, at least one of said at least two actuating devices being operable to move said second plow wing between said aligned position and said forwardly angled position and to move said second plow wing between said retracted and said extended positions, said at least one of said at least two actuating devices being operable to move said second plow wing between said aligned position and said forwardly angled position at least when said second plow wing is in said retracted position.

23. The plow assembly of claim 22 including first and second slides mounted on said plow, said first plow wing and said hinge being mounted on and movable with said first slide, said second plow wing and second hinge being mounted on and movable with said second slide.

24. The plow assembly of claim 23, wherein said first and second slides are telescopically mounted within at least one housing on said rear surface of said plow, said plow including a first opening therethrough through which said hinge extends to support said plow wing for sliding movement along said plow, said plow including a second opening therethrough through which said second hinge extends to support said second plow wing for sliding movement along said plow.

25. The plow assembly of claim 23, wherein said at least two actuating devices are operable to move a respective one of said plow wing and said second plow wing from a retracted and aligned position to a retracted and forwardly angled position and then to an extended and forwardly angled position in a generally continuous and uninterrupted manner.

26. The plow assembly of claim 25 further including at least one restraining mechanism which is operable to limit extension of said plow wing and said second plow wing from said retracted position until after a respective one of said plow wing and said second plow wing is moved to said forwardly angled position.

27. The plow assembly of claim 23, wherein said at least two actuating devices comprise a first pair of actuating devices which includes first and second actuating devices and a second pair of actuating devices which includes third and fourth actuating devices, said first actuating device being operable to move said plow wing between said retracted and said extended positions, said second actuating device being operable to move said plow wing between said aligned position and said forwardly angled position, said third actuating device being operable to move said second plow wing between said retracted and said extended positions, and said fourth actuating device being operable to move said second plow wing between said aligned position and said forwardly angled position.

28. The plow assembly of claim 27, wherein each of said first, second, third and fourth actuating devices have two ends, one end of said first and third actuating devices being pivotally connected to said rear surface of said plow blade, the other end of said first actuating device being pivotally connected to said first slide, the other end of said third actuating device being pivotally connected to said second slide, one end of said second actuating device being pivotally connected to said first slide, the other end of said second actuating device being pivotally connected to said hinge, one end of said fourth actuating device being pivotally connected to said second slide, the other end of said fourth actuating device being pivotally connected to said second hinge.

29. The plow assembly of claim 28, wherein said hinge is pivotally connected to said first slide along a first generally vertical pivot axis, said other end of said second actuating device being pivotally connected to said hinge at a distance from said first vertical pivot axis, said second hinge being pivotally connected to said second slide along a second generally vertical pivot axis, said other end of said fourth actuating device being pivotally connected to said second hinge at a distance from said second vertical pivot axis.

30. The plow assembly of claim 29, wherein said other end of said first actuating device is pivotally connected to said first slide at a position spaced from the position at which said one end of said second actuating device is pivotally connected to said first slide, said other end of said third actuating device being pivotally connected to said second slide at a position spaced from the position at which said one end of said fourth actuating device is pivotally connected to said second slide.

31. The plow assembly of claim 27, wherein said first, second, third and fourth actuators are operable independently of one another.

32. The plow assembly of claim 31, wherein said first, second, third and fourth actuators comprise hydraulic cylinders, each of said first, second, third and fourth actuators being actuatable in response to at least one respective first, second, third and fourth valves.

33. The plow assembly of claim 32, wherein said first and second valves are operable in response to a first limit switch and said third and fourth valves are operable in response to a second limit switch, said first and second limit switches being operable to deactuate a respective one of said first, second, third and fourth valves and actuate the other respective one of said first, second, third and fourth valves in response to a threshold amount of movement of a respective one of said plow wing and said second plow wing relative to said plow.

34. A plow assembly for vehicles, said assembly comprising:

a plow having first and second ends, a front material engaging surface, and a rear surface opposite said front surface;

a support for attaching said plow to the vehicle;

first and second plow wings, each wing having inner and outer ends, a front, material engaging surface, and a rear surface opposite said front surface, said first wing being mounted for sliding movement along said front surface of said plow at said first plow end, said second wing being mounted for sliding movement along said front surface of said plow at said second plow end, each of said wings being movable between a retracted position in which said outer end of said wing is adjacent its respective end of said plow, and an extended position in which said outer wing end is spaced outwardly of its retracted position;

said first plow wing including a first hinge and being pivotally mounted on said first hinge for movement between an aligned position in which said front surface of said first plow wing is aligned with said front surface of said plow, and a forwardly angled position in which said front surface of said first plow wing extends at an angle to said plow front surface, said second plow wing including a second hinge and being pivotally mounted on said second hinge for movement between an aligned position in which said front surface of said second plow wing is aligned with said front surface of said plow, and a forwardly angled position in which said front surface of said second plow wing extends at an angle to said plow front surface; and at least two extendable actuators including at least one first actuator operable to move said first plow wing, and at least one second actuator operable to move said second plow wing, each of said plow wings being operable independently of the other plow wing such that said plow wings are independently movable between said respective retracted, extended, aligned and forwardly angled positions, said plow wings forming a general U-shape with said plow when both plow wings are in their forwardly angled positions to facilitate pushing material being plowed without such material slipping off the plow ends, said at least one first actuator being operable to move said first plow wing between said aligned position and said forwardly angled position irrespective of a degree of extension of said first plow wing, said at least one second actuator being operable to move said second plow wing between said aligned position and said forwardly angled position irrespective of a degree of extension of said second plow wing.

35. The plow assembly of claim 34 including first and second slides mounted on said plow, said first plow wing and first hinge being mounted on and movable with said first slide, said second plow wing and second hinge being mounted on and movable with said second slide.

36. The plow assembly of claim 35 further including first and second restraining mechanisms which are operable to limit extension of a respective one of said first and second plow wings until after the respective plow wing is moved to said forwardly angled position.

37. The plow assembly of claim 36, wherein said first and second restraining mechanisms comprise first and second biasing members connected between a respective one of said first and second slides and said plow, said biasing members biasing said slides toward said retracted position.

38. The plow assembly of claim 36, wherein each of said first and second restraining mechanisms comprise a pair of latch members, one of said latch members being engagable between said plow and a respective one of said slides to limit outward movement of the respective slide and disengagable to allow outward movement of said slide in response to a respective one of said plow wings pivoting to said forwardly angled position, the other of said latch members being engagable between the respective plow wing and slide to limit pivotal movement of said plow wing when said plow wing is in said forwardly angled position, said other latch member being disengagable to allow pivoting of said plow wing toward said aligned position in response to a release member at said plow contacting said other latch member when said respective slide is moved to said retracted position.

39. The plow assembly of claim 35, wherein each slide is telescopically mounted within a housing on said rear surface of said plow, said plow including first and second openings therethrough, said first hinge extending through said first opening to support said first plow wing for sliding movement along said front surface of said plow, said second hinge extending through said second opening to support said second plow wing for sliding movement along said front surface of said plow.

40. The plow assembly of claim 34, wherein said at least one first and second actuators are operable to move said plow wing between a retracted and aligned position and an extended and forwardly angled position in a generally continuous and uninterrupted manner.

41. The plow assembly of claim 40, wherein said at least one first and second actuators are operable to first move said first and second plow wings from said retracted and aligned position to a retracted and forwardly angled position and then move said first and second plow wings from said retracted and forwardly angled position to said extended and forwardly angled position.

42. The plow assembly of claim 34, wherein said at least one first actuator includes a first pair of actuators and said at least one second actuator includes a second pair of actuators, one actuator of each of said first and second pairs of actuators being operable to move a respective one of said plow wings between said aligned position and said forwardly angled position, the other actuator of said first and second pairs of actuators being operable to move said respective one of said plow wings between said retracted position and said extended position.

43. The plow assembly of claim 42, wherein each actuator of said first and second pairs of actuators is operable independently of the other actuator of the respective pair of actuators.

44. The plow assembly of claim 43, wherein said actuators comprise hydraulic cylinders, each of said first and second pairs of actuators being actuatable by at least one of a respective one of at least four valves, each of said valves being selectably operable by an operator of said plow assembly.

45. The plow assembly of claim 44, wherein said valves are sequentially operable to first actuate a respective one of said actuators to move a respective one of said first and second plow wings from a retracted and aligned position to a retracted and forwardly angled position and to then actuate the respective one of said actuators to move the respective plow wing from said retracted and forwardly angled position to an extended and forwardly angled position.

46. A plow assembly for vehicles, the vehicle having a longitudinal axis generally aligned with the direction of motion of the vehicle when traveling in forward or reverse, said assembly comprising:

a plow having first and second ends, a front material engaging surface, and a rear surface opposite said front surface;

a support for attaching said plow to the vehicle;

first and second extendable plow wings, each wing having inner and outer ends, a front, material engaging surface, and a rear surface opposite said front surface, said first wing being mounted for sliding movement along said front surface of said plow at said first plow end, said second wing being mounted for sliding movement along said front surface of said plow at said second plow end, each of said plow wings being movable between a retracted position in which said outer end of said wing is adjacent its respective end of said plow and an extended position in which said outer wing end is spaced outwardly from its retracted position;

each plow wing also including a hinge and being pivotally mounted on said hinge for movement between an aligned position in which said front surface of said plow wing is generally aligned with said front surface of said plow, and a forwardly angled position in which said wing front surface extends at an angle to said plow front surface;

first and second slides mounted on said plow, said first plow wing and first hinge mounted on and movable with said first slide, said second plow wing and second hinge mounted on and movable with said second slide;

said plow including first and second openings extending through said front material engaging surface, said first slide being slidably mounted on said rear surface of said plow in alignment with said first opening with said first hinge extending through said first opening for pivotally mounting said first plow wing, said second slide being slidably mounted on said rear surface of said plow in alignment with said second slide with said second hinge extending through said second opening for pivotally mounting said second plow wing, each of said slides including a wall covering said respective first or second opening when said plow wing is at least partially extended toward said extended position such that said openings through said front material engaging surface of said plow are closed when said plow wings extended; and at least one extendable actuator operable to move said first and second plow wings, each of said plow wings being operable independently of the other plow wing such that said plow wings are independently movable between said respective, retracted, extended, aligned and forwardly angled positions.

47. The plow assembly of claim 46, wherein said at least one actuator includes at least two actuators, one of said at least two actuators being operable to move said first plow wing and the other of said at least two actuators being operable to move said second plow wing.

48. The plow assembly of claim 47, wherein each of said at least two actuators is operable to move a respective one of said first and second plow wings from a retracted and aligned position to a retracted and forwardly angled position and further to an extended and forwardly angled position in a generally continuous and uninterrupted manner.

49. The plow assembly of claim 47, wherein said at least two actuators include two pair of actuators including a first pair of actuators operable to move said first plow wing, and a second pair of actuators operable to move said second plow wing, each actuator of each of said two pair of actuators being operable independently of one another.

50. The plow assembly of claim 49, wherein said two pair of actuators comprise two pair of hydraulic cylinders, each of said actuators being extendable and retractable in response to at least one hydraulic valve.

51. The plow assembly of claim 50, wherein each of said valves is selectably actuatable by an operator of said plow assembly.

52. The plow assembly of claim 50, wherein at least two of said valves are sequentially operable to first actuate a respective one of said actuators to move a respective one of said first and second plow wings from a retracted and aligned position to a retracted and forwardly angled position and then to actuate a respective other one of said actuators to move the respective plow wing from said retracted and forwardly angled position to an extended and forwardly angled position.

53. The plow assembly of claim 52, wherein said at least two of said valves are sequentially operable in response to a limit switch which is operable to deactuate the respective one of said actuators and actuate the respective other one of said actuators in response to a threshold amount of pivotal movement of the respective plow wing relative to said plow.

54. The plow assembly of claim 51, wherein said plow is pivotally mounted on said support frame for movement about a first, generally vertical pivot axis from a centered position extending generally transverse to the longitudinal axis of the vehicle to a series of angled positions in which said plow is angled to the left or right of said centered position.

55. A method for adjusting at least one plow wing of a plow assembly comprising:

providing a plow assembly which is mountable to a vehicle and includes a plow and at least one plow wing on an end of said plow, said plow wing being mounted for extension along said plow at an end between a retracted position in which an outer end of said plow wing is adjacent an end of said plow, and an extended position in which the outer end of said plow wing is spaced outwardly of said retracted position, said plow wing being pivotally mounted for movement between an aligned position in which a front surface of said plow wing is aligned with a front material engaging surface of said plow, and a forwardly angled position in which said wing front surface extends at an angle to said plow front surface;

pivoting said at least one plow wing from a retracted and aligned position to a retracted and forwardly angled position via at least one actuator; and moving said at least one plow wing from said retracted and forwardly angled position to an extended and forwardly angled position via said at least one actuator.

56. The method for adjusting at least one plow wing of claim 55, wherein said steps of pivoting and moving said at least one plow wing are performed in a generally continuous, uninterrupted manner.

57. The method for adjusting at least one plow wing of claim 56, wherein during said step of pivoting said at least one plow wing, a stop member restricts movement of said plow wing toward said extended position and said step of moving said at least one plow wing is in response to one of overcoming a biasing force of said stop member and disengaging said stop member to allow movement of said at least one plow wing along said plow.

58. The method for adjusting at least one plow wing of claim 55, wherein said step of pivoting said at least one plow wing is in response to actuating a first actuator and said step of moving said at least one plow wing is in response to actuating a second actuator.

59. The method for adjusting at least one plow wing of claim 58, wherein said steps of pivoting and moving said at least one plow wing are performed in a generally continuous, uninterrupted manner.

60. The method for adjusting at least one plow wing of claim 59, wherein prior to said step of pivoting said at least one plow wing, s aid method includes selectably actuating said first actuator, and prior to said step of moving said at least one plow wing, said method includes actuating said second actuator in response to a threshold amount of pivoting of said at least one plow wing.

61. The method for adjusting at least one plow wing of claim 58, wherein said first and second actuators comprise extendable and retractable hydraulic cylinders, said method including providing said first actuator with at least one first hydraulic valve and providing said second actuator with at least one second hydraulic valve, said first and second hydraulic valves being independently operable to extend and retract said first and second actuators.

62. The method for adjusting at least one plow wing of claim 55 including:

moving said at least one plow wing from said extended and forwardly angled position to said retracted and forwardly angled position via said at least one actuator; and pivoting said at least one plow wing from said retracted and forwardly angled position to said retracted and aligned position via said at least one actuator.

63. The method for adjusting at least one plow wing of claim 55, wherein said plow wing is mounted on an end of said plow for sliding movement along said plow.

64. The method for adjusting at least one plow wing of claim 55, wherein said at least one plow wing comprises two plow wings, one at each end of said plow.

* * * * *